US008380111B2

(12) United States Patent
Murakami et al.

(10) Patent No.: US 8,380,111 B2
(45) **Date of Patent: *Feb. 19, 2013**

(54) DEVELOPER SUPPLY CONTAINER AND DEVELOPER SUPPLYING SYSTEM

(75) Inventors: Katsuya Murakami, Toride (JP); Toshiaki Nagashima, Moriya (JP); Ayatomo Okino, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/336,615

(22) Filed: Dec. 23, 2011

(65) Prior Publication Data

US 2012/0099904 A1 Apr. 26, 2012

Related U.S. Application Data

(62) Division of application No. 12/301,741, filed as application No. PCT/JP2007/060934 on May 23, 2007.

(30) Foreign Application Priority Data

May 23, 2006 (JP) ..... 2006-142456

(51) Int. Cl.
*G03G 15/08* (2006.01)

(52) U.S. Cl. ..... 399/258; 399/106; 399/111; 399/119; 399/120; 399/262

(58) Field of Classification Search ..... 399/106, 399/111, 120, 258, 262
See application file for complete search history.

(56) References Cited

U.S. PATENT DOCUMENTS 5,734,953 A * 3/1998 Tatsumi ..... 399/262
5,761,584 A * 6/1998 Tsuda et al. ..... 399/258
5,797,073 A 8/1998 Russell
6,185,401 B1 2/2001 Kanamori et al.
(Continued)

FOREIGN PATENT DOCUMENTS

CN 1722019 A 1/2006
EP 1437632 A 7/2004
(Continued)

OTHER PUBLICATIONS

International Search Report dated Sep. 11, 2007, in International Application No. PCT/JP2007/060934, filed May 23, 2006.

(Continued)

*Primary Examiner* — David Gray
*Assistant Examiner* — Francis Gray
(74) *Attorney, Agent, or Firm* — Fitzpatrick, Cella, Harper & Scinto

(57) ABSTRACT

With a structure in which gear trains 5, 6 of a developer supply container 1 are locked by a locking member 7, and the gear trains 5, 6 receive a drive from a gear 12 of a developer receiving apparatus 10, thus accomplishing automatic setting rotation of developer supply container 1, when the developer supply container 1 is once dismounted and then remounted, the locking member 7 is in a non-locking position, and therefore, the setting rotation of the developer supply container 1 cannot be effected automatically.

With inserting operation of the developer supply container 1, an inducing portion 7*c* of the locking member 7 is pushed and raised by a guide portion 10*j* provided in a groove portion of the developer receiving apparatus 10, so that locking member 7 effects its locking operation. Therefore, upon completion of the insertion of the developer supply container 1, the gear trains 5, 6 are locked by the locking member 7, and therefore, the setting rotation of the developer supply container 1 can be properly effected.

7 Claims, 39 Drawing Sheets

U.S. PATENT DOCUMENTS

| | | | | |
|---|---|---|---|---|
| 6,292,644 | B1 | 9/2001 | Goto et al. | |
| 7,203,449 | B2 | 4/2007 | Ban et al. | |
| 7,266,330 | B2 | 9/2007 | Murakami et al. | |
| 7,283,773 | B2 | 10/2007 | Amano et al. | |
| 7,292,811 | B2 * | 11/2007 | Ban et al. | 399/258 |
| 7,426,363 | B2 | 9/2008 | Murakami et al. | |
| 7,450,890 | B2 | 11/2008 | Murakami et al. | |
| 7,486,915 | B2 | 2/2009 | Koyama et al. | |
| 7,499,666 | B2 | 3/2009 | Amano et al. | |
| 7,764,909 | B2 | 7/2010 | Nakajima et al. | |
| 7,773,919 | B2 | 8/2010 | Nakajima et al. | |
| 7,796,923 | B2 | 9/2010 | Nakajima et al. | |
| 7,822,372 | B2 | 10/2010 | Nagashima et al. | |
| 7,848,685 | B2 * | 12/2010 | Nagashima et al. | 399/262 |
| 7,953,351 | B2 | 5/2011 | Isomura et al. | |
| 2005/0135841 | A1 | 6/2005 | Murakami et al. | |
| 2005/0271426 | A1 | 12/2005 | Okino et al. | |
| 2006/0008299 | A1 | 1/2006 | Amano et al. | |
| 2006/0104671 | A1 | 5/2006 | Murakami et al. | |
| 2007/0231016 | A1 | 10/2007 | Ban et al. | |
| 2008/0013988 | A1 | 1/2008 | Murakami et al. | |
| 2008/0044205 | A1 | 2/2008 | Amano et al. | |

FOREIGN PATENT DOCUMENTS

| | | | |
|---|---|---|---|
| EP | 1659455 | A2 | 5/2006 |
| JP | 53-46040 | A | 4/1978 |
| JP | 1-108581 | A | 4/1989 |
| JP | 11-194600 | A | 7/1999 |
| JP | 2000-162861 | A | 6/2000 |
| JP | 2005-173568 | A | 6/2005 |
| KR | 20060052618 | A | 5/2006 |
| KR | 100767135 | B1 | 10/2007 |

OTHER PUBLICATIONS

Decision on Grant—Patent for Invention dated Oct. 25, 2010, in Russian Application No. 2008150845/28.

* cited by examiner (a)

(b)

(a)

(b)

(a)

(b)

DEVELOPER SUPPLY CONTAINER AND DEVELOPER SUPPLYING SYSTEM

This application is a divisional of U.S. patent application Ser. No. 12/301,741, filed Nov. 20, 2008, which is a 371 National Phase of International Application No. PCT/JP2007/060934, filed May 23, 2007.

TECHNICAL FIELD

The present invention relates to a developer supply container removably mountable in a developer receiving apparatus. It also relates to a developer supplying system provided with a developer supply container and a developer receiving apparatus.

As an example of a developer receiving apparatus, an image forming apparatus, such as a copying machine, a printer, and a facsimile machine, and also, an image formation unit removably mountable in an image forming apparatus, such as those listed above, can be listed.

BACKGROUND ART

In the field of an electrophotographic image forming apparatus, such as a copying machine, a printer, etc., microscopic particulate toner (developer) has been in use. In the case of an image forming apparatus such as those mentioned above, as developer is consumed, the image forming apparatus is replenished with the developer in a developer supply container removably set in the image forming apparatus.

Developer is an extremely fine particulate substance. Thus, if it is mishandled during a developer replenishment operation, it is possible that the developer will scatter. Therefore, there have been proposed developer replenishment methods which place a developer supply container in an image forming apparatus and discharges the developer in the developer supply container, little by little, through a tiny opening of the developer supply container. Further, some of these methods have been put to practical use.

There have been also proposed a large number of cylindrical developer supply containers (conventional container), in which a stirring member (discharging member) for conveying the developer while stirring it is disposed.

A developer supply container, such as those described above, is provided with a coupling member for driving the stirring member disposed in the developer supply container. The coupling member of a conventional developer supply container is structured so that it receives driving force from the main assembly of an image forming apparatus by engaging with the coupling member of the main assembly.

After the completion of the mounting (insertion) of the above described developer supply container into the image forming apparatus, a user is to rotate the developer supply container by a preset angle. As the developer supply container is rotated by the preset angle, it becomes possible for the developer supply container to perform its operation (developer replenishment operation). That is, as the developer supply container is rotated, the hole with which the peripheral surface of the developer supply container is provided becomes connected to the developer receiving hole of the image forming apparatus, making it possible for the image forming apparatus to be replenished with the developer.

The apparatus disclosed in Japanese Laid-open Patent Application H53-46040 is structured so that an operation, such as the above described one, for rotating a developer supply container to set it for developer discharge, is automatically carried out.

More concretely, as the coupling member for driving the stirring member disposed in the developer supply container receives driving force by engaging with the coupling member of the image forming apparatus, the step for rotating the developer supply container to set it for developer delivery is carried out.

Thus, in the case of the apparatus disclosed in the abovementioned governmental gazette, it is reasonable to think that because the developer supply container is set for developer discharge by being rotated, there is provided a structural arrangement for making it rather difficult for the coupling member of the developer supply container to be rotated relative to the container proper of the developer supply container. In other words, it is reasonable to think that even after the developer supply container is properly set for developer discharge by being rotated, the coupling member of the developer supply container remains under a substantial amount of torsional load.

That is, in the case of the apparatus disclosed in the abovementioned governmental gazette, even during the process for supplying the image forming apparatus with the developer, which is carried out after the developer supply container is properly set in the image forming apparatus by being rotated, the amount of force necessary to driving the coupling member remains substantial.

Therefore, in the case of the apparatus disclosed in the abovementioned governmental gazette, the amount of force necessary to drive the stirring member to replenish the developer supply container with the developer is substantial, and therefore, the amount of load, to which the driving motor, driving gear, etc., for driving the stirring member is subjected, is substantial.

DISCLOSURE OF THE INVENTION

The object of the present invention is to provide a developer supply container which is significantly smaller in the amount of force necessary to drive a developer discharging means after the rotation of the developer supply container in the direction to set the developer supply container for developer discharge.

According to an aspect of the present invention, there is provided a developer supply container detachably mountable to a developer receiving apparatus which includes driving means and shifting force applying means, wherein said developer supply container is set by a setting operation including at least a rotation thereof in a setting direction, said developer supply container comprising rotatable discharging means for discharging a developer said developer supply container; drive transmitting means for transmitting the driving force from the driving means to said discharging means; movable suppressing means movable between an operating position in which a relative rotation of said drive transmitting means relative to said developer supply container is suppressed to rotate said developer supply container in the setting direction by a driving force received from said driving means, and a non-operating position; and moving force receiving means for receiving, from said moving force applying means, a force for moving said suppressing means from the non-operating position toward the operating position.

According to another aspect of the present invention, there is provided a developer supplying system comprising a developer receiving apparatus; a developer supply container which is detachably mountable to said developer receiving apparatus and which is set by a setting operation including at least a rotation thereof in a setting direction; wherein said developer receiving apparatus includes driving means for applying a driving force, and moving force applying means for applying a shifting force, wherein said developer supply container includes rotatable discharging member for discharging a developer said developer supply container, drive transmitting means for transmitting the driving force from the driving means to said discharging member, movable suppressing means movable between an operating position in which a relative rotation of said drive transmitting means relative to said developer supply container is suppressed to rotate said developer supply container in the setting direction by a driving force received from said driving means, and a non-operating position*; moving force receiving means for receiving, from said moving force applying means, a force for moving said suppressing means from the non-operating position toward the operating position.

These and other objects of the present invention will become more apparent upon consideration of the following description of the present invention, taken in conjunction with the accompanying drawings.

BEST MODE FOR CARRYING OUT THE INVENTION

Next, the embodiments of the present invention will be concretely described with reference to the appended drawings.

Embodiment 1

First, an image forming apparatus having a developer receiving apparatus will be described, and then, a developer supply container will be described. Incidentally, in this embodiment, a system which is made up of the developer receiving apparatus and developer supply container will be referred to as a developer supply system.

(Image Forming Apparatus)

Figure 1:
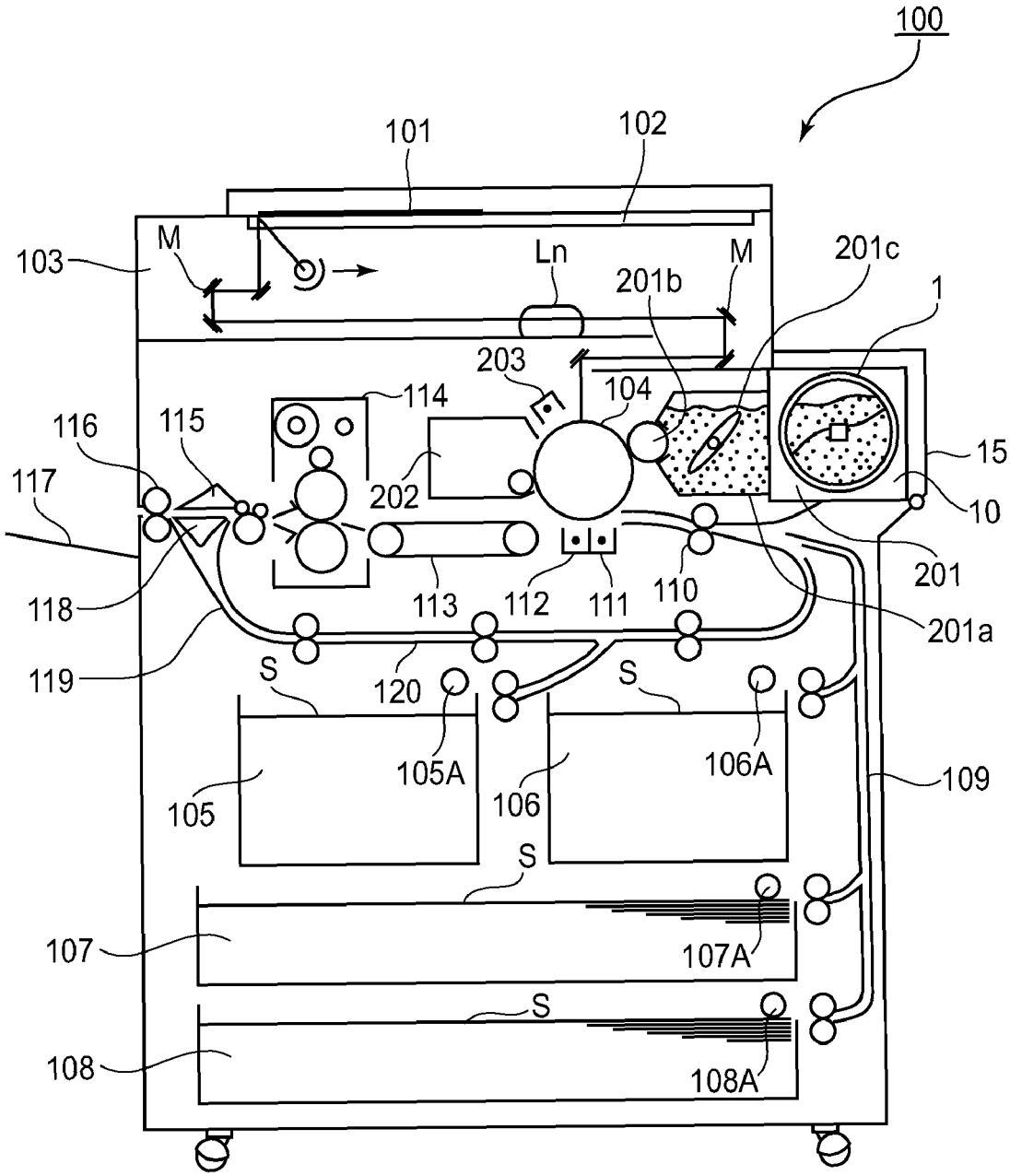
FIG. 1 is a sectional view of the image forming apparatus, which shows the general structure of the apparatus.

First, referring to FIG. 1, a copying machine employing an electrophotographic method will be described as an example of an image forming apparatus having a developer receiving apparatus in which a developer supply container is removably mountable, regarding its structure.

In the same drawing, designated by a referential code 100 is the main assembly of an electrophotographic copying machine (which hereafter will be referred to as "apparatus main assembly 100"). Designated by a referential code 101 is an original, which is placed on an original placement glass platen 102. An electrostatic latent image is formed on an electrophotographic photosensitive member 104 (which hereafter will be referred to as "photosensitive drum"), that is, an image bearing member, by focusing the optical image, which is in accordance with the image formation data, on the photosensitive drum with the use of the multiple mirrors M and a lens Ln of an optical portion. This electrostatic latent image is developed into a visible image by a developing apparatus and developer.

In this embodiment, toner is used as the developer. Thus, it is the toner supply that is stored in the developer supply container, which will be described later. Incidentally, in a case where a developing apparatus is structured to use a developer which contains toner and carrier, the developer supply container is structured to store both toner and carrier so that a developing apparatus is supplied with both the toner and carrier. Also in the above described case where the developing apparatus is structured to use a developer which contains toner and carrier to develop an electrostatic latent image, the developer supply container may be structured to store carrier to supply the developing apparatus with carrier.

Designated by referential codes 105-108 are cassettes in which recording mediums S (which hereafter will be referred to as "sheets") are stored. Among these sheets S stored in the cassettes 105-108, the most appropriate sheet is selected based on the information inputted by an operator (user) through the control portion (liquid crystal panel) of the copying apparatus, or the sheet size of the original 101. It should be noted here that the recording medium usable with the image forming apparatus is not limited to a sheet of paper. For example, an OHP sheet and the like may be used as necessary.

A sheet conveyed by the sheet feeding and separating apparatus 105A-108A is conveyed to a pair of registration rollers 110 by way of a conveying portion 109, and then, is conveyed further in synchronism with the rotation of the photosensitive drum 104 and the scanning timing of an optical portion 103.

Designated by referential codes 111 and 112 are a transfer discharging device and a separation discharging device, respectively. The image formed of the developer on the photosensitive drum 104 is transferred onto the sheet S by the transfer discharging device 111. The sheet S onto which the image formed of the developer has just been transferred, is separated from the photosensitive drum 104 by the separation discharging device 112.

Thereafter, the sheet S is conveyed further by a conveying portion 113 to a fixing portion 114. In the fixing portion 114, the image formed of the developer, on the sheet S, is fixed by heat and pressure. In the single-sided mode, the sheet S is conveyed through a discharging and turning portion 115, and then, is discharged into a discharge tray 117 by a pair of discharge rollers 116. In the multi-layer mode, the sheet S is conveyed to the pair of registration rollers 110, by way of the re-feeding and conveying portions 119 and 120, by being controlled by a flapper 118 of the discharge and turning portion 115. Then, the sheet S is discharged into the discharge tray 117 through the same path as the path through which the sheet S is conveyed in the single-side mode.

In the two-sided copy mode, the sheet S is conveyed through the discharging and turning portion 115 by the discharge rollers 116 until the sheet S becomes partially exposed from the apparatus main assembly. Then, the sheet S is conveyed back into the apparatus main assembly by rotating in reverse the discharge rollers 116, and also, controlling the flapper 118 while the trailing end portion of the sheet S is still remaining pinched by the discharge rollers 116 after it has moved past the flapper 118. Thereafter, the sheet S is conveyed to the registration rollers 110 by way of the re-feeding and conveying portions 119 and 120. Then, it is discharged into the discharge tray 117 through the route similar to the route through which it is conveyed in the single-sided copy mode.

In the apparatus main assembly 100 structured as described above, image formation processing devices, such as a developing apparatus as a developing means, a cleaner portion 202 as a cleaning means, a primary charging device as a charging means, etc., are disposed in the adjacencies of the peripheral surface of the photosensitive drum 104. Incidentally, the cleaner portion 202 is for removing the developer remaining on the photosensitive drum 104. The primary charging device 203 is for uniformly charging the peripheral surface of the photosensitive drum 104 to form an intended electrostatic image on the photosensitive drum 104.

(Developing Apparatus)

Next, the developing apparatus will be described. The developing apparatus 201 is an apparatus for developing an electrostatic latent image formed on the photosensitive drum 104 by optical portion 103 based on the information of the original 101, by adhering developer to the electrostatic latent image. A developer supply container for supply developer to the developing apparatus 201 is removably mounted in the apparatus main assembly 100 by an operator.

Figure 2:
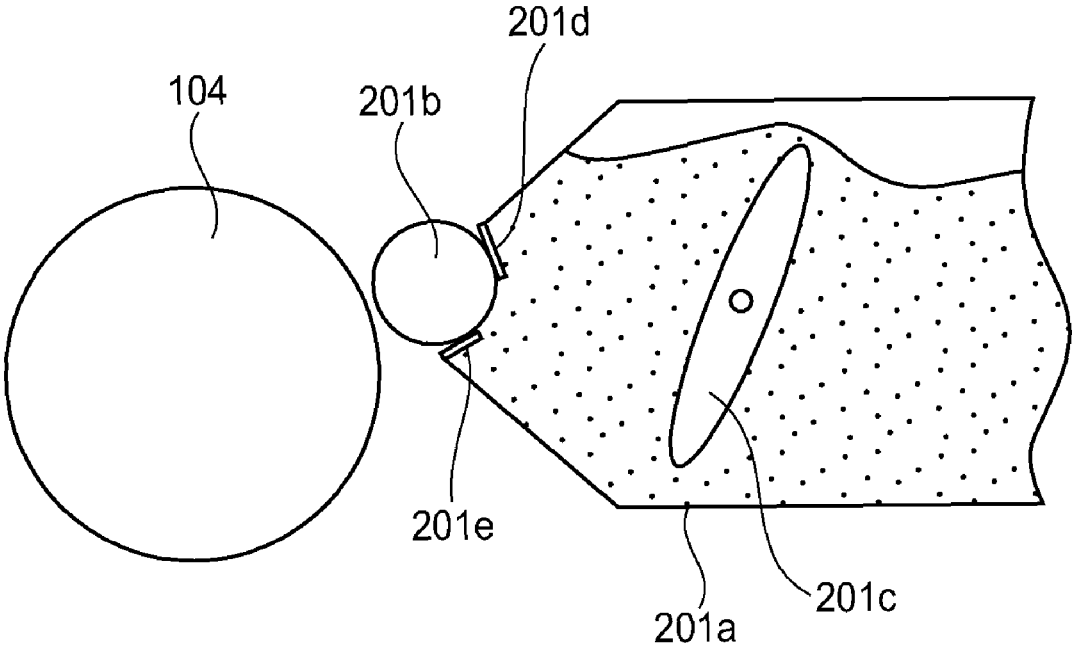
FIG. 2 is a sectional view of a part of the developing apparatus, which shows the structure thereof.
Figure 3A:
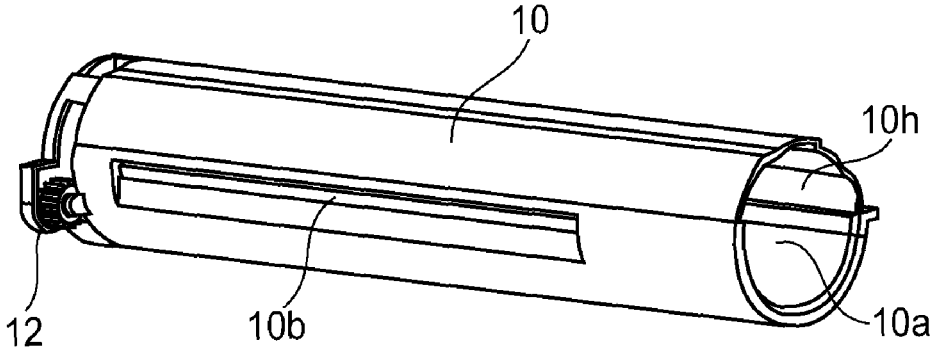
FIG. 3*a* is a perspective view of the developer receiving apparatus.
Figure 3B:
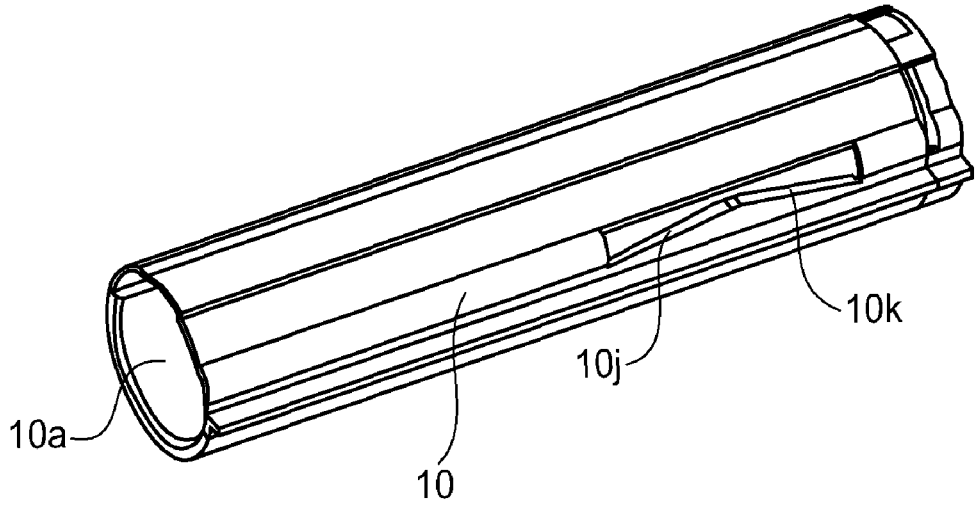
FIG. 3*b* is also a perspective view of the developer receiving apparatus.
Figure 3C:
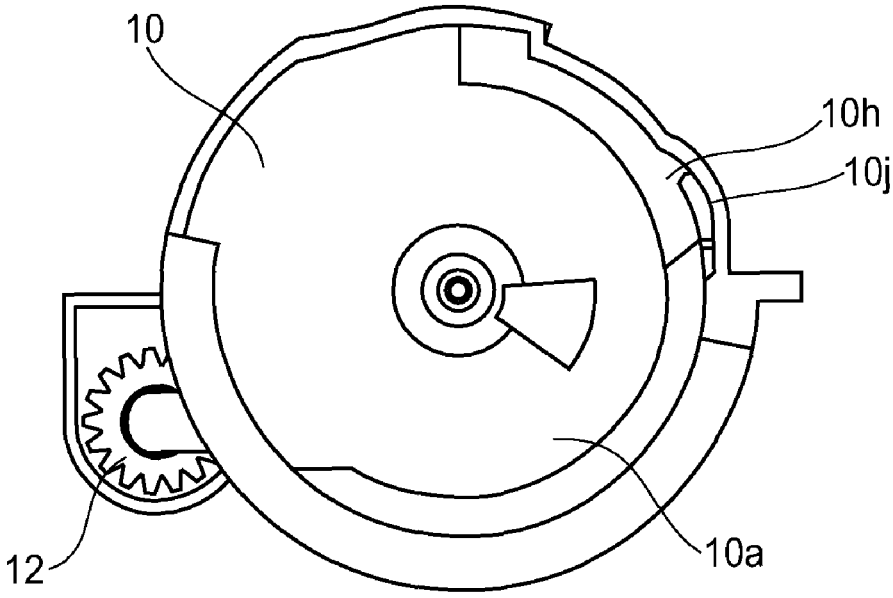
FIG. 3*c* is a drawing for describing the guiding member.
Figure 3D:
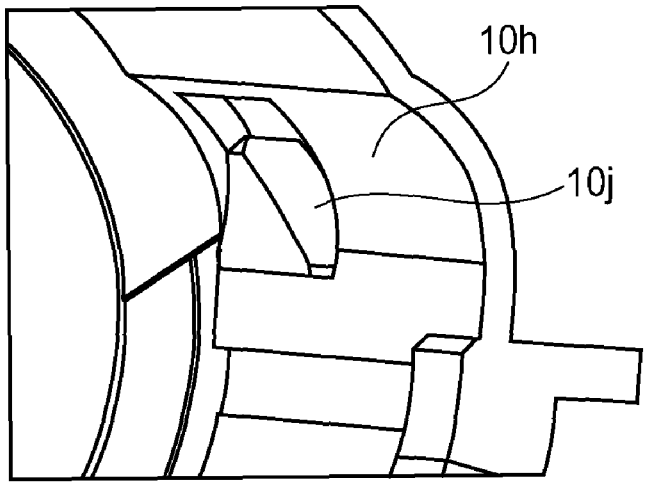
FIG. 3*d* is a drawing for describing the guiding member.

The developing apparatus 201 has a developer receiving apparatus 10, in which the developer supply container 1 is removably mounted, and a developing device 201*a*. The developing device 201*a* has a development roller 201*b* and a developer sending member 201*c*. The developer supplied from the developer supply container 1 is sent by the sending member 201*c* to the developing device 201*b*, by which it is supplied to the photosensitive drum 104. Further, referring to FIG. 2, the development roller 201*b* is provided with a development blade 201*d* for regulating the amount of the developer coat on the roller, a leak prevention sheet 201*e* placed in contact with the development roller 201*b* to prevent the developer from leaking through the gap between the development roller 201*b* and the wall of development device 201*a*.

Figure 9:
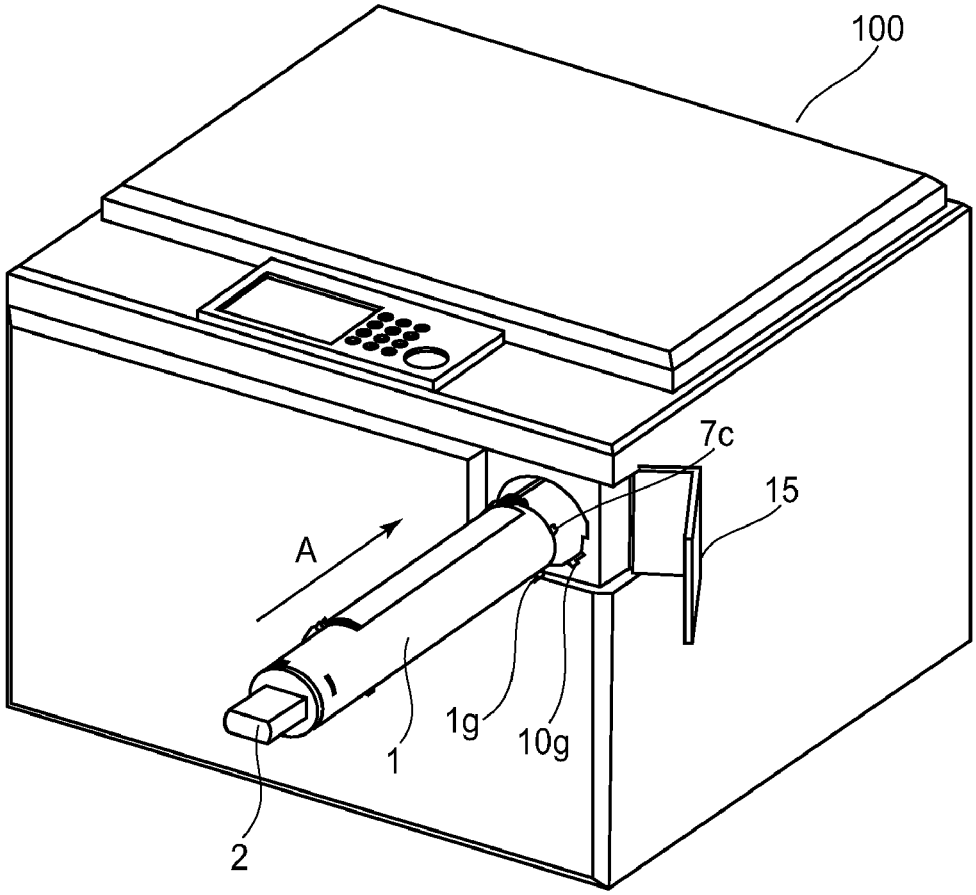
FIG. 9 is a perspective view of the developer supply container while the developer supply container is mounted into the developer receiving apparatus.

Further, referring to FIG. 9, the apparatus main assembly 100 is provided with a cover 15, which is for replacing the developer supply container, and is a part of the external cover of the copying machine. When an operator mounts the developer supply container 1 into, or removes the developer supply container 1 from, the apparatus main assembly 100, the operator opens this cover 15 to carry out the operation for replacing the developer supply container.

(Developer Receiving Apparatus)

Referring to FIGS. 3*a*-3*d*, the developer receiving apparatus 10 is provided with a storage portion 10*a* in which the developer supply container 1 is removably mounted, and a developer reception hole 10*b* for receiving the developer discharged from the developer supply container 1. The developer supplied through the developer reception hole 10*b* is supplied to the above described developing device 201*a* to be used for image formation.

Figure 4:
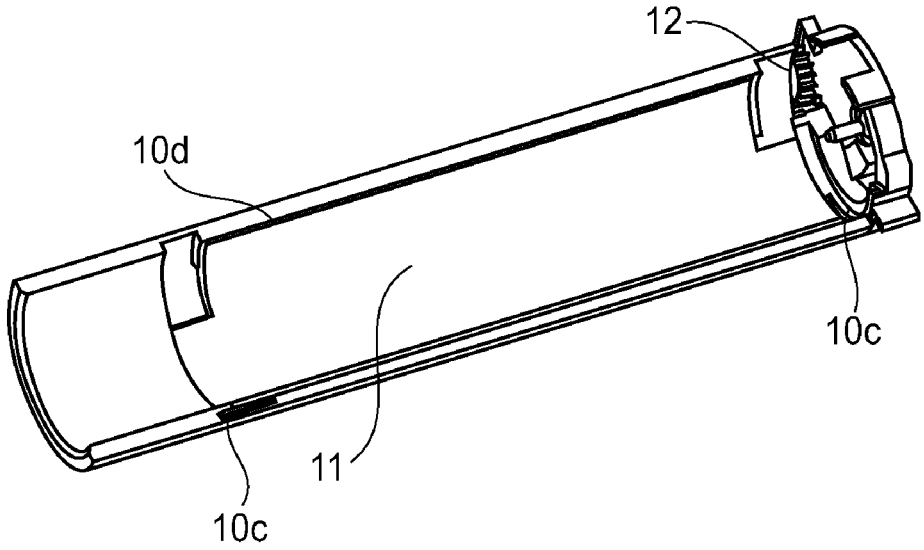
FIG. 4*a* is a drawing for describing the interior of the developer receiving apparatus when the developer reception hole of the apparatus is airtightly sealed.
FIG. 4*b* is a drawing for describing the interior of the developer receiving apparatus when the developer reception hole of the apparatus is fully open.
Figure 4:
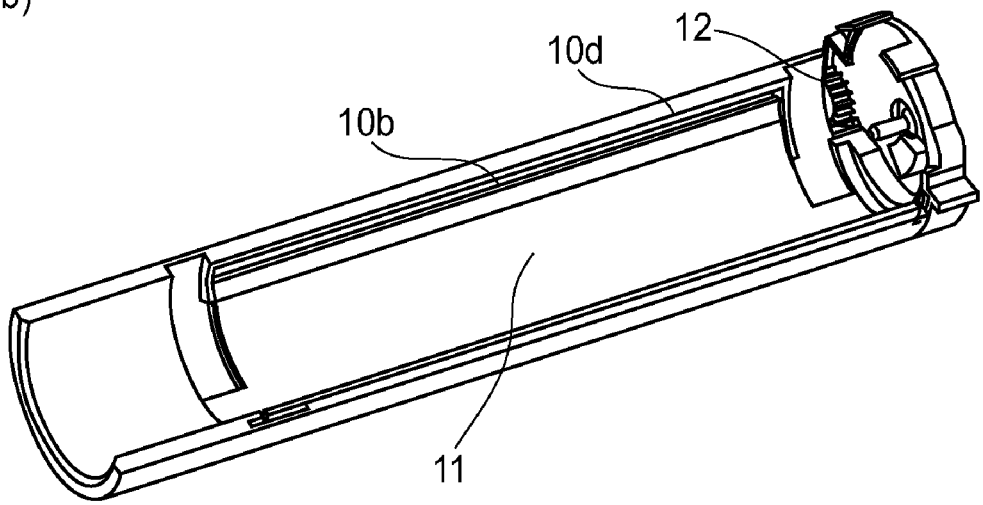

Further, referring to FIGS. 4*a* and 4*b*, the developer receiving apparatus 10 is provided with a developing device shutter 11, which is roughly in the form of a semicylinder, the curvature of which matches those of the developer supply container 1 and storage portion 10*a*. This developing device shutter 11 is engaged with the guiding portions 10*d*, with which the bottom edge of the wall of the storage portion 10*a* is provided, being thereby enabled to slide along the wall of the storage portion 10*a* in the direction parallel to the circumferential direction of the storage portion 10*a* to open or close the developer reception hole 10*b*.

The guide portion 10*c* is located at both lengthwise ends of the developer reception hole 10*b* which can be unsealed, or sealed, by the movement of the developing device shutter 11.

Before the developer supply container 1 is mounted into the storage portion 10*a*, the developing device shutter 11 is in the position in which it keeps the developer reception hole 10*b* airtightly sealed by being placed in contact with the developing device shutter stopper 10*d* with which the developer receiving apparatus 10 is provided, preventing thereby the developer from flowing backward, that is, from the developing device to the storage portion 10*a*.

Further, in order to ensure that when the developer shutter 11 is opened to unseal the developer reception hole 10*b*, the bottom edge of the developer reception hole 10*b* and the top edge of the developing device shutter 11 precisely align with each other so that the developer reception hole 10*b* becomes fully open, the developing device shutter stopper 10*e* (FIG. 10*d*) for regulating the developing device shutter 11 in terms of the final position into which the developing device shutter 11 is moved for the unsealing, is provided.

This stopper 10*e* also functions as the stopping portion for stopping the rotation of the container proper 1*a* at the exact moment when the developer discharge hole 1*b* aligns with the developer reception hole 10*b*. That is, as the developer reception hole unsealing movement of the developing device shutter 11 is stopped by the stopper 10*e*, the rotation of the developer supply container 1 which is in engagement with the developing device shutter 11, is stopped by an unsealing projection, which will be described later.

Further, one of the lengthwise ends of the storage portion 10*a* is provided with a driving gear 12, as a driving member (driving device) for transmitting the rotational driving force from the driving motor, with which the apparatus main assembly 100 is provided. The developer storage portion 10*a* is structured so that this driving gear 12 drives a developer discharging member 4 by giving a second gear 6 (FIGS. 5*a*-5*d*) the rotational force, the direction of which is the same as the direction in which the developer supply container 1 is rotated to move the developing device shutter 11 in the direction to unseal the developer reception hole 10*b*, as will be described later.

Further, the driving gear 12 is in connection to the driving gear train for rotationally driving the developer sending member 201*c* and development roller 201*b* of the developing device, and also, for driving the photosensitive drum 104. The driving gear 12 used in this embodiment is 1 in module, and 17 in tooth count.

Further, the developer receiving apparatus 10 is provided with a groove 10*h*, and guide portions 10*j* and 10*k*, as a force applying means, which has a surface slanted relative to the direction in which the developer supply container 1 is inserted and the direction in which the developer supply container 1 is removed. These guide portions 10*j* and 10*k* may be referred to as a force applying means, a guiding device, or the like.

The groove 10*h* is structured for accommodating a guiding portion 7*c*, which functions as the portion for switching the locking member in position, when the developer supply container 1 is mounted into, or removed from, the developer receiving apparatus 10. Further, referring to FIGS. 3*c* and 3*d*, the guide portions 10*j* and 10*k* are placed so that they protrude inward of the storage portion 10*a* of the groove 10*h*. Further, the guide portions 10*j* and 10*k* are placed so that the guiding portion 7*c* comes into contact with them when the guiding portion 7*c* slides along the groove 10*h* while the locking portion 7*b* of the locking member 7 is off the catch portion 9*a* of the locking member catching member 9.

(Developer Supply Container)

Figure 5A:
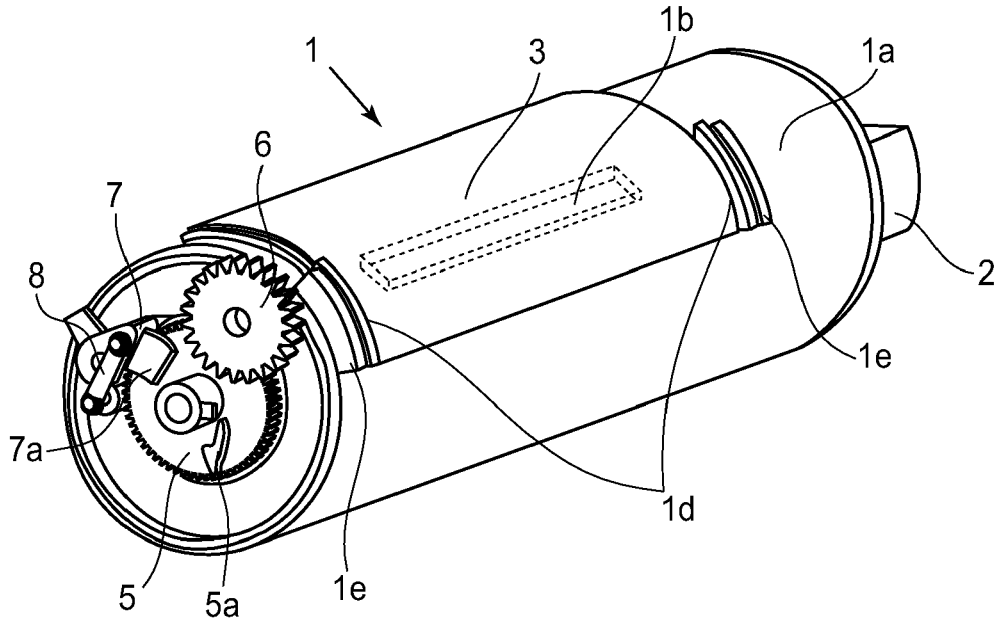
FIG. 5*a* is a perspective view of the developer supply container, which is for describing the container.

Referring to FIG. 5*a*, the container proper 1*a* of the developer supply container 1, as a storage portion (container body) for storing developer, is roughly in the form of a semicylinder. The semicylindrical portion of the wall of the container proper 1*a*, is provided with the developer discharge hole 1*b*, which is in the form of a slit and extends in the lengthwise direction of the container proper 1*a*.

In order to protect the developer stored in this container proper 1*a*, and to prevent the developer from leaking, the container proper 1*a* is desired to have a certain level of rigidity. In this embodiment, the container proper 1*a* is formed of polystyrene by injection molding. Further, the choice of the resinous substance as the material for the container proper 1*a* does not need to be limited to substances such as the above-mentioned one. That is, other substances such as ABS may be used.

One of the end surfaces of the container proper 1*a* is provided with a handle 2, as a handgrip portion to be gripped when the developer supply container 1 is mounted or removed by a user. Further, this handle 2 is desired to have a certain level of rigidity as is the container proper 1*a*. It is formed of the same material as the container proper 1*a*, with the use of the same molding method as the container proper 1*a*.

As for the fixation of the container proper 1*a* and handle 2 to each other, they may be mechanically fitted with each other, screwed to each other, bonded to each other, or welded to each other. That is, all that is necessary is for them to be fixed to each other strongly enough to prevent them from disengaging from each other during the mounting or removal of the developer supply container 1. In this embodiment, they are fixed to each other by being mechanically engaged with each other.

As for an example of a modified version of the handle, the developer supply container 1 may be structured so that gears 5 and 6 are attached to the trailing end of the developer supply container 1 in terms of the direction in which the developer supply container 1 is inserted, and the handle 2 for operating the developer supply container 1 is also attached to the trailing end so that the joint between the gear 6 and driving gear 12 remains exposed. In this case, the driving force transmitting members (gears 5 and 6) can be protected by the handle 2. Therefore, this arrangement may be said to be superior to the arrangement described above.

In this embodiment, the front end of the container proper 1*a*, in terms of the developer container insertion direction, is provided with the first and second gears 5 and 6. The end wall of the container proper 1*a*, which is at the opposite end (in terms of lengthwise direction) from the end with the gears 5 and 6, is provided with a hole 1*c* for filling the developer supply container 1 with developer. The hole 1*c* is sealed with an unshown sealing member or the like after the filling of the developer supply container 1 with developer.

Further, when the developer supply container is in the operational position (in which developer supply container setting operation ends to enable developer supply container to discharge developer) into which the developer supply container 1 is moved by being rotated by a preset angle after it is mounted into the developer receiving apparatus, the developer discharge hole 1*b* faces roughly sideways, as will be described later. Further, the developer supply container 1 is structured so that when it is mounted into the developer receiving apparatus, it is to be kept in such an attitude that the developer discharge hole 1*b* faces roughly upward, as will be described later.

(Container Shutter)

Referring to FIG. 5*a*, the developer discharge hole 1*b* remains shut by the container shutter 3, which is roughly in the form of a semicylinder, the curvature of which roughly matches that of the peripheral surface of the developer supply container 1. This container shutter 3 is in engagement with the guide portion 1*d* with which both of the lengthwise ends of the container proper 1*a* are provided. Not only do these guide portions 1*d* guide the container shutter 3 when the container shutter 3 is moved in a sliding manner to be opened or closed, but also, prevents the container shutter 3 from disengaging from the container proper 1*a*.

Further, in order to prevent developer from leaking from the developer supply container 1, the surface of the container shutter 3, which faces the developer discharge hole 1*b*, is provided with a sealing member (unshown). Instead, however, the portions of the container proper 1*a*, which are next to the edge of the developer discharge hole 1*b*, may be provided with a sealing member. Obviously, both the container shutter 3 and container proper 1*a* may be provided with a sealing member. In this embodiment, only the container proper 1*a* is provided with a sealing member.

Further, instead of providing the developer supply container 1 with the container shutter 3 as in this embodiment, the developer discharge hole 1*b* may be sealed with a sealing film formed of a resin, by welding the sealing film to the portions of the container proper 1*a*, which are next to the edge of the developer discharge hole 1*b*. In this case, the developer discharge hole 1*b* is unsealed by peeling the sealing film.

However, in the case of this structural arrangement, there is a possibility that when the developer supply container 1 depleted of developer is replaced, the developer remaining in the developer supply container 1, although being very small in amount, will scatter through the developer discharge hole 1*b*. Therefore, the developer supply container 1 is desired to be structured so that the developer discharge hole 1*b* can be resealed with the container shutter 3.

It is obvious that when there is a possibility that during the distribution (transportation, shipment) of the developer supply container 1, developer will leak from the developer supply container 1 due to the shape of the developer discharge hole 1*b* of the developer supply container 1 and/or the amount by which the developer supply container 1 is filled with developer, the developer supply container 1 may be provided with both the sealing film and container shutter 3 to keep the developer supply container 1 more reliably sealed.

(Discharging Member)

Figure 5B:
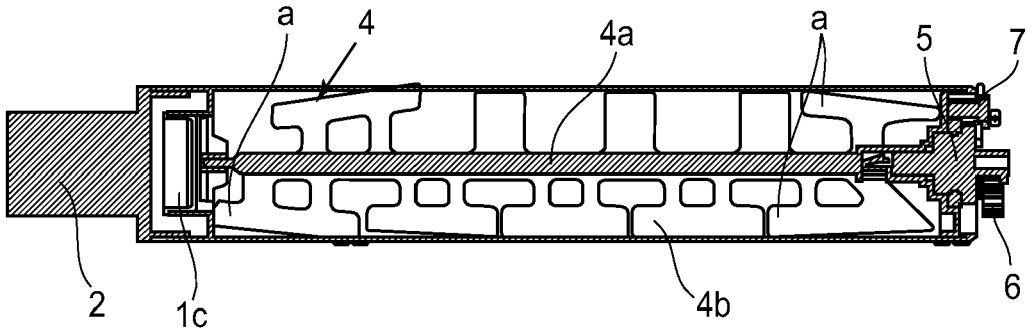
FIG. 5*b* is a sectional view of the developer supply container, which is for describing the container.

The developer supply container 1 is provided with the developer discharging member 4, which is disposed in the container proper 1*a*. The discharging member 4 is a rotatable developer discharging means (discharging device) for discharging the developer in the container proper 1*a* from the container proper 1*a* through the developer discharge hole 1*b* by conveying the developer to the developer discharge hole 1*b* while stirring the developer by being rotated. Referring to FIG. 5*b*, the discharging member 4 is primarily made up of a shaft 4*a* and stirring wings 4*b*.

One of the lengthwise ends of the shaft 4*a* is rotatably supported by the container proper 1*a*, and also, so that, in practical terms, the shaft 4*a* is not allowed to move in its lengthwise direction. On the other hand, the other lengthwise end of the shaft 4*a* is connected to the first gear 5 so that it is coaxially rotatable with the first gear 5. More concretely, the two are connected by attaching the shaft portion of the first gear 5, and the other end of the shaft 4*a*, to each other, in the container proper 1*a*. Further, in order to prevent the developer from leaking out from the container proper 1*a* along the shaft portion of the first gear 5, the shaft portion is fitted with a sealing member.

Further, instead of connecting the first gear 5 and shaft 4*a* to each other as described above, it is possible to indirectly connect the first gear 5 and shaft 4*a* through a certain member so that driving force can be transmitted to the shaft 4*a*.

The shaft 4*a* is desired to be rigid enough for the discharging member 4 to loosen the developer in the developer supply container 1 so that the developer can be conveyed, while being stirred, toward the developing apparatus, even if the developer will have agglomerated. Further, the shaft 4*a* is desired to be as small as possible in the amount of resistance relative to the container proper 1*a*. Based on the viewpoints described above, in this embodiment, polystyrene was used as the material for the discharge member shaft 4*a*. Obviously, the choice of the material for the shaft 4*a* does not need to limited to polystyrene. That is, other substances, such as polyacetal or the like may be used.

The stirring wings 4*b* are fixed to the shaft 4*a*. They are for conveying the developer in the container proper 1*a* toward the developer discharge hole 1*b* while stirring the developer; as the shaft 4*a* is rotated, the stirring wings 4*b* convey the developer. Further, in terms of the radius direction of the container proper 1*a*, the stirring wings 4*b* are made extend far enough to properly sweep the inward surface of the cylindrical wall portion of the container proper 1*a*, in order to minimize the amount by which the developer fails to be discharged from the container proper 1*a*.

Further, referring to FIG. 5*b*, the stirring wings 4*b* are shaped so that the edges of their free end slant roughly in the shape of a letter L (portion designated by a in FIG. 5*b*). The rotational delay of this portion a is used to convey the developer toward the developer discharge hole 1*b*. In this embodiment, the stirring wings 4*b* are formed of a polyester sheet. Obviously, the choice of the material for the stirring wings 4*b* does not need to be limited to a polyester sheet. That is, a resin other than polyester may be used as long as the sheet made of the substance is flexible.

Regarding the structure of the discharging member 4 described above, the structure does not need to be limited to the above described example. That is, any of various structural arrangements may be used as long as it enables the discharging member 4 to perform the function of discharging the developer out of the developer supply container 1 by conveying the developer by being rotated. For example, the material, shape, etc., may be different from the those of the above described example of the stirring wings 4*b*, or a conveying system different from the one in this embodiment may be employed. Further, in this embodiment, the first gear 5 and discharging member 4, which are two separate components, are attached to each other. However, the first gear 5 and the shaft portion of the discharging member 4 may be integrally formed of a resin by molding.

(Mechanism for Opening or Closing Developing Device Shutter)

Next, the mechanism for opening or closing the developing device shutter 11 will be described.

Figure 5C:
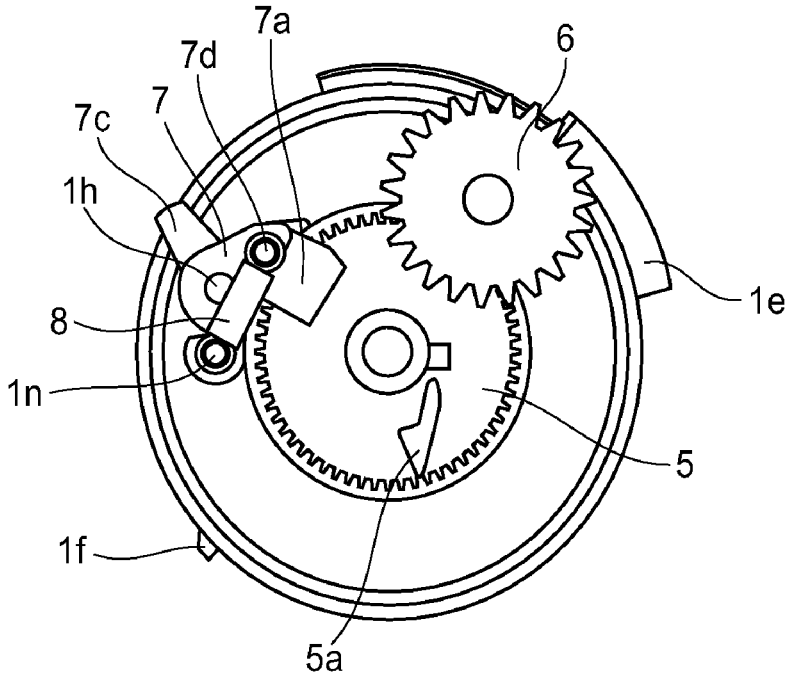
FIG. 5*c* is a side view of the developer supply container, as seen from the driving force receiving side of the developer supply container.
Figure 5D:
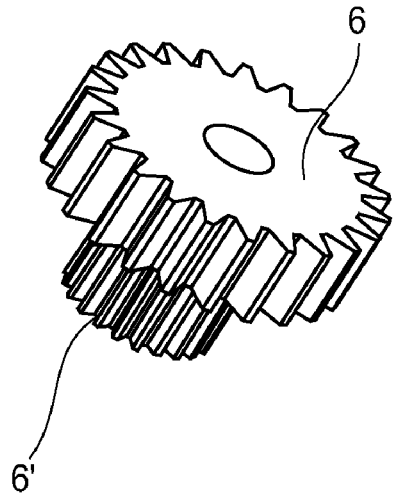
FIG. 5*d* is a perspective view of the second and third gears, which is for describing the gears.

Referring to FIG. 5*c*, the developer supply container 1*a* is provided with an unsealing projection 1*e* and a sealing projection 1*f*, which are for moving the developing device shutter 11 to open or close the developing device shutter 11. The projections 1*e* and 1*f* are on the peripheral surface of the container proper 1*a*.

The unsealing projection 1*e* is a projection for pushing down the developing device shutter 11 (FIG. 4) to unseal the developer receiving hole 10*b* (FIG. 4) during the operation for setting the developer supply container 1 after the amounting of the developer supply container 1 (operation for rotating developer supply container 1 by preset angle into operational position).

The sealing projection 1*f* is a projection for pushing up the developing device shutter 11 to seal the developer reception hole 10*b* during the operation for removing developer supply container 1 (operation for reversely rotating developer supply container 1 by preset angle from operational position (supplying position) toward position into which developer supply container 1 is mounted, or from which developer supply container 1 is removed).

As described above, in order to coordinate the opening or closing movement of the developing device shutter 11 with the operation for rotating the developer supply container 1, the unsealing projection 1*e* and sealing projection 1*f* are positioned as follows:

That is, the unsealing projection 1*e* and sealing projection 1*f* are positioned so that immediately after the mounting of the developer supply container 1 into the developer receiving apparatus 10 (FIG. 10), they are on the upstream and downstream sides, respectively, relative to each other in terms of the direction in which the developing device shutter 11 is rotated for unsealing.

(Driving Force Transmitting Means)

Next, the driving force transmitting means (driving force transmitting device) for transmitting the rotational driving force received from the developer receiving apparatus 10, to the developer discharging member 4 will be described regarding its structure.

The developer receiving apparatus 10 is provided with the driving gear 12 as a driving member for transmitting the driving force to the developer discharging member 4 of the developer supply container 1.

On the other hand, the developer supply container 1 is provided with a driving force transmitting means for transmitting the rotational driving force received from the driving gear 12, to the developer discharging member 4 by engaging with the driving gear 12.

In this embodiment, the driving force transmitting means has a gear train. The shaft portion of each of the gears of the gear train is attached to one of the lengthwise end surfaces of the developer supply container 1, as will be described later.

In this embodiment, after the mounting of the developer supply container 1, the developer supply container 1 is to be rotated by a preset angle with the use of the handle 2 to be set in the operational position (supplying position). Before the rotation of the developer supply container 1, the driving force transmitting means and driving gear 12 are not in engagement with each other. That is, they remain separated from each other in terms of the circumferential direction of the developer supply container 1. Then, as the developer supply container 1 rotated with the use of the handle, the driving force transmitting means and driving gear 12 face each other, and then, engage with each other, enabling the driving force to be transmitted from the driving gear 12 to the driving force transmitting means (state of engagement).

More concretely, the first gear 5 (driving force transmitting intermediary member), as a driving force transmitting means, which is in connection with the developer discharging member 4, is supported by its axle attached to the abovementioned lengthwise end surface of the container proper 1*a* so that the first gear 5 is enabled to rotate about the rotational center (approximate center) of the developer supply container 1. This first gear 5 can coaxially rotate with the developer discharging member 4.

The shaft portion of the first gear 5 is attached to the abovementioned lengthwise end surface of the container proper 1*a* so that when the developer supply container 1 is rotated by the preset angle to be set for developer discharge, the rotational center of the first gear 5 is roughly in alignment with the rotational center of the developer supply container 1.

Further, the second gear 6 (driving force transmitting member or driving force transmitting eccentric member), as a driving force transmitting member, is rotatably supported by a shaft attached to the container proper 1*a* so that the second gear 6 is enabled to orbitally rotate the rotational center of the developer supply container 1, with the presence of a preset distance between the rotational center of the developer supply container 1 and that of the second gear 6. This second gear 6 is positioned so that it is enabled to engage with the driving gear 12 of the developer receiving apparatus 10 to transmit the driving force from the driving gear 12 to the second gear 6. That is, the developer supply container 1 and developer receiving apparatus 10 are structured so that the second gear 6 receives rotational driving force from the driving gear 12. Further, referring to FIG. 5*d*, the second gear 6 is structured as a step gear for transmitting rotational force to the first gear 5; it is provided with a gear 6', that is, the third gear, which engages with the first gear 5 to transmit rotational driving force to the first gear 5.

The developer supply container 1 and developer receiving apparatus 10 are structured so that the direction in which the driving gear 12 transmits driving force is opposite from the direction in which the container proper 1*a* is rotated to be set for its operation, and the direction in which the second gear 6 is rotated by being meshed with the driving gear 12 is the same as the direction in which the container proper 1*a* is rotated to be set for its operation.

Further, the direction in which the container proper 1*a* is rotated when the developer supply container 1 is set for developer discharge is the same as the direction in which the developing device shutter 11 is rotated to unseal the developer discharge hole 1*b*, as described above.

That is, the developer supply container 1 and developer receiving apparatus 10 are structured so that as the rotational driving force is inputted into the second gear 6 from the driving gear 12, the second gear 6, gear 6' (third gear), and first gear 5 which is in engagement with the gear 6' (third gear) to receive driving force, rotate, and therefore, the developer discharging member 4 in the container proper 1*a* rotates, as described above.

Immediately after the mounting of the developer supply container 1 into the developer receiving apparatus 10, there is a certain amount of distance between the second gear 6 and driving gear 12 in terms of the circumferential direction of the container proper 1*a*, as described above.

Then, as the operation for rotating the developer supply container 1 is carried out by a user, the second gear 6 engages with the driving gear 12 so that the driving force can be transmitted from the driving gear 12 to the second gear 6. At this point in time, the developer discharge hole 1*b* is not in connection with the developer discharge hole 10*b* (developing device shutter 11 remains closed).

Thereafter, driving force is inputted into the driving gear 12 of the developer receiving apparatus 10, as will be described later.

It is by adjusting the position in which the second gear 6 is placed relative to the developer supply container 1 (unsealing projection 1*e* or developer discharge hole 1*b*) in terms of the circumferential direction of the container proper 1*a* as described above, that the engagement between the second gear 6 and driving gear 12 begins to occur at the above described point in time. This is why the second gear 6 and first gear 5 are positioned so the rotational center of the second gear 6 and the rotational center of the first gear 5 do not coincide.

In this embodiment, the container proper 1*a* is hollow and cylindrical. Therefore, the rotational center of the developer discharging member 4 coincides (roughly coincides) with the rotational center of the container proper 1*a*, and the first gear 5, which is directly in connection with the developer discharging member 4, coincides (roughly coincides) with the rotational center of the container proper 1*a*. However, the rotational center of the second gear 6 does not coincide with that of the first gear 5. Therefore, as the developer supply container 1 rotates, the second gear 6 engages with the driving gear 12 of the developer receiving apparatus 10 by being orbitally moved about the rotational center of the container proper 1*a*. This is why the second gear 6 is positioned so that its rotational does not coincide with the rotational center of the container proper 1*a*.

Incidentally, the developer supply container 1 may be structured so that the rotational center of the developer discharging member 4 does not coincide with that of the container proper 1*a*. For example, the developer supply container 1 may be structured so that the rotational center of the developer discharging member 4 is offset toward the developer discharge hole 1*b* (in terms of radius direction of container proper 1*a*) from the rotational center of the developer supply container 1. In this case, it is desired that the first gear 5 is reduced in diameter (radius), and the developer supply container 1 is structured so that the first gear 5 is supported by a shaft attached to the position of the lengthwise end wall of the container proper 1*a*, which coincides with the rotational center of the developer discharging member 4, but, does not coincide with the rotational center of the container proper 1*a*. Otherwise, the modified version of the developer supply container described above is the same in structure as the developer supply container 1 in this embodiment.

Further, if the developer supply container 1 is structured so that the rotational center of the developer discharging member 4 does not coincide with that of the container proper 1*a*, the driving force transmitting means of the developer supply container 1 may be made up of only the second gear 6, that is, without the provision of the first gear 5, and also, so that the second gear 6 is supported by a shaft attached to the portion of the container proper 1*a*, which is offset from the rotational center of the container proper 1*a* in the same manner as the rotational center of the developer discharging member 4 is offset. In this case, the second gear 6 is connected to the developer discharging member 4 so that they rotate coaxially.

Further, in this case, the rotational direction of the developer discharging member 4 is opposite from the above described on, and therefore, the developer is conveyed downward toward the developer discharge hole 1*b*, which faces sideways. Also in this case, the developer supply container 1 is desired to be structured to give the developer discharging member 4 such a function that the rotation of the developer discharging member 4 lifts the developer in the developer supply container 1, and guides the lifted developer toward the developer discharge hole 1*b*, which is located below.

The first and second gears 5 and 6 are desired to have the function of fully transmitting the driving force from the developer receiving apparatus 10. In this embodiment, polyacetal is used as the material for the first and second gears 5 and 6, which are formed by injection molding.

To describe in more detail, the first gear 5 is 0.5 in module, 60 in tooth count, and 30 mm in diameter, whereas the second gear 6 is 1 in module, 20 in tooth count, and 20 mm in diameter. Further, the third gear 6' is 0.5 in module, 20 in tooth count, and 10 mm in diameter. The rotational center of the second gear 6 and that of the third gear 6' are offset from the rotational center of the first gear 5 by 20 mm in the radius direction of the first gear 5.

Incidentally, the module, tooth count, and diameter ϕ of each of these gears do not need to be limited to those mentioned above, as long as they are set in consideration of the required performance of the driving force transmitting means.

For example, all that is necessary to further increase the developer discharge speed (rotational speed of developer discharging member 4) is to increase the first gear 5 in diameter, and to increase the second gear 6 in diameter. On the other hand, if the torque is considered to be more important, all that is necessary to be done is to increase the first gear 5 in diameter, and to decrease the second gear 6 in diameter. That is, the values for these factors may be selected to be appropriate for the desired specifications.

Incidentally, in this embodiment, the developer supply container 1 is structured so that as it is seen from its lengthwise direction, the second gear 6 protrudes beyond the peripheral surface of the container proper 1*a*. However, the developer supply container 1 may be structured so that even if it is seen from its lengthwise direction, it does not protrude beyond the peripheral surface of the container proper 1*a*. In such a case, the developer supply container 1 is superior in terms of the ease with which it can be wrapped with wrapping material, being therefore smaller in the frequency, with which such an accident that it breaks as it is accidentally dropped during its distribution or the like, occur.

(Method for Assembling Developer Supply Container)

The method for assembling the developer supply container 1 in this embodiment is as follows: First, the developer discharging member 4 is inserted into the container proper 1*a*. Then, the first gear and container shutter 3 are attached to the container proper 1*a*. Thereafter, the second gear 6, and the third gear 6,' that is, an integral part of the second gear 6, are attached to the container proper 1*a*. Then, the container proper 1*a* is filled with developer through the developer inlet hole 1*c*. Then, the developer inlet hole 1*c* is sealed with a sealing member. Lastly, the handle 2 is attached.

This order in which the processes of filling the container proper 1*a* with developer, and attaching the second gear 6, container shutter 3, and handle 2 to the container proper 1*a*, may be changed if it is necessary to make it easier to assemble the developer supply container 1.

Further, in this embodiment, the internal volume of the container proper 1*a* is made to be roughly 600 cc by using a hollow cylindric container, which is 50 mm in internal diameter ϕ, and 320 mm in length. Further, the amount by which the container proper 1*a* is filled with developer is 300 g.

(Rotation Controlling Means)

The developer supply container 1 in this embodiment is structured so that it is automatically rotated by the driving force from the driving gear 12 in the direction in which it is to be set for developer discharge, and also, so that the amount of force necessary to rotate the developer supply container 1 after the setting of the developer supply container 1 is smaller than the amount of force necessary to rotate the developer supply container 1 to set it in its position for developer discharge.

More concretely, the developer supply container 1 is provided with a rotation controlling means for preventing the driving force transmitting means from rotating relative to the developer supply container 1, in order for the developer supply container 1 to be automatically rotated in the direction to be set for developer discharge, by the driving force received from the driving gear 12. This rotation controlling means may be referred to as a controlling device, a load applying means, a load applying device, or a braking mechanism.

Further, this rotation controlling means is structured to be movable so that it can be placed in the operational (active) position in which it prevents the driving force transmitting means from rotating relative to the developer supply container 1, and the nonoperational (inactive) position into which it is retracted so that it does not prevent the driving force transmitting member from rotating relative to the developer supply container 1. In this embodiment, the developer supply container 1 is structured so that the rotation controlling means is automatically moved from the nonoperational position to the operational position. Next, referring to FIGS. 5-8, the structure of the rotation controlling means will be described in detail.

In this embodiment, the developer supply container 1 is simplified in structure by using the driving force transmitting means for transmitting the rotational driving force to the developer discharging member 4, as the mechanism for automatically rotating the developer supply container 1 toward the operational position, as described above.

That is, in this embodiment, a torsional load generating mechanism, which utilizes the driving force transmitting means, is used to turn the driving force from the driving gear 12, into the torque for automatically rotating the developer supply container 1 into its operational position.

More concretely, the amount of torsional load of the second gear 6 relative to the container proper 1*a* is increased by increasing the amount of torsional load of the first gear 5 relative to the container proper 1*a*. That is, while driving force is inputted from the driving gear 12 into the second gear 6 which is in mesh with the driving gear 12, the second gear 6 is being prevented from rotating relative to the container proper 1*a*. Thus, the inputted driving force turns into the force which acts in the direction to rotate the container proper 1*a*. As a result, the container proper 1*a* is automatically rotated into its operational position.

That is, while the developer supply container 1 is automatically rotated, the driving force transmitting means and developer supply container 1 are prevented by the rotation controlling means from rotating relative to each other. In other words, the rotation controlling means keeps greater the amount of torque necessary to rotate the driving force transmitting means and developer supply container 1 relative to each other, than the amount of torque necessary to rotate the developer supply container 1 relative to the developer receiving apparatus 10.

Incidentally, next, the structural arrangement for causing the rotation controlling means to act on the first gear 5 will be described. However, the structural arrangement may be such that the rotation controlling means is caused to act on the second gear 6 instead.

Referring to FIGS. 6*a* and 6*b*, the first gear 5 is fitted with a locking member catching member 9, which is in the form of a ring, and is fitted around the peripheral surface 5*c* of the first gear 5. This catching member 9 is structured so that it is rotatable relative to the first gear 5 about the rotational axis of the first gear 5. Further, the entirety of the periphery of the catching member 9 makes up a catching portion 9*a*, which is in the form of the teeth portion of a saw.

The shaft portion of the first gear 5 is fitted with a ring 14 (so-called O-ring), which is between the peripheral surface portion 5*c* and the internal surface 9*b* of the catching member 9, remaining thereby compressed. Further, the ring 14 is fixed to the peripheral surface portion 5*c* of the shaft portion of the first gear 5. Thus, as the catching member 9 is rotated relative to the first gear 5, torsional load (friction) is generated between the internal surface 9*b* of the catching member 9, and the compressed ring 14.

In this embodiment, the periphery of the catching member 9 is covered with teeth (catching portions 9*a*) like those of a circular saw. However, the number of catching portions 9*a* may be only one. Further, the catching portion 9*a* may be in the form of a projection or a recess.

Further, it is desired that as the material for the ring 14, an elastic substance, such as rubber, felt, foamed substance, urethane rubber, elastomer, or the like, is used. In this embodiment, silicon rubber is used. Further, the ring 14 may not be in the form of a complete ring; a ring which lacks its portion in terms of circumferential direction may be used as the ring 14.

In this embodiment, the peripheral surface 5*c* of the first gear 5 is provided with a groove 5*b*, and the ring 14 is attached to the first gear 5 by being fitted in the groove 5*b*. However, the method for keeping the ring 4 attached to the first gear 5 does not need to be the method used in this embodiment. For example, the structural arrangement may be such that the ring 14 is attached to the catching member 9, instead of the first gear 5, so that the torque is generated by causing the peripheral surface 5*c* of the first gear 5 and ring 14 relative to each other to generate the torque. Further, the ring 14 and first gear 5 may be integrally molded (with use of so-called two-color molding).

Figure 7:
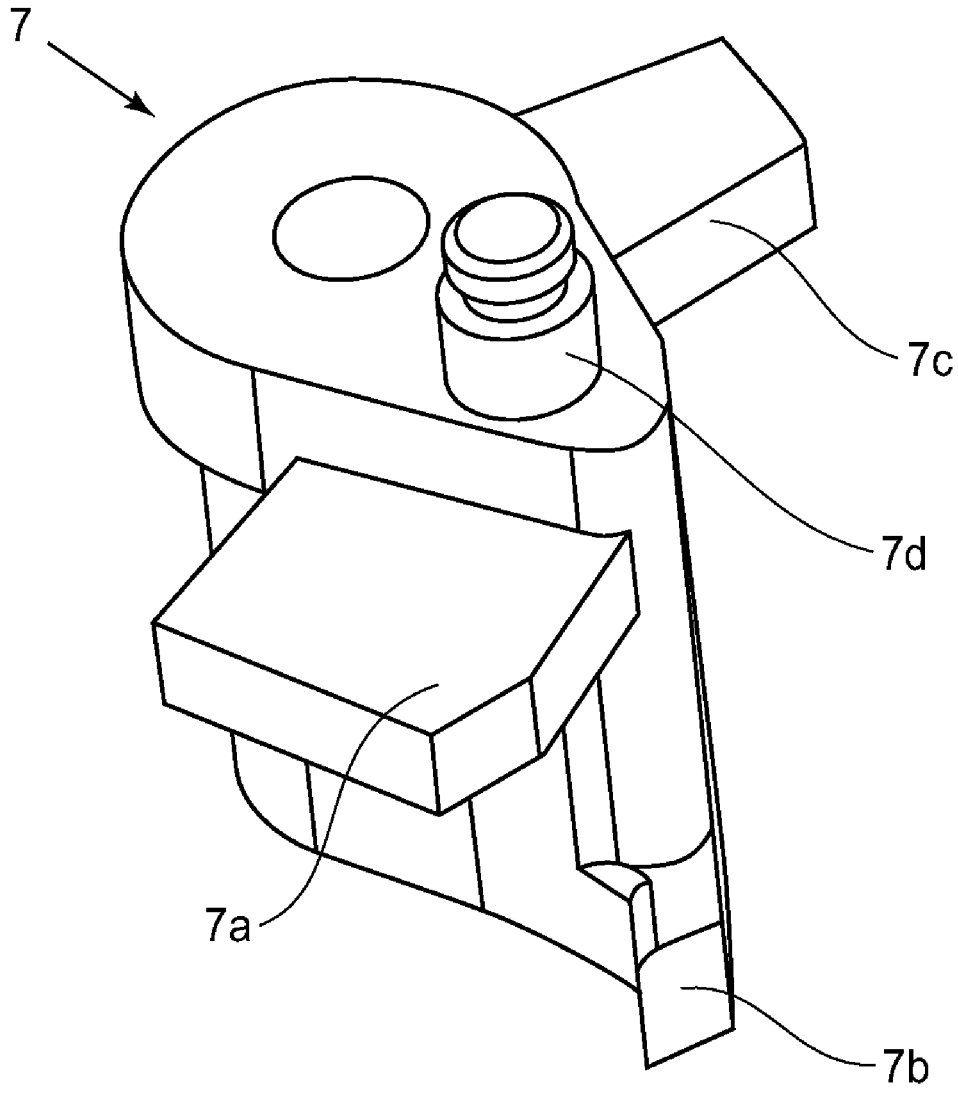
FIG. 7 is a perspective view of the locking member.

Referring to FIG. 5*c*, the container proper 1*a* is provided with a support column 1*h*, which projects from the same lengthwise end surface of the container proper 1*a* as are the shafts of the above-mentioned gears. A locking member 7, which is a part of the rotation controlling means (controlling device, controlling member) which controls the rotation of the catching member 9, is supported by the support column 1*h* in such a manner that it can be changed in position. Referring to FIG. 7, this locking member 7 has a locking member disengaging portion 7*a*, an engaging portion 7*b*, a guiding portion 7*c* (locking member position switching portion), and a support column 7*d*. The guiding portion 7*c* is for moving the locking member 7, which is in the nonoperational position before the mounting of the developer supply container 1, into the operational position, as the developer supply container 1 is mounted. The developer supply container 1 is structured so that at least the tip of the locking member 7 protrudes beyond the peripheral surface of the container proper 1*a* in terms of the radius direction of the container proper 1*a*.

The locking member 7 is a member which also functions as the means for changing (switching) the rotational load of the second gear 6 relative to the container proper 1*a*, as will be described later. That is, the locking member 7 also functions as the means for changing the amount of force necessary for preventing the developer supply container 1 and driving force transmitting member from rotating relative to each other.

Next, a case in which the gears 5 and 6 rotate relative to the container proper 1*a* even when the locking member 7 is in the engaged state will be described. In this embodiment, even in the above described case, the locking member 7 will be referred to as a "locking" member. Further, as will be described later, the developer supply container 1 may be structured so that the locking member 7 will not allow the gears 5 and 6 to rotate relative to the container proper 1*a* at all. All of these states of "lock" will be referred to as state of "lock".

Next, referring to FIGS. 8*a*-8*c*, the relationship between the locking member 7 and catching member 9 will be described.

Figure 8A:
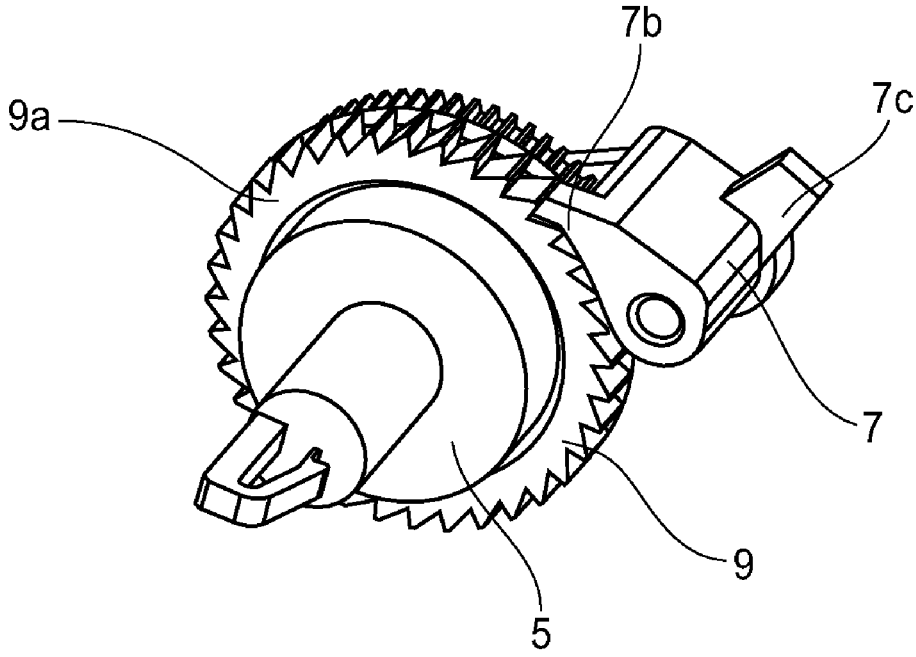
FIG. 8*a* is a perspective view of the torsional load amount switching mechanism when the torsional load is large.

Referring to FIG. 8*a*, while the locking portion 7*b* is in engagement with the catching portion 9*a* of the catching member 9, the catching member 9 is prevented from rotating relative to the container proper 1*a* (locking member 7 is in its active position). As driving force is inputted from the driving gear 12 into the first gear 5 through the second gear 6 while the locking portion 7*b* and the catching portion 9*a* are in the above described state, the amount of rotational load (torque) necessary to rotate the first gear 5 is large, because the ring 14 is in the compressed state between the internal surface 9*b* of the catching member 9 and the shaft portion of the first gear 5.

Figure 8B:
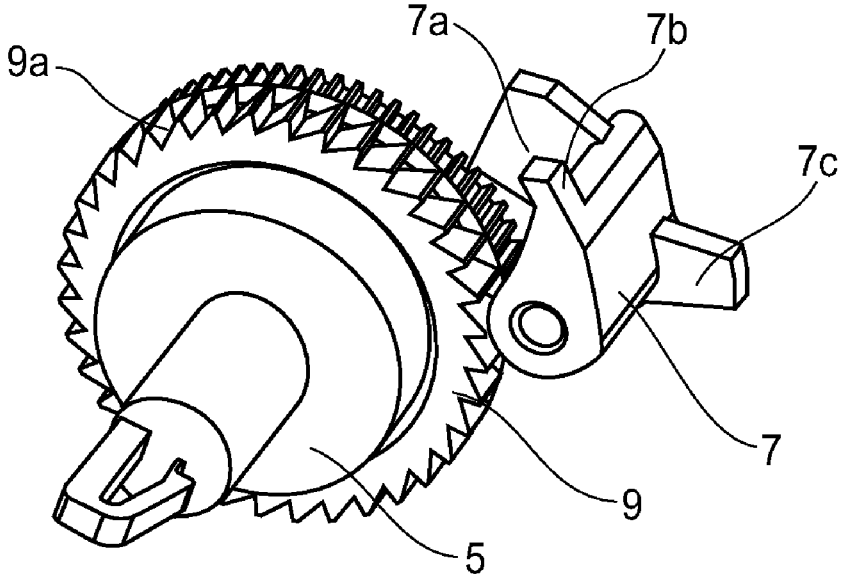
FIG. 8*b* is a perspective view of the torsional load amount switching mechanism when the torsional load is small.

Referring to FIG. 8*b*, on the other hand, while the locking portion 7*b* is not in engagement with the catching portion 9*a* of the catching member 9, the catching member 9 is not prevented from rotating relative to the container proper 1*a* (locking member 7 is in inactive position). As driving force is inputted from the driving gear 12 into the first gear 5 through the second gear 6, the catching member 9 rotates with the first gear 5. That is, the portion of the torsional load of the first gear 5, which is generated by the ring 14, is not present, and therefore, the amount of torque necessary to rotate the first gear 5 is sufficiently small.

Incidentally, in this embodiment, the developer supply container 1 is structured so that in order to generate the torque for rotating the developer supply container 1, the ring 14 is placed between the first gear 5 and catching member 9 to create friction. However, the torque may be generated with the use of the structural arrangement other than the above described one. For example, a structural arrangement that uses the attraction (magnetic force) between the magnetic poles S and N, or the change in the internal and external diameters of an elastic coil spring, may be used.

Figure 5E:
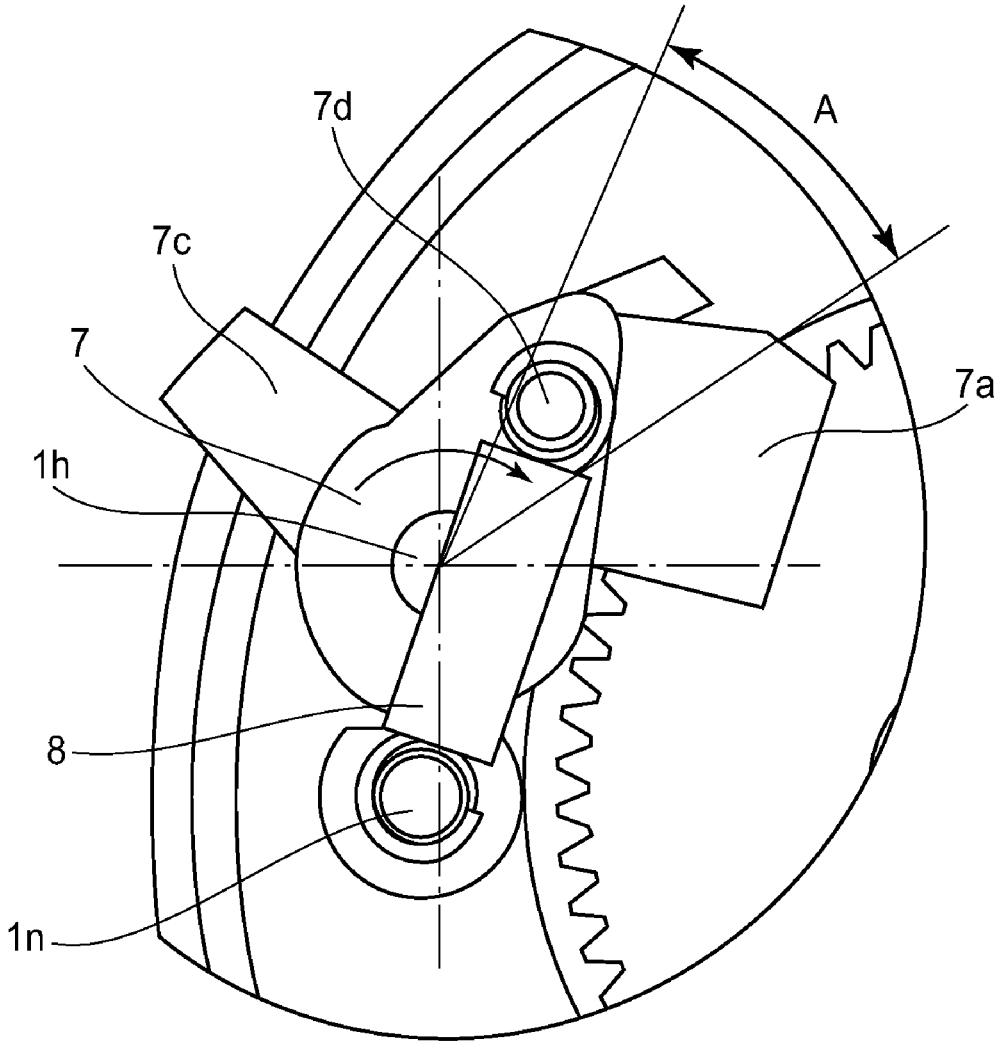
FIG. 5*e* is a locking member and its adjacencies, which is for describing how the locking member is kept under pressure.
Figure 6:
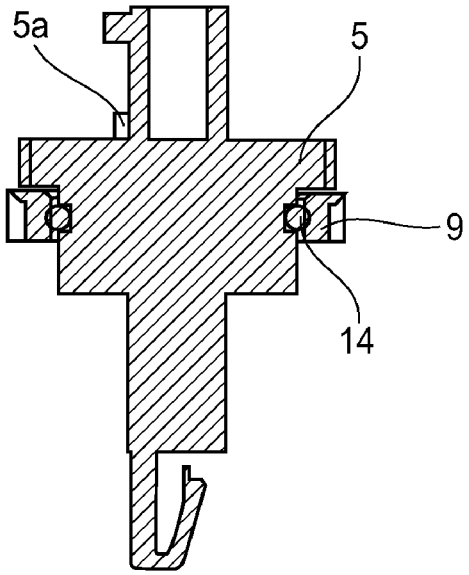
FIG. 6*a* is a sectional view of the torsional load generating portion of the developer supply container.
FIG. 6*b* is an exploded view of the torsional load generating portion of the developer supply container.
Figure 6:
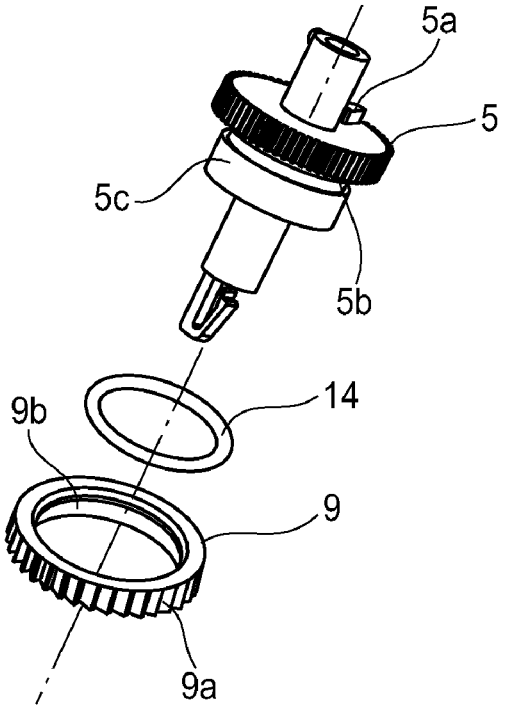

Further, referring to FIGS. 5*c* and 5*e*, the locking member 7 employs a so-called flip-flop mechanism, and is provided with a spring 8 as a member for keeping the locking member 7 under pressure.

The flip-flop mechanism provided with the pressure applying member means a mechanism such as the following one: It is made up of: a member Z, which is enabled to arcuately move between points X and Y (distance L (angle L)); a member W capable of moving the member Z from the point X toward the point Y by a distance shorter than the distance L (angle L); and a pressure applying member (elastic member), and as the member Z is moved from the point X toward the point Y by the member W as far as possible by the member W, it is moved the rest of the way to the point Y by the resiliency of the pressure applying member. That is, the member Z which is at the position X is affected by a member W, by an amount which is not large enough to cause the member Z to reach the point Y without the presence of the pressure applying member (elastic member).

Next, this flip-flop mechanism will be described with referent to this embodiment.

One end of the spring 8 is attached to a support column 1*n*, which perpendicularly protrudes from the lengthwise end surface of the container proper 1*a*, that is, the surface to which the gears are held, whereas the other end of the spring 8 is attached to a support column 7*d*, which is a part of the locking member 7. Referring to FIG. 5*e*, the spring 8 is set so that while the locking member 7 is in a certain area (range A in FIG. 5*e*) in its moving range, the spring 8 applies pressure to the locking member 7 in the direction designated by a referential letter B, that is, the direction to rotationally move the locking member 7. The size of the range A in FIG. 5*e* is to be set according to the position of the support column 1*n*, strength of the spring 8, amount of the friction which occurs between the locking member 7 and the support column 1*h* which rotatably supports the locking member 7, etc.

On the other hand, the first gear 5 is provided with a disengagement projection 5*a* (FIGS. 5 and 6), as a locking member disengaging releasing portion, which perpendicularly protrudes from the outward surface of the first gear 5. This disengagement projection 5*a* is shaped and positioned so that as the first gear 5 rotates relative to the developer supply container 1 when the container 1 is in its operational position into which the developer supply container 1 has been rotated, the disengagement projection 5*a* collides with the disengaging portion 7*a* of the locking member 7.

That is, the disengagement projection 5*a* has the function of pushing the locking member 7 by coming into contact with the disengaging portion 7*a* of the locking member 7 as the first gear 5 rotates. As the locking member 7 is pushed up, the locking portion 7*b* unlatches from the catching portion 9*a* of the catching member 9, instantly freeing the first gear 5 from the torsional load under which it has been.

That is, it is freed from the condition in which the driving force transmitting means is prevented from rotating relative to the developer supply container 1 after the automatic rotation of the developer supply container 1. In other words, the amount of torque necessary to rotate the driving force transmitting member relative to the developer supply container 1 is sufficiently reduced (state of no control).

As described above, the torsional load generating mechanism in this embodiment does not completely prevent the first gear 5 from rotating relative to the container proper 1*a* (does not completely lock first gear 5). That is, the amount of torsional load (rotational resistance) which the torsional load generating mechanism generates is small enough to allow the first gear 5 to rotate relative to the container proper 1*a* while the developer supply container 1 is remaining stationary in its operational position.

Incidentally, in this embodiment, the developer supply container 1 is structured so that when the torsional load generated by the torsional load generating mechanism is unnecessary, the torsional load generating mechanism does not generate the torsional load at all. However, the structural arrangement is such that the amount of torsional load generated by the torsional load generating mechanism after the disengagement of the locking member 7 is smaller than at least the amount of torque necessary to automatically rotate the developer supply container 1.

Further, in this embodiment, the guiding portion 7*c* is an integral part of the locking member 7. However, the guiding portion 7*c* may be formed as a component independent from the locking member 7. In such a case, it is the guiding member 7*c*, which is independent from the locking member 7 that transmits the force from the developer receiving apparatus 10, to the locking member 7.

(Developer Supply Container Setting Operation)

Next, referring to FIGS. 9-11, the operation for setting the developer supply container 1 will be described. Referring to FIGS. 10 and 11, FIGS. 10*b* and 11*b* are sectional views of the developer supply container 1, which are for describing the relationship among primarily the developer discharge hole 1*b*, developer reception hole 10*b*, and development device shutter 11. FIGS. 10*c* and 11*c* are sectional views of the developer supply container 1, which are for describing the relationship among primarily the driving gear 12, first gear 5, and second gear 6. FIGS. 10*d* and 11*d* are sectional views of the developer supply container 1, which are for describing the relationship between primarily the developing device shutter 11, and the portions of the container proper 1*a* which are involved with the movement of the developing device shutter 11.

The abovementioned developer supply container setting operation means the operation for rotating, by a preset angle, the developer supply container 1, which is in its cradle in the developer receiving apparatus 10, into which the developer supply container 1 is mounted, or from which the developer supply container 1 is moved out of the developer receiving apparatus 10, into its position in which it is operational. The abovementioned cradle in the developer receiving apparatus 10, into which the developer supply container 1 is mounted, or from which the developer supply container 1 is moved out of the developer receiving apparatus 10, means the place in the developer receiving apparatus 10, which allows the developer supply container 1 to be mounted into, or removed from, the developer receiving apparatus 10. Further, the abovementioned operational position means the supplying position (set position) in which the developer supply container can discharge the developer therein. Further, as the developer supply container 1 is slightly rotated from the position in which the developer supply container 1 is present, right after it was mounted into the developer receiving apparatus 10, or right before it is removed from the developer receiving apparatus 10, it is made impossible by the locking mechanism for the developer supply container 1 to be removed from the developer receiving apparatus 10; it is also when the developer supply container is in the above described operational position that the developer supply container 1 cannot be removed from the developer receiving apparatus 10.

Next, the steps in the operation for setting the developer supply container 1 will be described in the order in which they are carried out.

(1) Referring to FIG. 9, a user is to open the development supply container replacement cover 15, and mount the developer supply container 1 into the developer receiving apparatus 10 by inserting the developer supply container 1 into the developer receiving apparatus 10 in the direction indicated by an arrow mark A through the hole exposed by the opening of the cover 15. While the developer supply container 1 is inserted, the driving gear 12 of the developer receiving apparatus 10 and the second gear of the developer supply container 1 remain separated from each other, and therefore, driving force transmission is impossible.

Figure 10A:
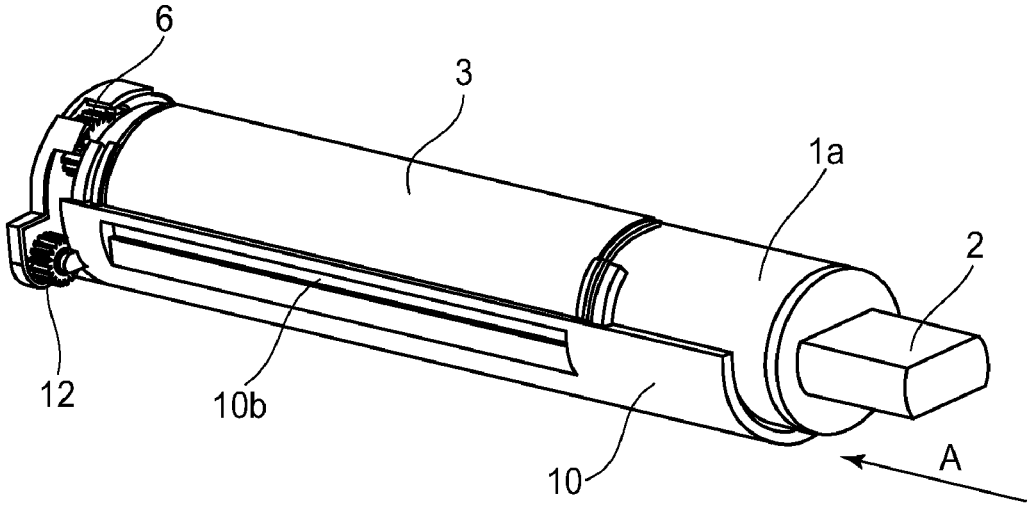
FIG. 10*a* is a perspective view of the developer supply container after the completion of the step for mounting the developer supply container into the developer receiving apparatus.
Figure 10B:
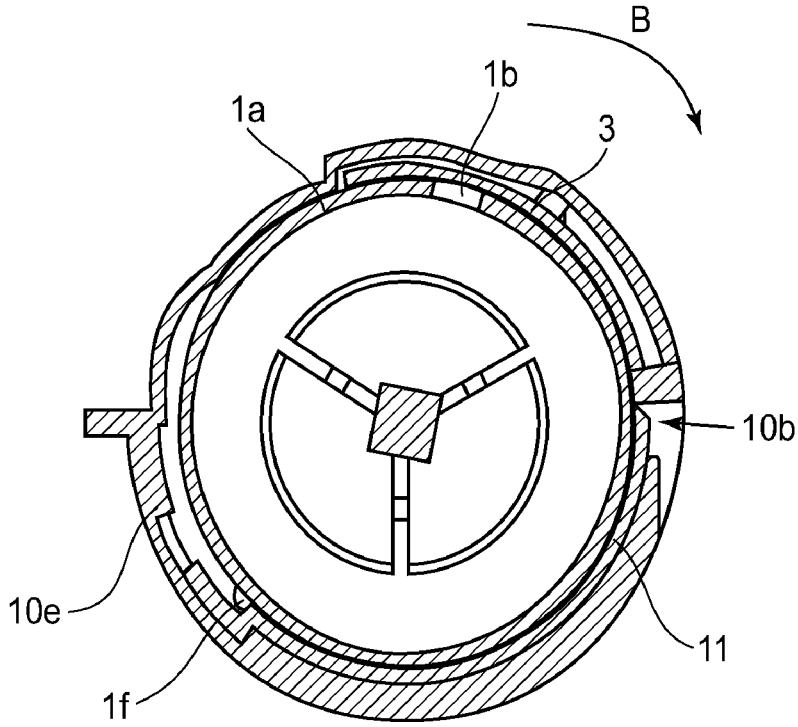
FIG. 10*b* is a sectional view of the developer supply container after the completion of the step for mounting the developer supply container into the developer receiving apparatus.
Figure 10C:
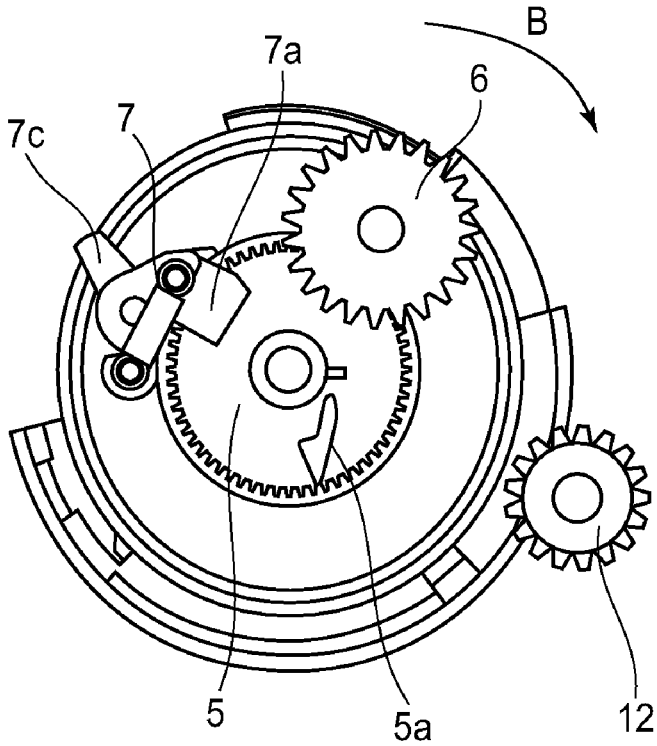
FIG. 10*c* is a plan view of the developer supply container, as seen from the driving force receiving side, after the completion of the step for mounting the developer supply container into the developer receiving apparatus.
Figure 10D:
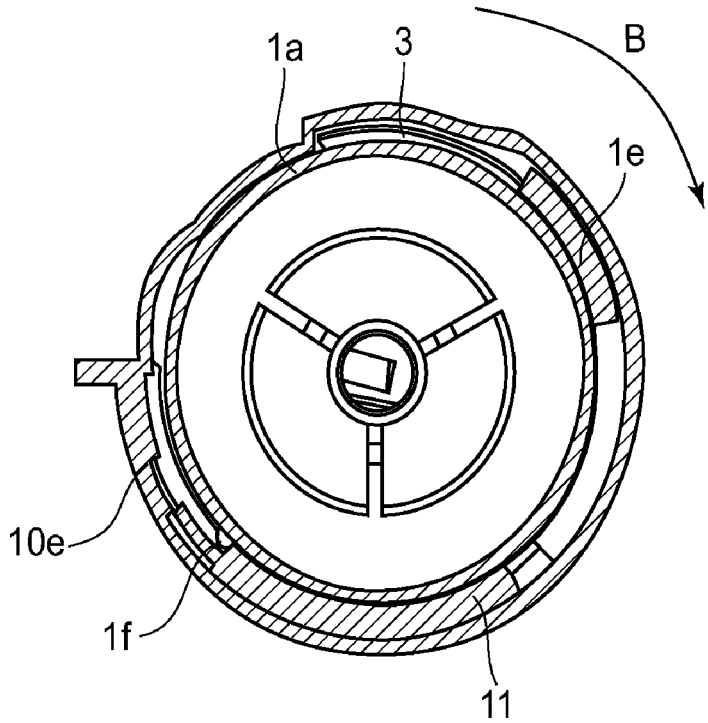
FIG. 10*d* is a sectional view of the developer supply container after the completion of the step for mounting the developer supply container into the developer receiving apparatus.

(2) After the insertion of the developer supply container 1 into the developer receiving apparatus 10, the use is to rotate the handle 2 in the direction indicated by an arrow mark B in FIGS. 10*b*-10*d*, whereby the developer supply container 1 and developer receiving apparatus 10 become connected to each other in such a manner that driving force can be transmitted from the developer receiving apparatus 10 to the developer supply container 1.

More concretely, as the container proper 1*a* rotates in the direction indicated by the arrow mark B, the second gear 6 is made to orbitally move about the rotational center of the developer supply container 1 (rotational center of discharging member 4), until it engages with the driving gear 12. Thereafter, driving force can be transmitted from the driving gear 12 to the second gear 6.

Figure 12A:
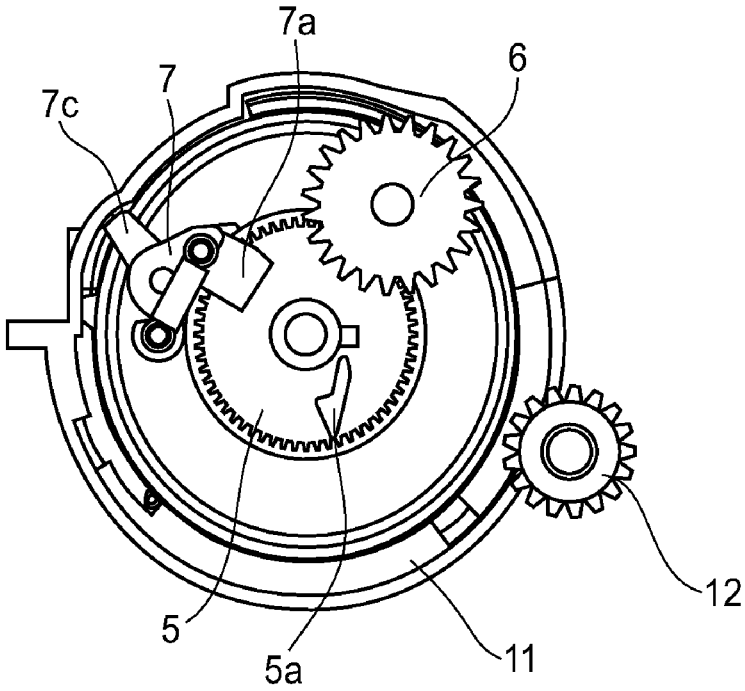
FIG. 12*a* is a plan view of the developer supply container, as seen from the side from which the container is driven, after the completion of the step for mounting the container.
Figure 12B:
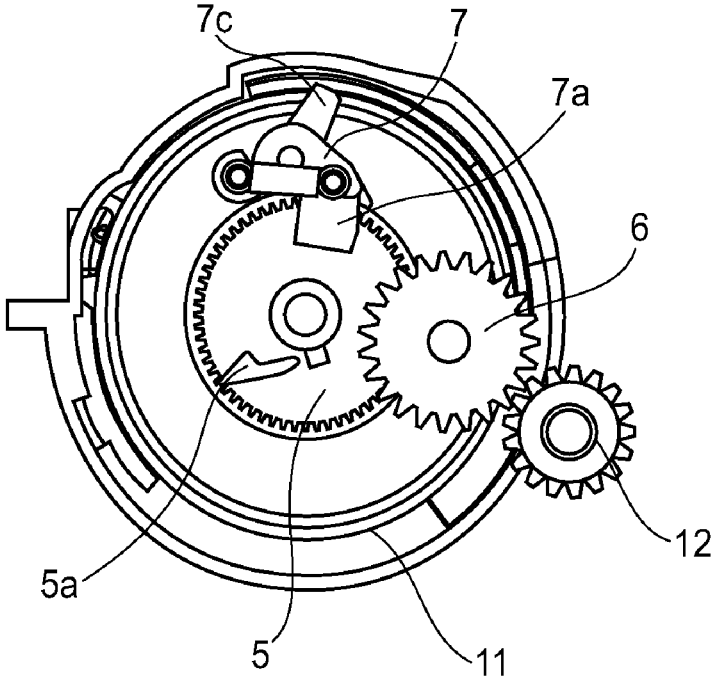
FIG. 12*b* is a plan view of the developer supply container, as seen from the side from which the container is driven, after the completion of the engagement of the second gear of the developer supply container with the container driving gear of the developer receiving apparatus.

FIG. 12*b* shows the developer supply container 1 immediately after it was rotated by the preset angle, by the user. When the developer supply container 1 is in the state shown in FIG. 12*b*, the developer discharge hole 1*b* of the developer supply container 1 is remaining almost completely sealed with the container shutter 3 (leading edge of developer discharge hole 1*b* in terms of moving direction of container shutter 3 is facing the shutter stopper 10*d* of developer receiving apparatus 10). Further, the developer reception hole 10*b* is remaining completely covered with the developing device shutter 11, preventing thereby the developer receiving apparatus 10 from being supplied with the developer from the developer supply container 1.

(3) The user is to close the developer supply container replacement cover 15.

(4) As the developer supply container replacement cover 15 is closed, driving force is inputted from the motor to the driving gear 12 of the developer receiving apparatus 10.

As the driving force is inputted into the driving gear 12, the developer supply container 1 is automatically rotated into its operational position (developer supplying position), because the amount of torque necessary to rotate the second gear 6, which is in mesh with the driving gear 12, is being kept greater than the amount of torque necessary to rotate the developer supply container 1, by the torsional load generating mechanism, through the first gear 5.

Incidentally, in this embodiment, it is structurally set so that the amount of force applied to the developer supply container 1 in the direction to rotate the developer supply container 1 is greater than the amount of force which the developer supply container 1 receives from the developer receiving apparatus 10 in the direction to prevent the developer supply container 1 from rotating. Therefore, it is ensured that as the driving force is transmitted to the second gear 6, the developer supply container 1 automatically rotates.

Further, as the developer supply container 1 rotates, the developing device shutter 11 is opened by the unsealing projection 1*e*. More concretely, as the container proper 1*a* rotates, the developing device shutter 11 slides by being pushed down by the unsealing projection 1*e* of the developer supply container 1, unsealing thereby the developer reception hole 10*b* (FIG. 10*d* R FIG. 11*d*).

On the other hand, as the developing device shutter 11 is moved by the rotation of the container proper 1*a* in the direction to unseal the developer reception hole 10*b*, the container shutter 3 comes into contact with the engaging portion of the developer receiving apparatus 10, being thereby prevented from rotating further. As a result, the developer discharge hole 1*b* is unsealed.

Figure 11A:
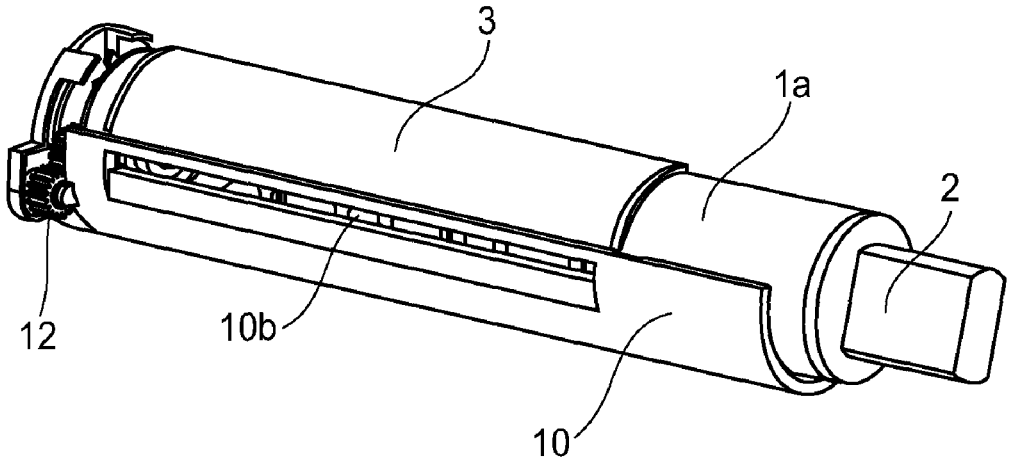
FIG. 11*a* is a perspective view of the developer supply container after the completion of the step for rotating the container, which was carried out after the step for mounting the developer supply container into the developer receiving apparatus.
Figure 11B:
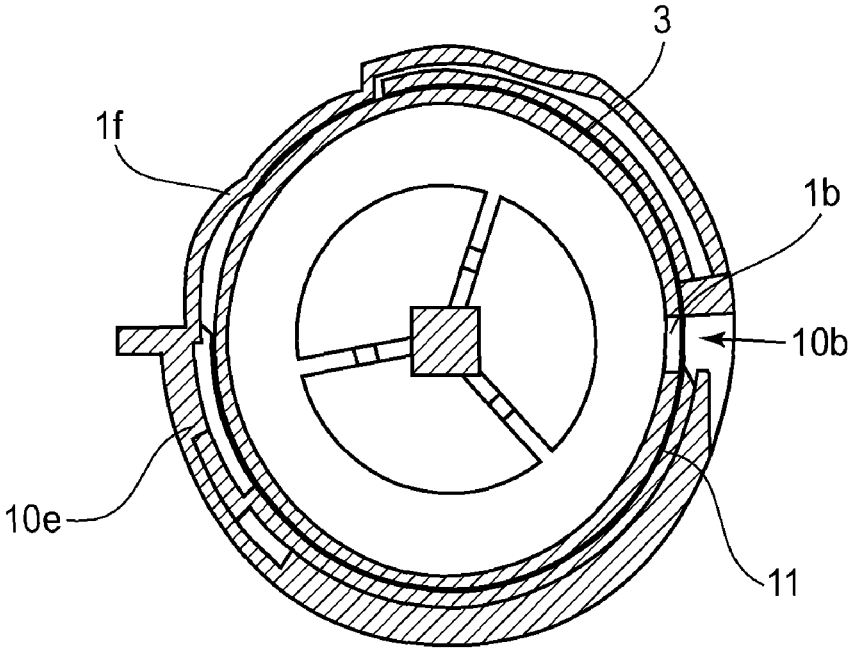
FIG. 11*b* is a sectional view of the developer supply container after the completion of the step for rotating the container rotation, which was carried out after the completion of the step for mounting the developer supply container into the developer receiving apparatus.
Figure 11C:
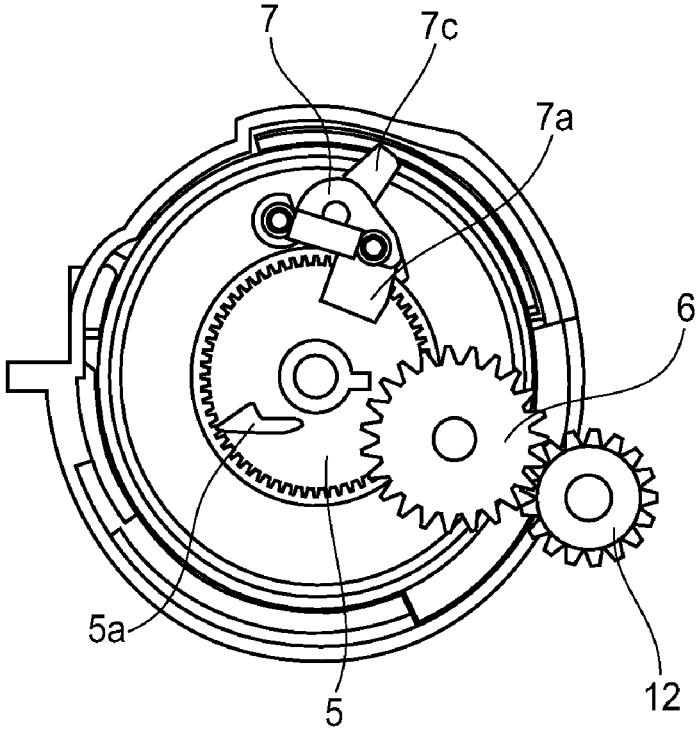
FIG. 11*c* is a lateral plan side view of the developer supply container, as seen from the side from which the container is driven, after the completion of the step for rotating the container rotation, which was carried out after the completion of the step for mounting the developer supply container into the developer receiving apparatus.
Figure 11D:
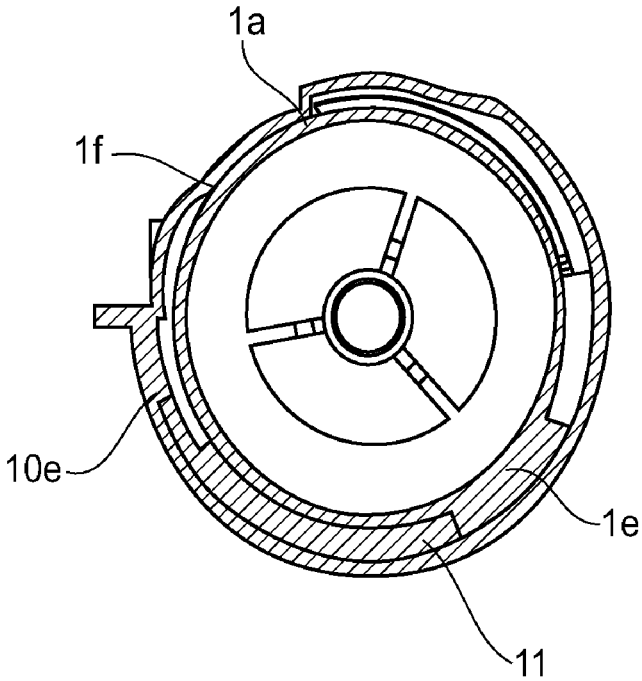
FIG. 11*d* is a sectional view of the developer supply container after the completion of the step for rotating the container, which was carried out after the completion of the step for mounting the developer supply container into the developer receiving apparatus.

As a result, the developer discharge hole 1*b* exposed by the movement of the container shutter 3 directly faces the developer reception hole 10*b* exposed by the movement of the developing device shutter 11; that is, the developer discharge hole 1*b* and developer reception hole 10*b* become connected to each other (FIG. 10*b*→FIG. 11*b*).

Figure 12C:
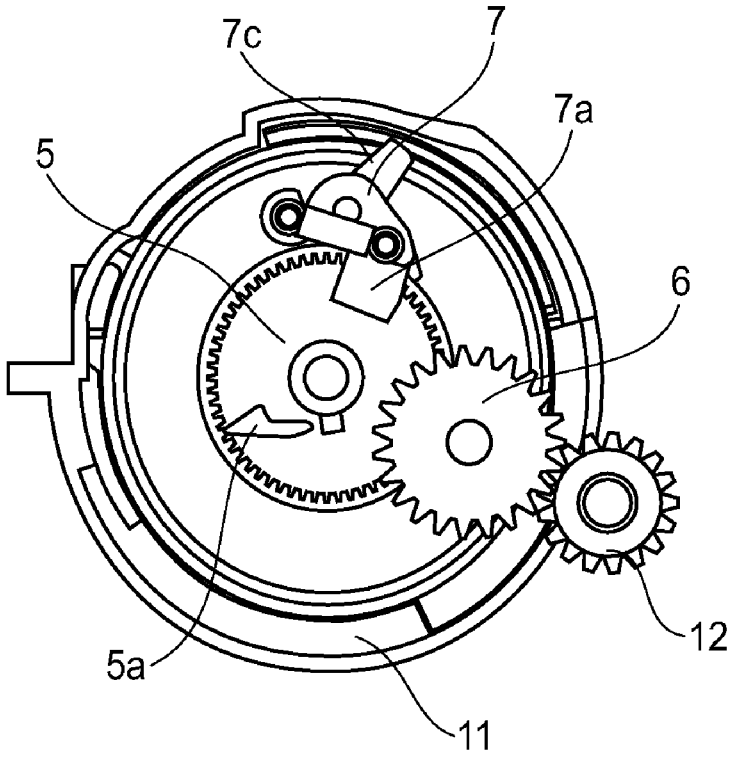
FIG. 12*c* is a plan view of the developer supply container, as seen from the side from which the container is driven, after the completion of the step for rotating the container, which was carried out after the step for mounting the developer supply container.

The developing device shutter 11 stops (FIG. 12*c*) as it comes into contact with the stopper 10*e* (FIG. 11*b*) for preventing the developing device shutter 11 from moving beyond where the development shutter 11 should be when the developer discharge hole 1*b* becomes fully exposed. Therefore, the bottom edge of the developer reception hole 10*b* and the top edge of the developing device shutter 11 precisely align with each other. The automatic rotation of the developer supply container 1 ends as the developing device shutter 11 which is in connection with the developer supply container 1 stops moving.

Further, in this embodiment, the position of the developer discharge hole 1*b* relative to the container proper 1*a* in terms of the circumferential direction of the container proper 1*a* is adjusted so that the developer discharge hole 1*b* precisely aligns with the developer reception hole 10*b* when the developer supply container 1 is in its operational position.

Figure 12D:
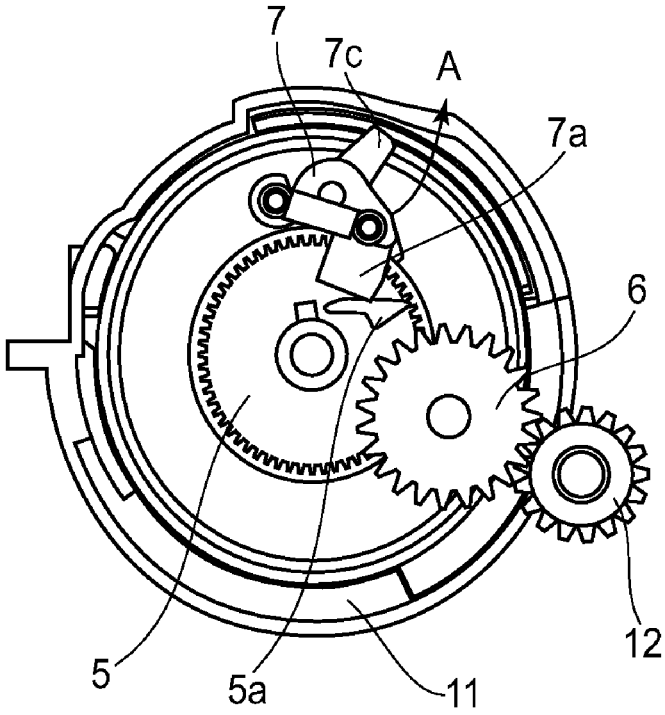
FIG. 12*d* is a plan view of the developer supply container, as seen from the side from which the container is driven, immediately before the locking member is disengaged after the completion of the step for mounting the developer supply container.
Figure 12E:
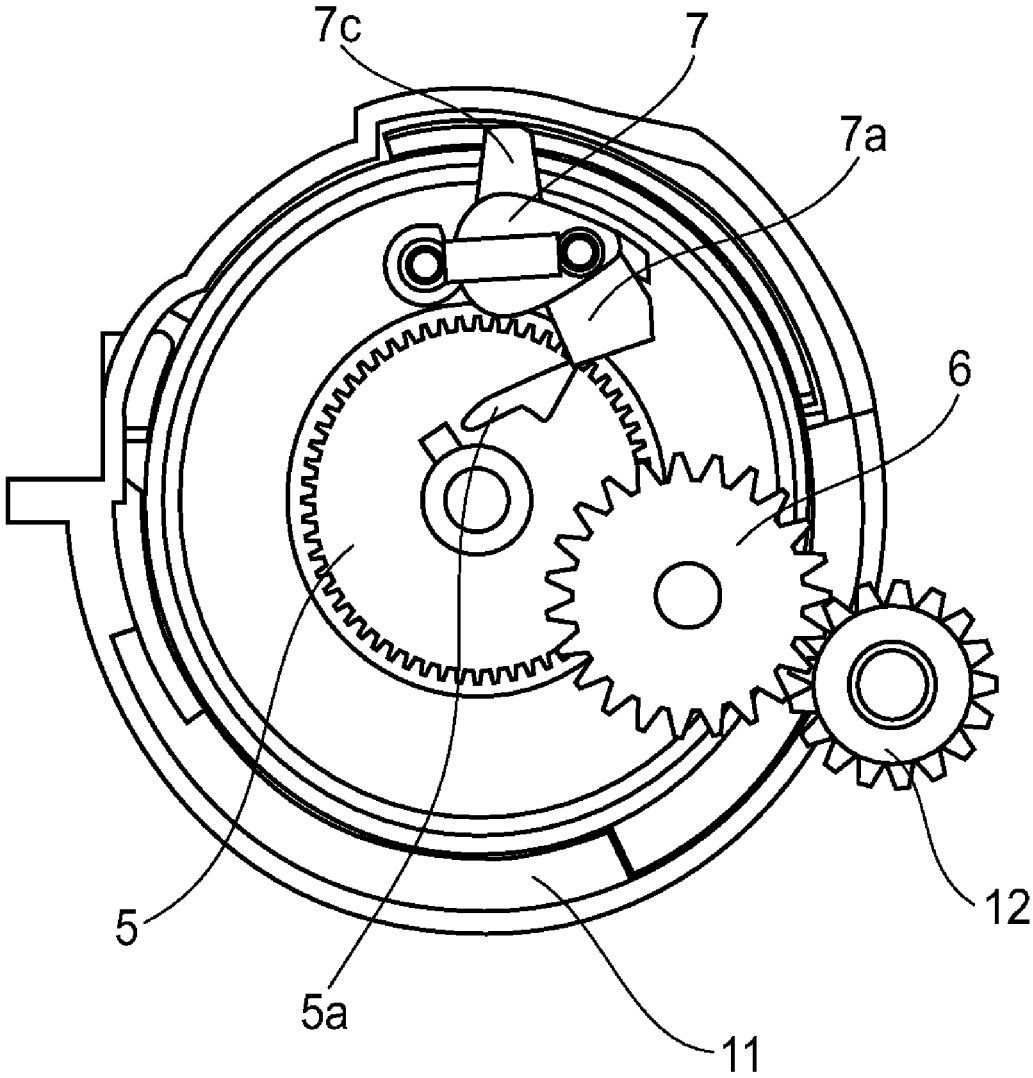
FIG. 12*e* is a plan view of the developer supply container, as seen from the side from which the container is driven, when the locking member is being disengaged after the completion of the step for mounting the developer supply container.

(5) The inputting of driving force into the driving gear 12 is continued even after the developer supply container 1 was moved into its operational position, where the developer supply container 1 is prevented from rotating further, through the developing device shutter 11. Therefore, the first gear 5 begins to rotate relative to the developer supply container 1, which is being prevented from rotating further, against the torsional load with which the first gear 5 is provided by the torsional load generating mechanism. As a result, the disengagement projection 5*a*, with which the first gear 5 is provided, comes into contact with the disengaging portion 7*a* of the locking member 7 (FIG. 12*d*). Then, as the first gear 5 rotates further, the disengagement projection 5*a* pushes up the disengaging portion 7*a* in the direction indicated by an arrow mark A in FIG. 12*d*, causing the locking portion 7*b* of the locking member 7 to disengage from the catching portion 9*a* of the catching member 9 (FIG. 12*e* and FIG. 8*b*).

As a result, the first gear 5 is freed from the torsional load to which the first gear 5 has been subjected; the amount of torque necessary to the first gear 5 becomes sufficiently small.

Thereafter, the amount of force required to rotate the driving transmitting member (first to third gears) by the developer receiving apparatus 10 (driving gear 12) in the developer supplying process can be smaller. Therefore, the driving gear 12 is not going to be subjected to a large amount of torque (torsional load). Thus, it is possible to reliably transmit the driving force.

Further, the developer supply container 1 and developer receiving apparatus 10 in this embodiment are structured so that the torsional load on the first gear 5 is removed with a certain amount of delay, after the completion of the process in which the developer supply container 1 is automatically rotated to align the developer discharge hole 1*b* with the developer reception hole 10*b*. Therefore, it is possible to always satisfactorily align the developer discharge hole 1*b* with the developer reception hole 10*b*.

Incidentally, in a case where the developer supply container 1 and developer receiving apparatus 10 are structured so that the amount of torsional load, to which the driving force transmitting member is subjected, is not changed (switched), that is, the amount of torsional load is kept at the same level, even after the completion of the rotation of the container proper 1*a*, that is, even after the developer discharge hole 1*b* aligned with the developer reception hole 10*b*, the first gear 5 remains under the torsional load generated by the torsional load generating mechanism, and therefore, the driving gear 12 also remains under the load through the second gear 6, making it possible that problems such as the following ones might occur. Therefore, the structural arrangement in this embodiment, which changes (switches) the amount of torsional load, is preferable.

That is, in a case where the developer supply container 1 and developer receiving apparatus 10 are structured not to change the torsional load upon the first gear 5, that is, to maintain the same amount of torsional load, the torsional load generating mechanism continues to act on the first gear 5 for a long time, even after the completion of the rotation of the container proper 1*a*, that is, even after the completion of the alignment of the developer discharge hole 1*b* with the developer reception hole 10*b*. Thus, the driving gear 12 also remains under the torsional load through the second gear 6 even after the completion of the automatic rotation of the container proper 1*a*. Therefore, it is possible that the durability of the driving gear 12 and/or the reliability with which the driving force is transmitted will be negatively affected by the load. It is also possible that as the first gear 5 is continuously rotated for a long time, the ring 14 becomes heated due to the rotational friction, and therefore, it is possible that this heat will cause the driving force transmitting member to deteriorate and/or the developer in the developer supply container 1 to deteriorate.

On the other hand, in the case of the structural arrangement in this embodiment, it is possible to reduce the amount of electrical power required to drive the driving force transmitting member by the developer receiving apparatus 10. Further, it is possible to do away with the requirement that the components of the gear train of the developer receiving apparatus 10, for example, the driving gear 12, to begin with, have to be significantly greater in strength and durability than otherwise. Therefore, the structural arrangement in this embodiment can contribute to the cost reduction of the developer receiving apparatus 10. Further, it can prevent the above-mentioned thermal deterioration of the driving force transmitting member and developer.

As described above, this embodiment makes it possible to automate the process for precisely positioning the developer supply container 1 to ensure that the developer supplying process which comes after the developer supply container positioning process is properly carried out, even through the developer supply container 1 and developer receiving apparatus 10 in this embodiment is simple in terms of the structure and the operation for transmitting the driving force from the developer receiving apparatus 10 to the driving force transmitting member of the developer supply container 1.

That is, according to this embodiment, it is possible to automatically rotate the developer supply container 1 into its operational position, with the use of the simple structural arrangement, that is, without the need for a driving motor dedicated to the rotation of the developer supply container 1 and a gear train separate from the above described gear train. Therefore, it is possible to improve the developer supply container 1 and an image forming apparatus 10 compatible with the developer supply container 1 in usability, while ensuring the developer is satisfactorily supplied.

Therefore, it is possible to prevent the problem that the insufficiency in the amount by which developer is supplied causes the formation of images which are unsatisfactory in that they are nonuniform in density and/or not high enough in density.

Further, the problem concerning a combination of a developer supply container and a developer receiving apparatus, which is structured so that the developer supply container is automatically rotated into its operation position, with the utilization of the driving force transmitting member, can be simply prevented by structuring the combination as it is in this embodiment.

(Operation for Removing Developer Supply Container)

Next, the operation for removing the developer supply container 1 to replace it, or for some other reason, will be described.

(1) First, a user is to open the developer supply container replacement cover 15.

(2) Then, the user is to rotate the developer supply container 1 from its operation position to its initial position in the developer receiving apparatus 10, by rotating the handle 2 in the direction opposite from the direction indicated by the arrow mark B in FIG. 10. That is, the developer supply container 1 is rotated back into the initial position, shown in FIG. 10*c*.

As the developer supply container 1 is rotated as described above, the developing device shutter 11 is pushed up by the sealing projection 1*f* of the developer supply container 1, resealing therefore the developer reception hole 10*b*. Also, the developer discharge hole 1*b* rotationally moves is resealed by the container shutter 3 (FIG. 11*b*→FIG. 10*b*).

More concretely, the container shutter 3 comes into contact with the stopper portion (unshown) of the developer receiving apparatus 10, being thereby prevented from moving farther. Then, while the container shutter 3 is in the above described state, the developer supply container 1 is rotated, whereby the developer discharge hole 1*b* is resealed by the container shutter 3.

Further, the developer supply container 1 is structured so that the rotation of the developer supply container 1, which is for resealing the developing device shutter 11, is stopped by the contact between the abovementioned stopper (unshown) with which the container shutter guiding portion 1*d* is provided, and the container shutter 3.

Further, the engagement between the second gear 6 and driving gear 12 is dissolved by the rotation of the developer supply container 1; by the time the developer supply container 1 is rotated back into its initial position in the developer receiving apparatus 10, the second gear 6 and driving gear 12 become completely separated from each other, stopping therefore interfering with each other.

(3) Lastly, the user is to take the developer supply container 1, which is in its initial position in the developer receiving apparatus 10, from the developer receiving apparatus 10.

Thereafter, the user is to replace the removed developer supply container 1 with a brand-new developer supply container 1 which has been prepared in advance. The operational steps carried out thereafter are the same as those in the above described "developer supply container setting operation".

(Principle for Rotating Developer Supply Container)

Figure 13:
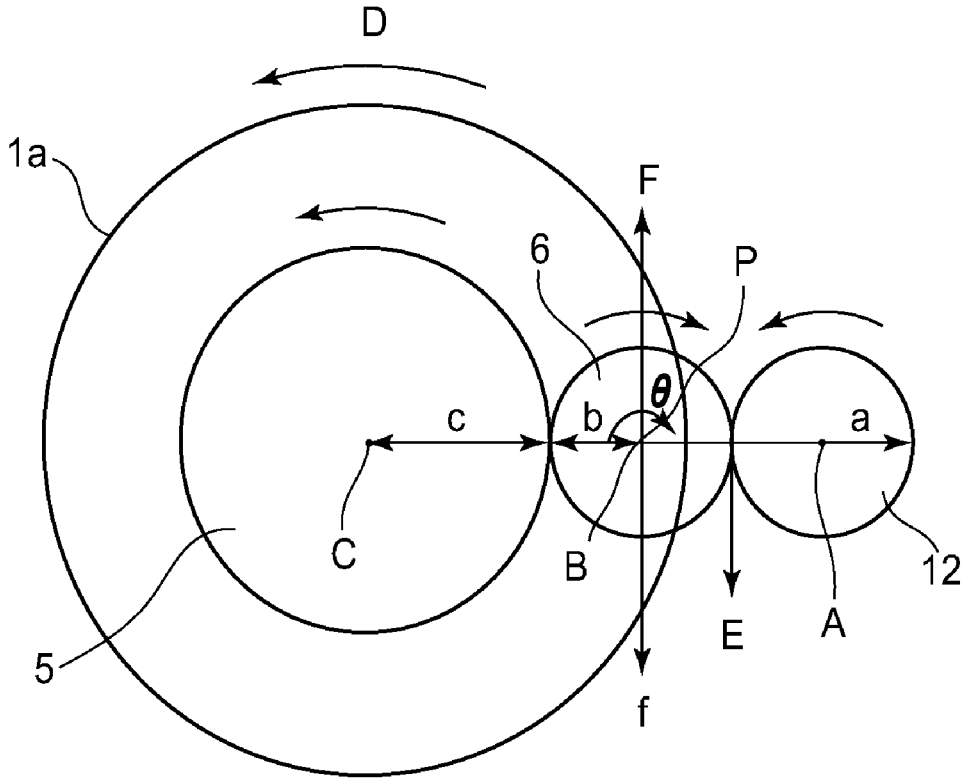
FIG. 13 is a schematic drawing for describing the force which works in the direction to pull the shutter inward.

Here, referring to FIG. 13, the principle for rotating the developer supply container 1 will be described. FIG. 13 is a drawing for describing the principle, based on which the developer supply container 1 is automatically rotated by the "inward pull".

As the second gear 6 receives rotational force from the driving gear 12 while remaining meshed with the driving gear 12, the shaft portion P of the second gear 6 is subjected to the rotational force f attributable to the rotation of the second gear 6, and this rotational force f acts on the container proper 1*a*. If this rotational force f is greater than the resistance F (friction which occurs between peripheral surface of developer supply container 1 and developer receiving apparatus 10), which the developer supply container 1 receives from the developer receiving apparatus 10, the container proper 1*a* rotates.

Therefore, it is desired that the torsional load to which the developer supply container 1 is subjected by the second gear 6, and which is created by causing the torsional load generating mechanism to act on the first gear 5, is made greater than the torsional resistance which the developer supply container 1 receives from the developer receiving apparatus 10.

On the other hand, the torsional load to which the developer supply container 1 is subjected by the second gear 6 after the first gear 5 is freed from the effect of the rotation load generating mechanism, is desired to be made smaller than at least the rotational resistance which the developer supply container 1 receives from the developer receiving apparatus 10.

It is desired that the above described relationship, in terms of amount, between the torsional load and rotational resistance, holds during the period from when the driving gear 12 begins to mesh with the second gear 6 to the completion of the opening of the developing device shutter 11.

The amount of this torque f can be obtained by measuring the amount of torque necessary to rotate (manually) the driving gear 12 in the direction to move the developing device shutter 11 in the unsealing direction, while the driving gear 12 is in mesh with the second gear 6. More concretely, the driving gear 12 is provided with a torque measurement shaft or the like, which is coaxial and rotates with the driving gear 12. Then, the amount of the abovementioned torque can be obtained by measuring the amount of torque necessary to rotate this torque measurement shaft while the driving gear 12 is in the above described state. The thus obtained amount of torque is the amount of torque necessary when there is no toner in the developer supply container 1.

The amount of torsional rotational resistance F can be obtained by measuring the amount of torque necessary to rotate (manually) the container proper 1*a* in the direction to move the developing device shutter 11 in the direction to unseal the developer discharge hole 1*e*. That is, the amount is measured by rotating the container proper 1*a* during the period from when the driving gear 12 begins to mesh with the second gear 6 to when the developing device shutter 11 becomes fully opened. More concretely, the driving gear 12 is removed from the developer receiving apparatus 10, and the torque measurement shaft or the like, the rotational axis of which aligns with the rotational center of the container proper 1*a*, is provided. Then, the amount of torsional resistance F is obtained by measuring the amount of torque necessary to rotate this torque measurement shaft with the use of a torque measuring device.

In this embodiment, a torque gauge (BTG 90 CN), a product of Tohnichi Co. Ltd., was used as the torque measuring device. Incidentally, the amount of torque may be automatically measured using a torque measuring machine made up of a motor and a torque converter, as the torque measuring device.

Next, its principle will be described in detail with reference to the model shown in FIG. 13. It is assumed that the driving gear 12, second gear 6, and first gear 5 are a, b, and c in the radius of their pitch circle, and A, B, and C in the amount of torque measured at the center of each gear, respectively (A, B, and C also designate rotational centers of the three gears, respectively). Further, a letter E stands for the amount of "inward pull", which occurs after the meshing of the driving gear 12 with the second gear 6, and a letter D stands for the torque necessary to rotate the container proper 1*a* about its rotational center.

The requirement for the container proper 1*a* to rotate is: f>F, and $$F=D/(b+c)$$

$$f=(c+2b)/(c+b)\times E=(c+2b)/(c+b)\times(C/c+B/b),$$

Therefore, $$(c+2b)/(c+b)\times(C/c+B/b)>D/(b+c), \text{ and}$$

$$(C/c+B/b)>D/(c+2b).$$

Therefore, in order to ensure that the container proper 1*a* is rotated by the generation of the "inward pull", it is desired that the formulas given above are satisfied. Thus, it is reasonable to consider a means for increasing the torque C or B, or reducing the torque D.

That is, the container proper 1*a* can be rotated by increasing the amount of torque necessary to rotate the first gear 5 which is directly in connection to the developer discharging member 4, and that necessary to rotate the second gear 6, while reducing the amount of rotational resistance to which the container proper 1*a* is subjected.

In this embodiment, the amount of torque C necessary to rotate the first gear 5 is increased by the above described torsional resistance generating mechanism, increasing thereby the amount of torque B necessary to rotate the second gear 6.

In consideration of the fact that the container proper 1*a* is rotated by ensuring that the "inward pull" is generated, the amount of torque necessary to rotate the first gear 5 is desired to be as large as possible. However, if the amount of torque necessary to rotate the first gear 5 is excessively large, the power consumption by the motor of the developer receiving apparatus 10 becomes excessively large, and the gears must be increased in physical strength and durability. Further, it is not desirable from the standpoint of the effects of the heat attributable to the rotation of the first gear 5, that the amount of torque necessary to rotate the first gear 5 is excessive. Therefore, it is desired that the amount of the above described torque is set to an appropriate value by adjusting the amount of pressure generated between the ring 14 and internal surface 9*b* of the catching member 9, and carefully choosing the material for the ring 14.

The amount of torsional resistance (friction between peripheral surface of developer supply container 1 and wall of developer supply container cradle of developer receiving apparatus 10) to which the developer supply container 1 is subjected by the developer receiving apparatus 10 is desired to be as small as possible. In this embodiment, in consideration of the above described standpoint, the friction is reduced as much as possible by reducing the container proper 1*a* in the area (peripheral surface) of contact between it and the wall of the developer supply container cradle of the developer receiving apparatus 10, by providing the peripheral surface of the contain proper 1*a* with a seal which is superior in slipperiness, or the like methods.

Next, the setting of the amount of torque necessary to rotate the second gear 6 will be concretely described.

The amount of torque necessary to rotate the second gear 6 is desired to be set to an appropriate value, in consideration of the amount of force (torque) necessary to be applied to the container proper 1*a* (at peripheral surface of developer supply container 1), diameter of the developer supply container 1, diameter of the second gear 6, and amount of the eccentricity of the second gear 6. Here, there is the following relationship among the rotational (torsional) resistance F' of the container proper 1*a*, diameter D' of the developer supply container 1, amount of the eccentricity e of the second gear 6 (distance from rotational center of developer supply container 1 to point at which second gear 6 is supported by shaft), and diameter d' of the second gear 6:

Amount of torque necessary to rotate second gear $$6=F'\times d'\times D'/(2\times(2e+d')).$$

To begin with, the amount of torsional resistance F1' of the developer supply container 1 is affected by the diameter of the container proper 1*a*, size of the seal, and structure of the seal. However, it is reasonable to think that the diameter of the container proper 1*a* is in a range of 200 mm-300 mm. In such a case, the amount of rotational resistance F' is generally set to a value in a range of 1 N-200 N. Further, in consideration of the diameter of the container proper 1*a*, the diameter d' of the second gear 6 is set to a value in a range of 4 mm-100 mm, and the amount of eccentricity e of the second gear 6 is set to a value in the range of 4 mm-100 mm. These values are to be appropriately selected according to the size and specifications of an image forming apparatus. Thus, in the case of an ordinary developer supply container 1, the torsional resistance for the second gear 6 which is calculated in consideration of the minimum and maximum values of the above-mentioned ranges, falls in a range of $3.0\times10^{-4}$ N·m-18.5 N·m.

For example, in a case where the diameter of a developer supply container such as the one used in this embodiment is 60 mm, the amount of the torsional resistance F is thought to be roughly in a range of 5 N-100 N.

Therefore, in a case where the second gear 6 in this embodiment is 20 in the amount of eccentricity and 20 mm in diameter, the amount of the torsional resistance for the second gear 6 is desired to be set to be no less than 0.05 N·m and no more than 1 N·m, in consideration of the abovementioned torsional resistance F. Further, in consideration of the amount of various losses, variance in component measurements, safety factors, etc., the minimum value for the torsional resistance for the second gear 6 is desired to be set to roughly 0.1 N·m, that is, twice the smallest value in the abovementioned range. Further, in consideration of the strength of the torsional resistance generating mechanism, the maximum value for the torsional resistance for the second gear 6 is desired to be set to roughly 0.5 N·m. That is, the amount of torsional resistance for the second gear 6 is desired to be set to be no less than 0.1 N·m and no more than 0.5 N·m.

In this embodiment, the developer supply container 1 is structured in consideration of the variances in the various members of the developer supply container 1 and image forming apparatus so that the amount of torsional resistance for the second gear 6 falls in a range of 0.15 N·m-0.34 N·m including the amount of torsional resistance (roughly 0.05 N·m) which occurs when the developer is stirred. However, the amount of torsional resistance which occurs when stirring the developer (amount of torque necessary to stir developer) is affected by the amount of the developer in the developer supply container 1 and the structural arrangement for stirring the developer. Therefore, the amount of the torsional resistance for the second gear 6 should be appropriately set.

Further, after the automatic rotation of the developer supply container 1, the locking member 7 is disengaged, reducing the contribution of the torsional load generating mechanism to zero. Thus, after the disengagement of the locking member 7, the amount of torque required to drive the developer supply container 1 is only the amount of torque required to stir the developer (rotate the discharging member 4), in practical terms.

In this embodiment, the amount of torque necessary to drive the second gear 6 after the disengagement of the locking member 7 is roughly 0.05 N·m, which is the amount of torque necessary to stir the developer.

In consideration of the amount of load to which the developer receiving apparatus 10 is subjected and the amount of electric power consumption, the amount of torque necessary to rotate the second gear 6 after the disengagement of the locking member 7 is desired to as small as possible. Assuming that an image forming apparatus is structured as is the one in this embodiment, if the portion of the torque required to rotate the developer supply container 1, which is attributable to the torsional load generating mechanism, is no less than 0.05 N·m when the locking member 7 is disengaged, heat will generate from the torsional load generating portion. Further, it is possible that this heat will accumulate, and transmit to the developer in the developer supply container 1, affecting thereby the developer.

Therefore, it is desired that the amount of torsional load which the torsional load generating mechanism generates after the disengagement of the locking member 7 is made to be no more than 0.05 N·m.

Further, the direction in which the force E is generated as the second gear 6 receives rotational force from the driving gear 12 is one of the factors, which is to be seriously taken into consideration.

To describe more concretely with reference to FIG. 13, the rotational force (torque) F which generates in the shaft portion of the second gear 6 (to rotate container proper 1*a*) is equal to one of components of the force E which the second gear 6 receives from the driving gear 12. Thus, it is reasonable to think that it is possible that, depending on the positional relationship between the second gear 6 and driving gear 12 when they engage with each other, the rotational force (torque) F may not be generated. In the case of the model shown in FIG. 13, the straight line which connects a point C (which coincides with rotational center of first gear 5 in this mode), which is the rotational center of the container proper 1*a*, and a point B which is the rotational center of the second gear 6, is the referential line. It is desired that the angle θ (angle measured in clockwise direction from referential line (0°) between this referential line and the straight line which connects the point B, and a point A which is the rotational center of the driving gear 12, is made to be no less than 90° and no more than 270°.

In particular, it is desired that the component f (direction of which is parallel to line tangential to peripheral surface of container proper 1*a* at point of mesh between second gear 6 and driving gear 12) of this force E, which is generated at the point of mesh between the second gear 6 and driving gear 2 as driving force is transmitted from the driving gear 2 to the second gear 6, is effectively utilized. This is why θ is desired to be set to a value which is no less than 120° and not more than 240°. Further, in order to more effectively utilize the component (f) of the force F, which is generated in the direction f, θ is desired to be set to a value which is close to 180°. In this model, θ is 180°.

In this embodiment, the positioning, structures, etc., of each gear is determined in consideration of the above described factors.

Incidentally, in reality, a certain amount of the driving force is lost as the driving force is transmitted from one gear to another. However, this model was described ignoring this loss. In other words, it is needless to say that the various structural features of the developer supply container 1 should be determined in consideration of the losses, such as the above described one, so that the developer supply container 1 is automatically rotated in a proper manner.

As described above, in this embodiment, the first and second gears 5 and 6 are employed as the means for transmitting driving force. Therefore, the driving force transmitting means in this embodiment is simple in structure, and yet, ensures that driving force is reliably transmitted.

Further, when tests for replenishing a developer receiving apparatus with developer were carried out using the developer supply container 1 in this embodiment, there was no problem related to the replenishment, and therefore, it was possible to reliably form images.

Incidentally, the choice of a developer receiving apparatus does not need to be limited to the above described one. For example, a developer receiving apparatus may be structured to be removably mountable in an image forming apparatus. That is, it may be structured as an image formation unit. As an example of the image formation unit, a process cartridge provided with a photosensitive member, and at least one processing means among a charging device, a cleaner, etc., and a development cartridge provided with a developing device, can be listed.

The materials, molding methods, shapes of the various members described above do not need to be limited to those in this embodiment. They may be freely selected as long as the above described effects can be achieved.

(Mechanism for Re-Locking Rocking Member)

It sometimes occurred for an unspecified that when mounting the developer supply container 1 into the developer receiving apparatus 10, the locking portion 7*b* of the locking member 7 becomes disengaged from the catch portion 9*a* of the catching member 9. For example, it is conceivable that a user disengaged the locking member 7 by erroneously touching the locking member 7, or temporarily removing the developer supply container 1 even though there was a sufficient amount of developer in the developer supply container 1. Therefore, in this embodiment, the locking member 7 is structured so that it can be re-locked. Next, the mechanism for re-locking the locking member 7 will be described in detail.

Figure 14A:
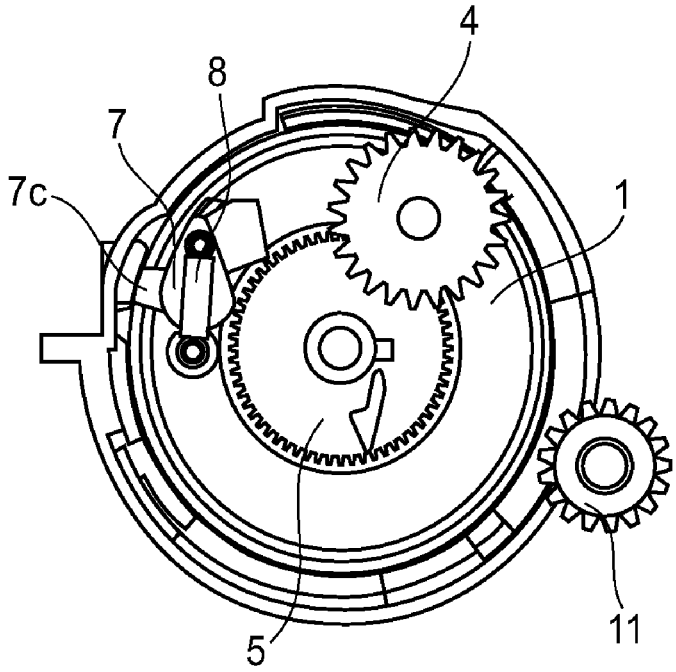
FIG. 14*a* is a plan view of the developer supply container, as seen from the side from which the container is driven, after the disengagement of the locking member.
Figure 14B:
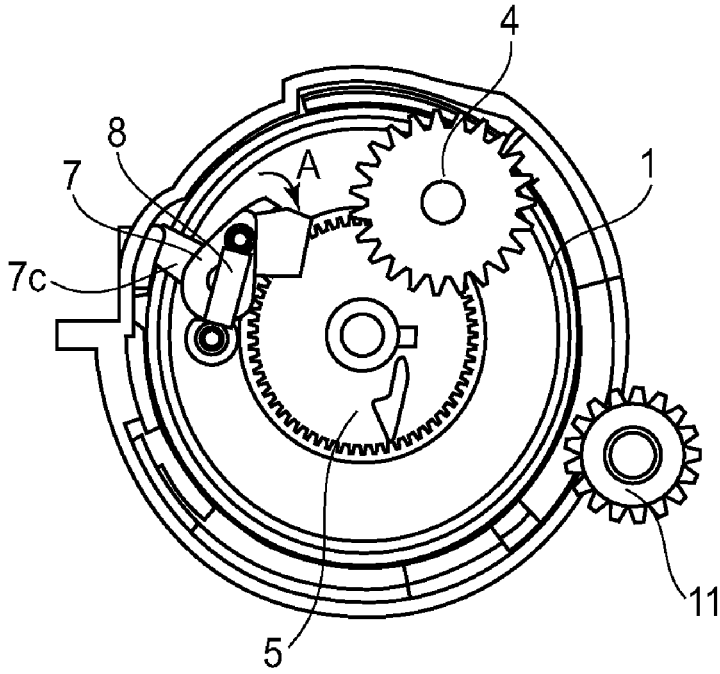
FIG. 14*b* is a plan view of the developer supply container, as seen from the side from which the container is driven, when the locking member is engaging.
Figure 14C:
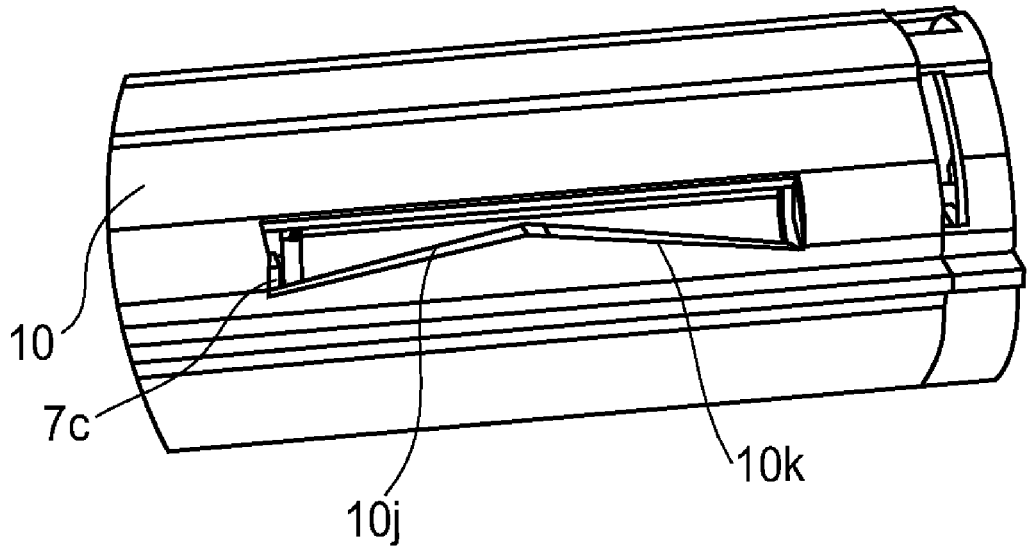
FIG. 14*c* is a schematic drawing for describing the relationship between the guiding member and the guiding portion during the insertion of the developer supply container, while the locking member is not in engagement with the first gear.
Figure 14D:
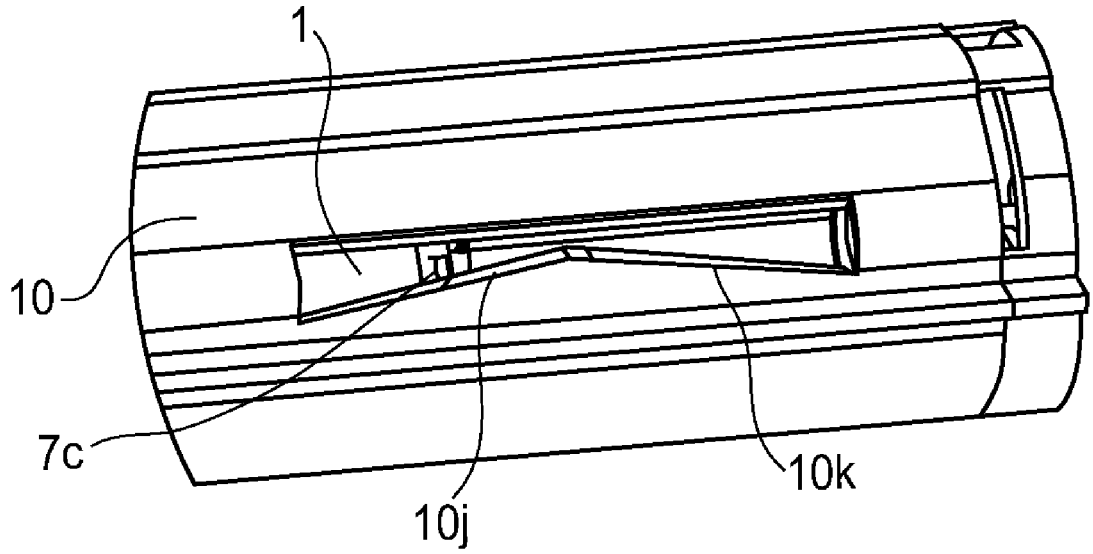
FIG. 14*d* is a schematic drawing for describing the relationship between the guiding member and guiding portion when the locking member is being engaged latches during the insertion of the developer supply container.
Figure 14E:
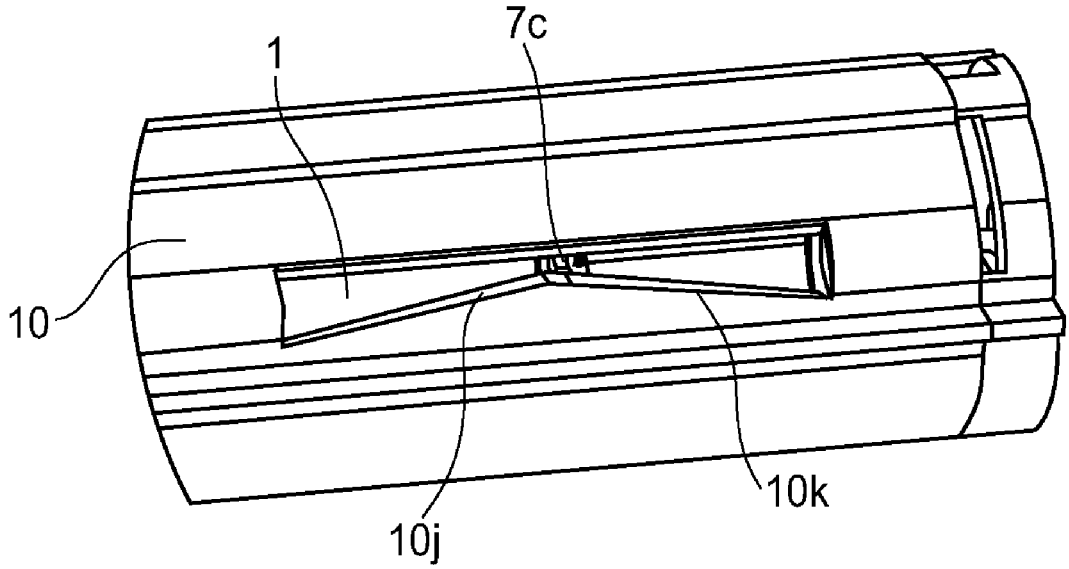
FIG. 14*e* is also a schematic drawing for describing the relationship between the guiding member and guiding portion when the locking member is being engaged during the insertion of the developer supply container.

The developer supply container 1 in this embodiment is provided with a re-locking mechanism (guiding mechanism) so that even if a situation, such as those described above, occurs, the locking member 7 can be re-locked. FIGS. 14*a*-14*h* are drawings for describing the re-locking mechanism. More concretely, FIG. 14*a* shows the disengaged locking member 7, and FIG. 14*b* shows the engaged locking member 7. FIGS. 14*c*→14*d*→14*e* shows how the engaged locking member 7 is disengaged by the rotation of the developer supply container 1, which is caused by the operation for setting the developer supply container 1. Further, FIGS. 14*g*→14*f*→14*e* show how the disengaged locking member 7 is re-locked by the rotation of the developer supply container 1, which is attributable to the operation for removing the developer supply container 1.

FIG. 14*a* shows the disengaged locking member 7. The developer supply container 1 is structured so that if it is inserted into the developer receiving apparatus 10 while the locking member 7 is in the state shown in FIG. 14*a*, the locking member 7 is re-engaged.

More concretely, as the developer supply container 1 is inserted into the developer receiving apparatus 10, the guiding portion 7*c*, as a locking member moving force receiving means, of the locking member 7 moves past the groove portion 10*h* of the developer receiving apparatus 10. This guiding portion 7*c* may be called a locking member moving force receiving device, a locking member moving force receiving portion, a guiding device, an interfering portion, a locking member engaging lever, or the like. As the guiding portion 7 *c* moves past the groove portion 10*h*, it comes into contact with a guiding portion 10*j* as a locking member moving force applying means, and therefore, it is pushed up by the inclined portion of the guiding portion 10*j* (FIGS. 14*c*→14*d*→14*e*). As the guiding portion 7*c* is pushed up, the locking member 7 rotates in the direction indicated by an arrow mark A in FIG. 14*b*. As a result, the locking portion 7*b* of the locking member 7 is caught by the catch portion 9*a* of the catching member 9. Incidentally, the guiding portion 10*j* (10*k*) may be referred to as a locking member moving force applying member, a locking member moving force applying device, or the like.

That is, the locking member 7 becomes re-engaged (FIGS. 14*a*→14*b*→14*h*). In other words, the guiding portion 7*c* functions as a switching portion for switching the state of the locking member 7 from the disengaged state to the engaged state.

Figure 14F:
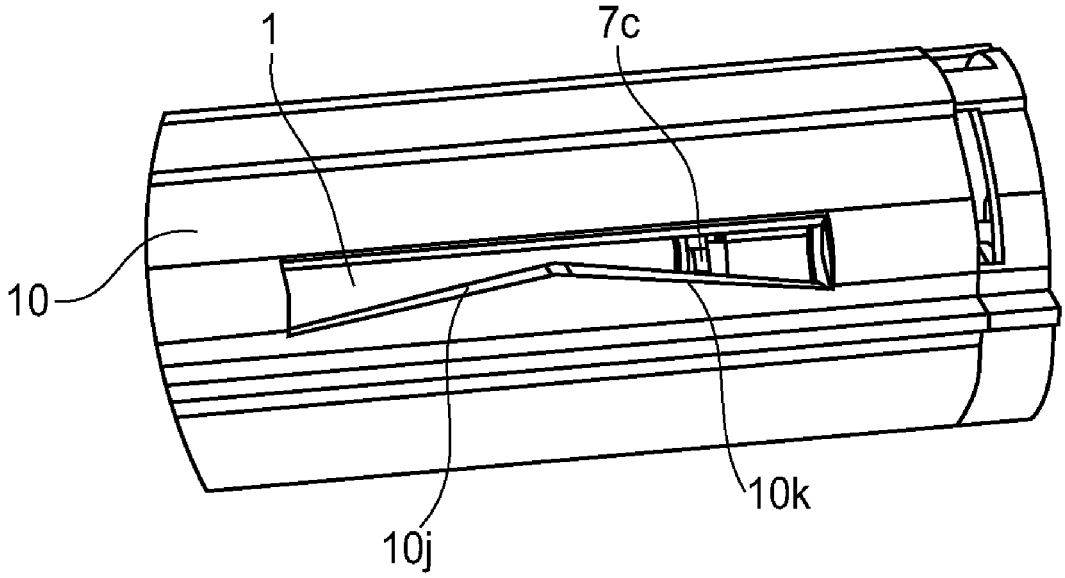
FIG. 14*f* is a schematic drawing for describing the relationship between the guiding member and guiding portion when the locking member is engaging during the extraction of the developer supply container.
Figure 14G:
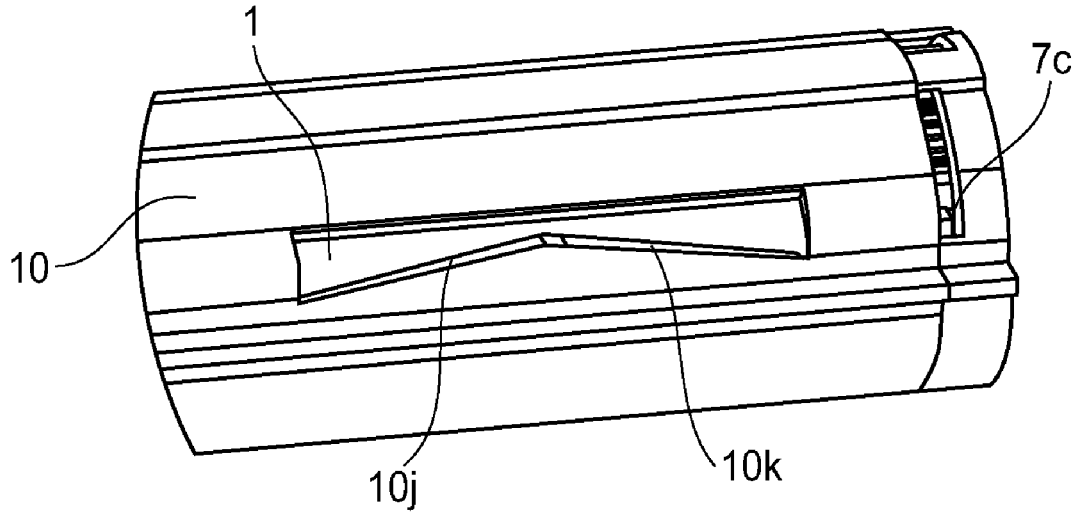
FIG. 14*g* is a schematic drawing for describing the relationship between the guiding member and guiding portion when the locking member is engaging during the extraction of the developer supply container.
Figure 14H:
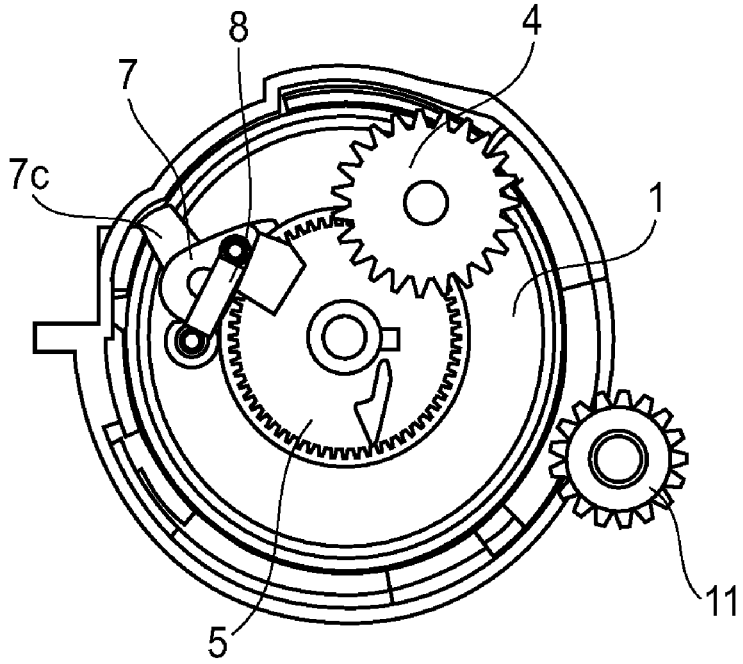
FIG. 14*h* is a plan view of the developer supply container, as seen from the side from which the container is driven, when the locking member is in engagement with first gear.

On the other hand, when a user removes the developer supply container 1 from the developer receiving apparatus 10 in order to replace the developer supply container 1, or for some other reason, the locking member 7 remains disengaged (state shown in FIG. 14*a*). It is while the developer supply container 1 is in this state that the user is to remove the developer supply container 1 by pulling the developer supply container 1 in its removal direction after rotating the handle 2 in the opposite direction from the direction indicated by the arrow mark B in FIG. 10. As the developer supply container 1 is rotated, the guiding portion 7*c* of the locking member 7 comes into contact with the guiding portion 10*k*, as shown in FIG. 14*f*, and is pushed up by the slant of the guiding member 10*k*. As the guiding portion 7*c* is pushed up, the rocking member 7 rotates, being thereby re-engaged (FIGS. 14*g*→14*f*→14*e*). Thus, it is ensured that even when a user happens to temporarily remove the developer supply container 1 from the developer receiving apparatus 10, and then, attempts to insert the same developer supply container 1 again, the locking member 7 is re-engaged before the developer supply container 1 is set.

Figure 8C:
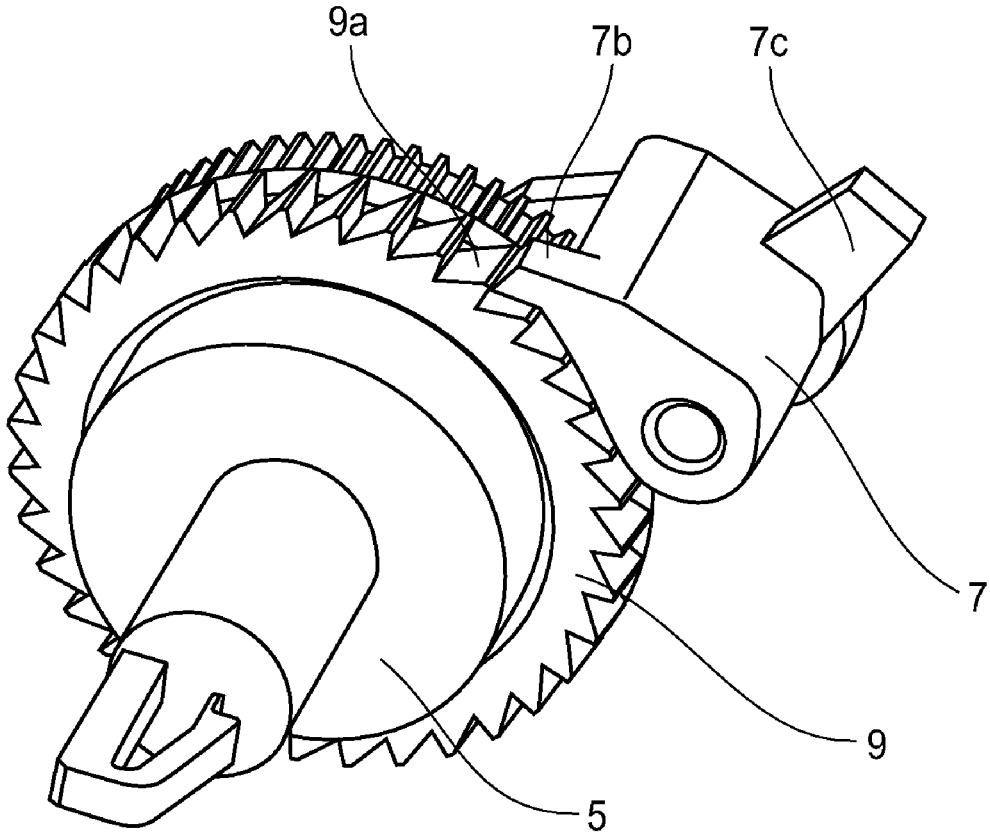
FIG. 8*c* is also a perspective view of the torsional load amount switching mechanism when the torque is small.

Further, referring to FIG. 8*c*, in a case where the locking member 7 is re-engaged by the above described mechanism, it is rare, but, possible that the tip of the locking portion 7*b* of the locking member 7 squarely collides with the tip of the catching portion 9*b* of the catching member 9, preventing thereby the engagement between the locking member 7 and catching member 9.

In the case of this embodiment, however, even if the above described phenomenon occurs, the locking member 7 is under the pressure from the resiliency of the spring 8. Therefore, it is ensured that the locking member 7 is re-engaged. That is, it is after the completion of the operation carried out by a user to set the developer supply container 1 that the first gear 5 is rotated by the driving force from the driving gear 12 of the apparatus main assembly. Therefore, the tip of the locking portion 7*b* is caught by the catch portion 9*a* of the catching member 9, as shown in FIG. 8*a*.

As described above, as long as a developer supply container is structured as is the developer supply container 1 in this embodiment, it is ensured that the locking member 7 is re-engaged without the need for a user to perform a specific operation. Therefore, even if the operation for setting the developer supply container 1 by rotating it is automated, it is ensured that the developing device shutter 11 and container shutter 3 are properly opened, and therefore, the developer receiving apparatus 10 is properly supplied with developer.

Embodiment 2

Next, the second embodiment of the present invention will be described. This embodiment is different from the first embodiment in the structure of driving force transmitting means (driving force transmitting device) of the developer supply container 1. Otherwise, the second embodiment is the same as the first embodiment. Therefore, the portions of the developer supply container 1 and developer receiving apparatus 10 in this embodiment other than the driving force transmitting means will not be described in detail. Further, the members of the developer supply container 1 and developer receiving apparatus 10 in this embodiment, which are the same in function as those in the first embodiment will be given the same referential codes as those given to the counterparts in the first embodiment, respectively.

(Mechanism for Re-Engaging Locking Member)

Figure 15:
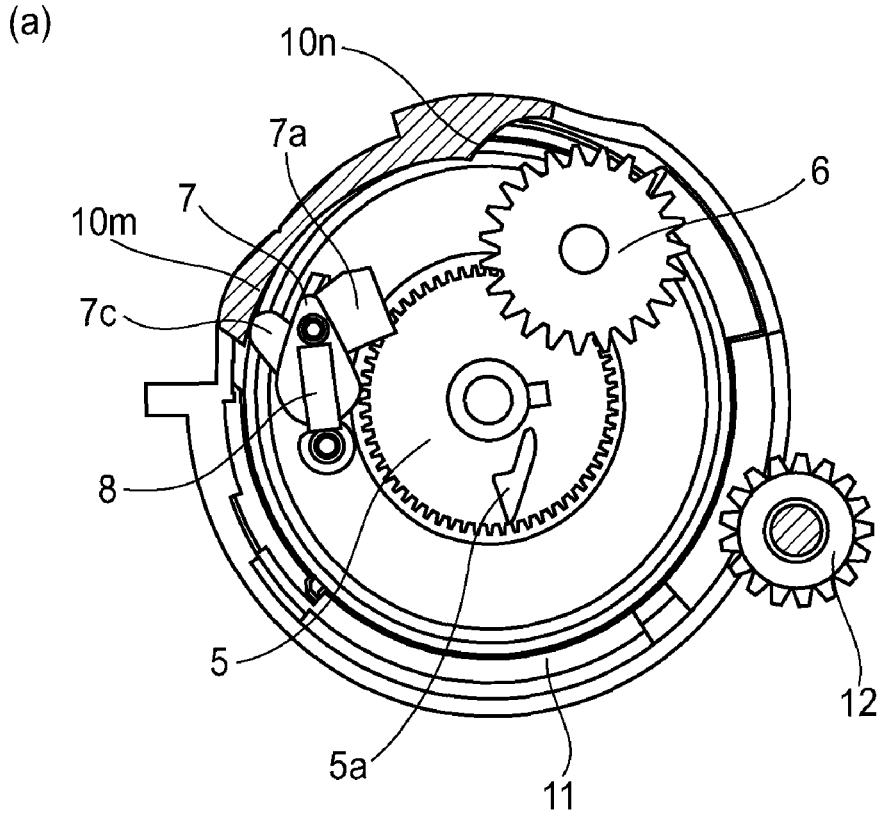
FIG. 15*a* is a plan view of the developer supply container, as seen from the side from which the container is driven, immediately before the re-engagement of the locking member in the second embodiment.
FIG. 15*b* is a plan view of a part of the developer supply container, as seen from the side from which the container is driven, after the re-engagement of the locking member in the second embodiment.
Figure 15:
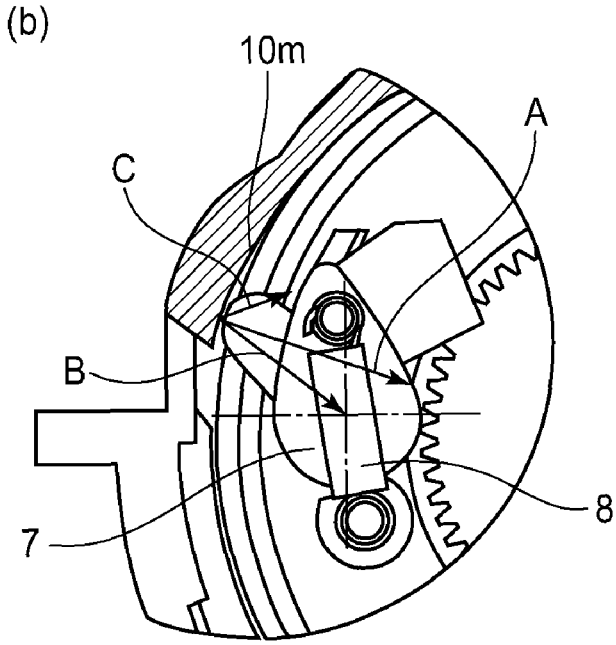

FIG. 15 is a drawing for describing the locking member re-engaging mechanism. In this embodiment, the developer supply container 1 is structured so that the locking member 7 is re-locked by the rotation of the developer supply container 1, more specifically, the operation for rotating the developer supply container 1 to remove it. Hereafter, this mechanism will be concretely described.

As the developer supply container 1 is inserted developer receiving apparatus 10 while the locking member 7 remains disengaged, the state of the developer supply container 1 becomes as shown in FIG. 15*a*. As the developer supply container 1 in this position is rotated in the direction in which it is to be rotated to be set for developer discharge, the guiding portion 7*c* is pushed by the guiding portion 10*m*, as a locking member moving force receiving means (locking member moving force receiving portion, locking member moving force receiving device), in the direction indicated by an arrow mark A in FIG. 15*b*.

Thus, the locking member 7 is rotated by the component C of the force A, that is, the component of the force A, which acts in the direction to rotate the locking member 7, until it moves to the right-hand edge of the range A shown in FIG. 5*e*. As the locking member 7 is moved as described above, it is moved into the operational position, shown in FIG. 8*a*, by the resiliency of the spring 8. As a result, the locking portion 7*b* engages with the catch portion 9 of the catching member 9. That is, the locking member 7 becomes re-locked. In other words, the guiding portion 7*c* functions as a switching portion for switching the state of the locking member 7 from the disengaged state to the engaged state.

For the purpose of making it possible for the rotation of the developer supply container 1 to be used to engage or disengage the locking member 7, it is desired that the guiding portion 7*c* is moved in the radius direction of the container proper 1*a* by the guiding portion 10*m*, which is a slanted portion.

Figure 16:
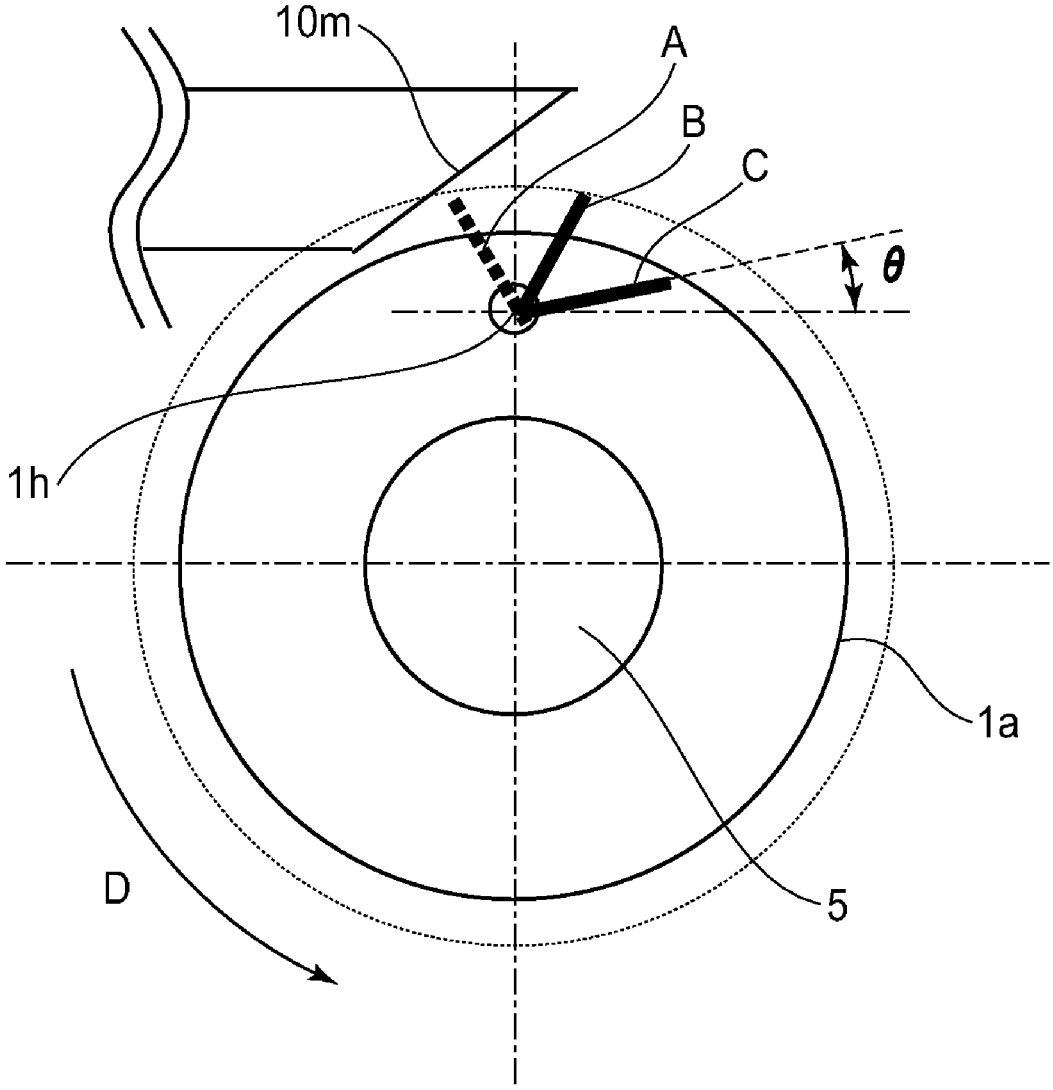
FIG. 16 is a schematic drawing for describing the re-engagement of the locking member in the second embodiment.

FIG. 16 is a schematic drawing showing relationship between the movement of the guiding portion 7*c*, and the guiding portion 10*m*. In the drawing, a position A is the position in which the guiding portion 7*c* is when it is inactive (locking member 7 is in the disengaged state), and a position B is the position in which the guiding portion 7*c* is when is active (locking member 7 is in the engaged state). Further, it is assumed that the guiding portion 7*c* is in the inactive position during a developer supplying operation.

As the container proper 1*a* rotated in the direction indicated by an arrow mark D while remaining in the above described state, the guiding portion 7*c* comes into contact with the guiding portion 10*m*, and then, moves into the position B. However, it does not move in the radius direction of the developer supply container 1. Therefore, the guiding portion 7*c* interferes with the guiding portion 10*m*, preventing thereby the container proper 1*a* from rotating further.

On the contrary, if the inactive and active positions of the guiding portion 7*c* are the positions B and C, respectively, and the guiding portion 7*c* is at the inactive position during the developer supplying operation, the guiding portion 7*c* is moved from the position B to the position C by the rotation of the developer supply container 1 in the direction indicated by an arrow mark D. In this case, the guiding portion 7*c* moves relative to the rotational center of the container proper 1*a*. Therefore, the guiding portion 7*c* moves into the position in which it does not contact the bottom portion of the guiding portion 10*m*. While the guiding portion 7 is in this position, it is possible to rotate the developer supply container 1 to take the developer supply container 1 out. As described above, in order for the locking member 7 to be switched in position between the active position and inactive position, it is desired that the developer supply container 1 is structured so that as the developer supply container 1 is rotated, a part of the edge of the locking member 7 moves away from the rotational center of the container proper 1*a* in the radium direction of the container proper 1*a*. Obviously, this is also true when the locking member 7 is re-engaged when the developer supply container 1 is set.

Figure 17A:
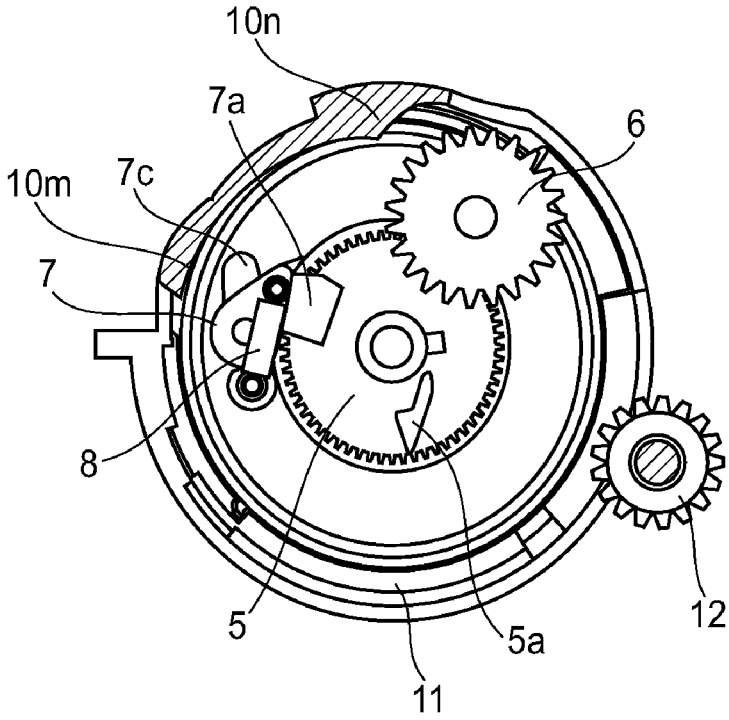
FIG. 17*a* is a plan view of the developer supply container in the second embodiment, as seen from the side from which the container is driven, immediately after the completion of the step for mounting the developer supply container into the developer receiving apparatus.
Figure 17B:
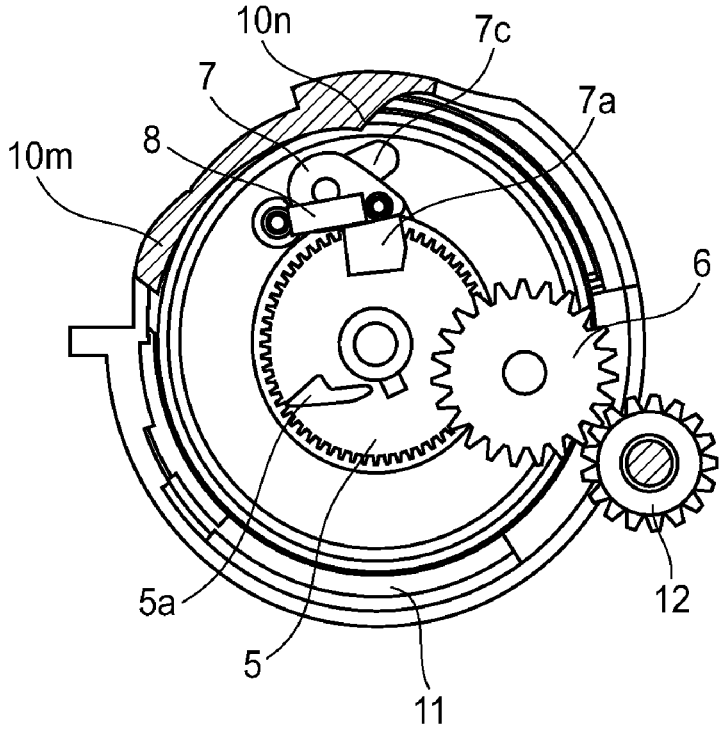
FIG. 17*b* is a plan view of the developer supply container in the second embodiment, as seen from the side from which the container is driven, immediately after the completion of the engagement of the second gear of the developer supply container and the driving gear of the developer receiving apparatus.
Figure 17C:
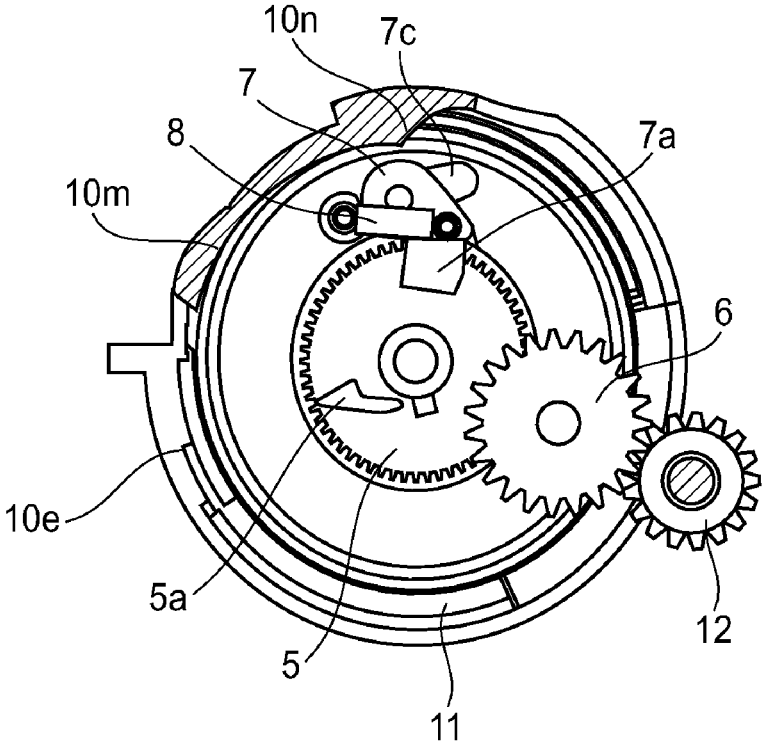
FIG. 17*c* is a plan view of the developer supply container in the second embodiment, as seen from the side from which the container is driven, after the completion of the step for rotating the developer supply container after the completion of the step for mounting the developer supply container.
Figure 17D:
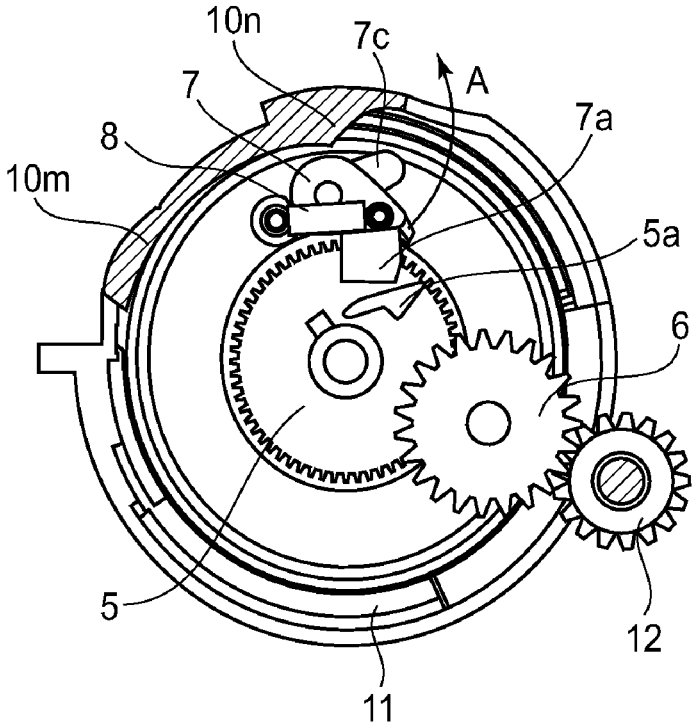
FIG. 17*d* is a plan view of the developer supply container in the second embodiment, as seen from the side from which the container is driven, immediately before the locking member is disengaged after the mounting of the developer supply container.
Figure 17E:
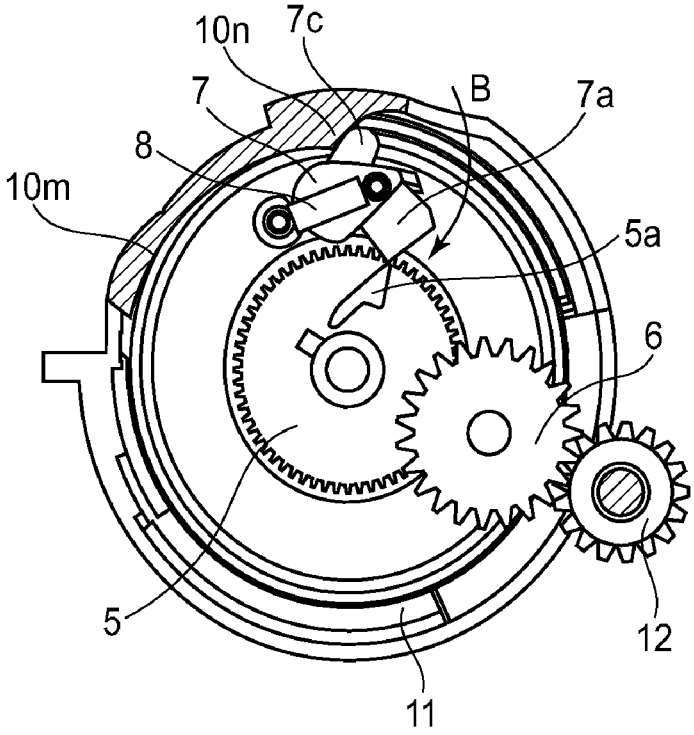
FIG. 17*e* is a plan view of the developer supply container in the second embodiment, as seen from the side from which the container is driven, when the locking member is being disengaged after the mounting of the developer supply container.
Figure 17F:
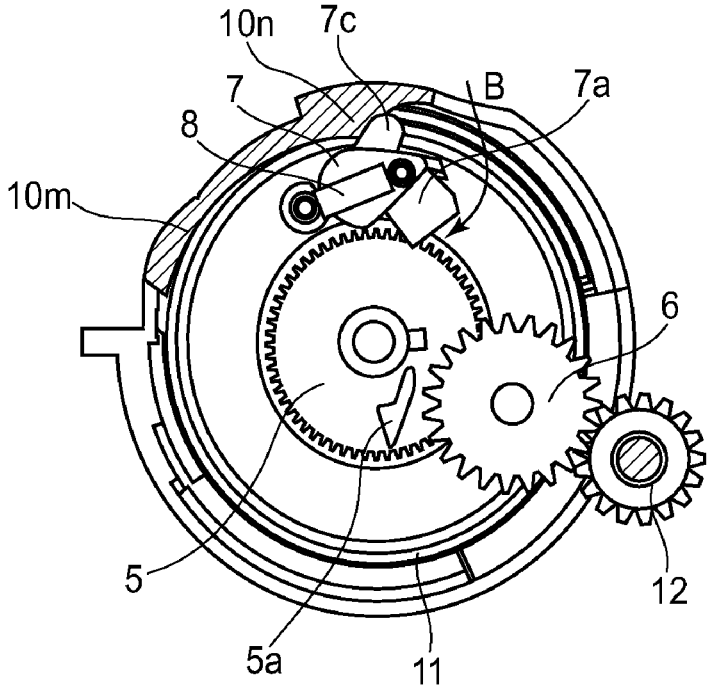
FIG. 17*f* is a plan view of the developer supply container in the second embodiment, as seen from the side from which the container is driven, immediately before the extraction of the container.

Next, referring to FIG. 17, the sequence for re-engaging the locking member 7 by the locking member re-engaging mechanism will be described in detail. FIG. 17*a* shows the state of the developer supply container 1 before the developer supply container 1 is rotated after its insertion, and FIG. 17*b* shows the state of the developer supply container 1, the second gear 6 of which is in mesh with the driving gear 12, being ready to receive driving force from the driving gear 12. FIG. 17*c* shows the state of the developer supply container 1 after the developer supply container 1 was automatically rotated by the driving force from the gear 12, and FIG. 17*d* shows the state of the developer supply container 1, the locking member 7 of which is being disengaged. FIG. 17*e* shows the state of the developer supply container 1 when the locking member disengaging projection is interfering with the locking member 7, and FIG. 17*f* shows the state of the developer supply container 1 when the locking member 7 and locking member disengaging projection are not interfering with each other.

Figure 17G:
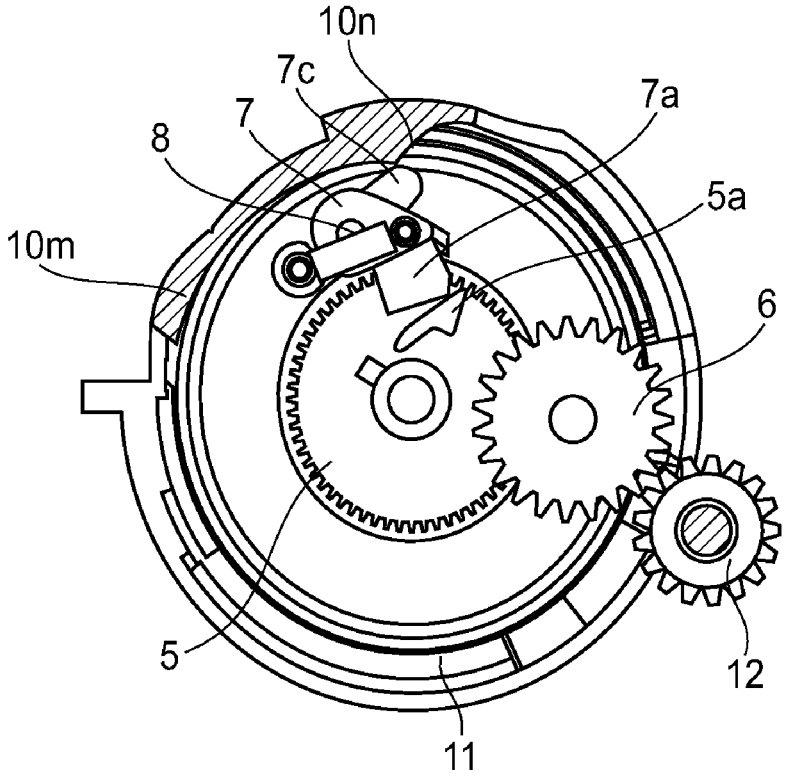
FIG. 17*g* is a plan view of the developer supply container in the second embodiment, as seen from the side from which the container is driven, when the locking member is being re-engaged.
Figure 17H:
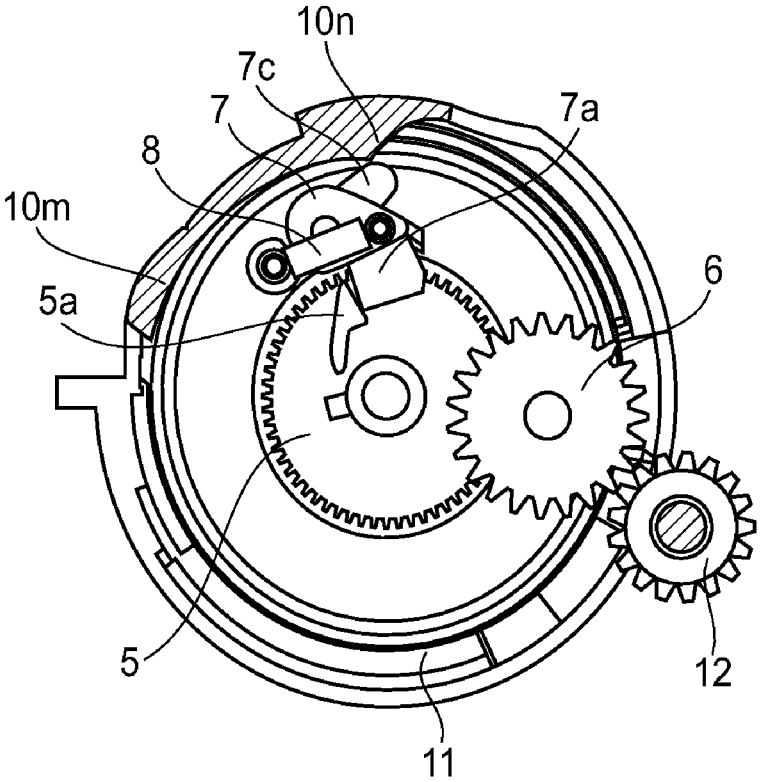
FIG. 17*h* is also a plan view of the developer supply container in the second embodiment, as seen from the side from which the container is driven, when the locking member is being re-engaged.

The FIGS. 17*g* and 17*h* show the state of the developer supply container 1 after the re-engagement of the locking member 7.

(Operation for Re-Locking Developer Supply Container)

Next, the operation for re-locking the developer supply container 1 when the developer supply container 1 is taken out to be replaced, or for some other reason, will be described.

(1) First, a user is to open the cover 15 for replacing a developer supply container 1.

(2) Then, the user is to rotate the developer supply container 1 from its operational position to its initial position in the developer receiving apparatus by rotating the handle 2 in the opposite direction from the direction indicated by the arrow mark B in FIG. 10*b*. That is, the developer supply container 1 returns to the initial position, appearing as shown in FIG. 17*a*. As long as the locking member disengagement projection 5*a* is not in contact with the disengagement force catching portion 7*a* as shown in FIG. 17*f*, the guiding portion 7*c* and guiding portion 10*n* interfere with each other as the developer supply container 1 is rotated, causing the locking member 7 to begin to rotate in the direction indicated by an arrow mark B in FIG. 17*f*.

After the locking member 7 rotates to the right edge of the area A in FIG. 5*e*, it is further rotated by the resiliency of the spring 8 into the position shown in FIG. 17*c*.

Further, when the positional relationship between the disengagement projection 5*a* and disengagement force catching portion 7*a* is such that they interfere with each other as shown in FIG. 17*e*, the guiding portion 7*c* of the locking member 7 is pushed by the guiding portion 10*n* in the direction B as the developer supply container 1 is rotated. Thereafter, the positional relationship between the disengagement projection 5*a* and disengagement force catching portion 7*a* is turned into the one shown in FIG. 17*g* or the one shown in FIG. 17*h*, by the profile of the disengagement projection 5*a* and that of the disengagement force catching portion 7*a*, as the first gear 5 is rotated. Therefore, the relationship remains the same until the developer supply container 1 is rotated back into its initial position in the developer receiving apparatus 10.

Further, the engagement between the second gear 6 and driving gear 12 is dissolved by the rotation of the developer supply container 1. Thus, by the time the developer supply container 1 is rotated back into its initial position, the second gear 6 and driving gear 12 stop interfering with each other.

(3) Lastly, the user is to take the developer supply container 1, which is in the initial position, from the developer receiving apparatus 10, and set a new developer supply container in the developer receiving apparatus 10. The operational steps hereafter are similar to those in the "operation for setting developer supply container" in the first embodiment.

As described above, even in the case where the user sets the same developer supply container 1, the above described re-locking mechanism ensures that the developer supply container 1 is automatically rotated and properly set.

Figure 18:
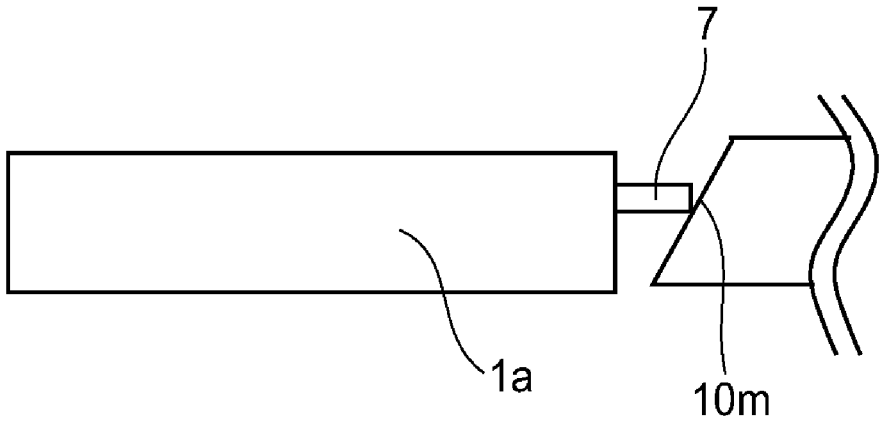
FIG. 18*a* is a schematic drawing of a modified version of the locking member.
FIG. 18*b* is also a schematic drawing of the modified version of the locking member.
Figure 18:
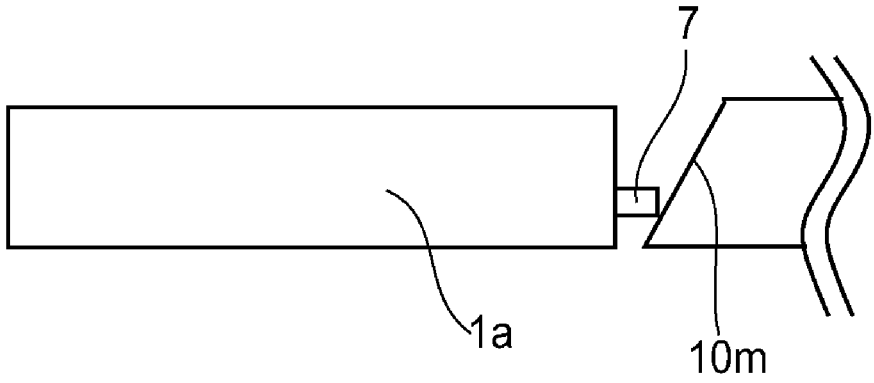

Incidentally, in this embodiment, the developer supply container 1 is structured so that in order for the developer supply container 1 to be locked, the locking portion 7*b* is to move relative to the rotational center of the container proper 1*a* in the radius direction of the container proper 1*a*. Thus, in order to lock the developer supply container 1, the guiding portion 7*c* has to move in the radius direction of the container proper 1*a* as the developer supply container 1 is rotated. However, the developer supply container 1 may be structured so that the locking member 7 moves in the thrust direction of the container proper 1*a*, as shown in FIGS. 18*a* and 18*b* to lock the developer supply container 1 as the developer supply container 1 is rotated (FIG. 18*a*: before rotation R FIG. 18*b*: after rotation). That is, the developer receiving apparatus 10 is provided with a surface slanted in a manner to cause the locking member 7 to move in the thrust direction of the developer supply container 1, and the developer supply container 1 is locked by placing the guiding portion 7*c* in contact with the slanted surface.

In the case of a structural arrangement such as this arrangement, all that is necessary to switch the position of the locking member 7 between the engaged position and disengaged position by utilizing the rotational movement of the container proper 1*a* is to shape a part of the guiding portion 7*c* in such a manner that as the developer supply container 1 is rotated, the locking member 7 is moved in the direction parallel to the rotational center of the container proper 1*a*.

Figure 20:
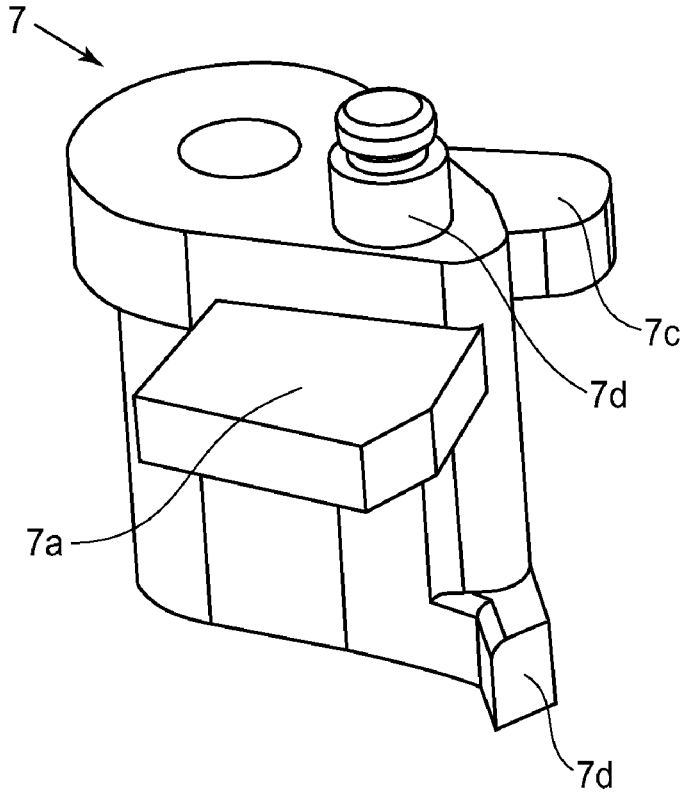
FIG. 20 is a perspective view of the locking member in the second embodiment.

Incidentally, the guiding portion 7*c* described above can move the locking member 7 by coming into contact with the guiding portions 10*m* and 10*n*, whether it is square at the corners or not. However, from the standpoint of smoothly moving the locking member 7, it is desired to be round at the corners (FIG. 20).

Further, regarding the shape of the guiding portions 10*m* and 10*n*, how the guiding portion 7*c* moves within the above described rotational range can be controlled by the shape of the guiding portions 10*m* and 10*n*.

Figure 19:
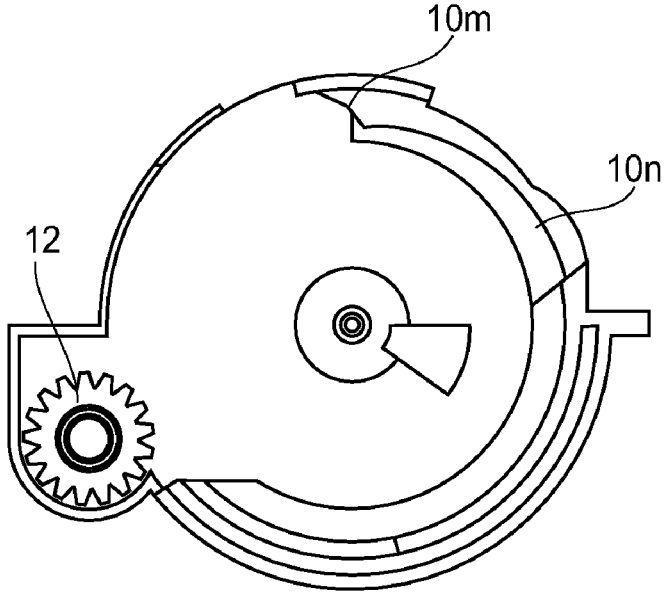
FIG. 19 is a schematic drawing of the guiding member in the second embodiment.

For example, because of the structure of the locking member 7, it is more difficult to move the rotation controlling means from the inactive position to active position by utilizing the rotation of the developer supply container 1 toward the developer discharging position than to move the rotation controlling means by utilizing the rotation of the developer supply container in the direction to take it out. Thus, the guiding portion 10*m* is made smaller than the guiding portion 10*n*, in terms of the ratio of the displacement of the guide portion 7*c* in the radius direction of the container proper 1*a*, relative to a preset angle by which the developer supply container 1 is rotated (FIG. 19).

Embodiment 3

Next, the third embodiment of the present invention will be described. This embodiment is different from the first embodiment only in the structure of the driving force transmitting means (driving force transmitting device) of the developer supply container 1. That is, the other components of the developer supply container 1 in this embodiment are the same in structure as those of the developer supply container 1 in the above described first embodiment, and therefore, will not be described in detail. The members of the developer supply container 1 and developer receiving apparatus 10 in this embodiment, which are the same in function as those in the first embodiment, will be given the same referential codes as those given to the counterparts in the first embodiment, respectively. Further, this embodiment employs the same locking mechanism as that used in the first embodiment. However, the locking mechanism used in the second embodiment may be employed in place of that in the first embodiment.

Figure 21:
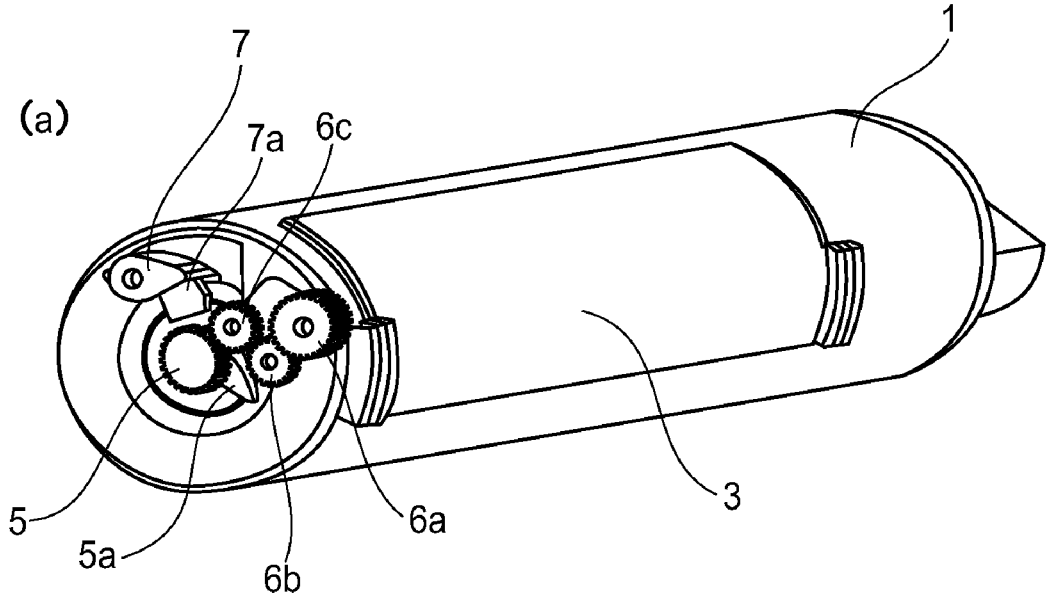
FIG. 21 is a rough drawing of the developer supply container in the third embodiment.
Figure 21:
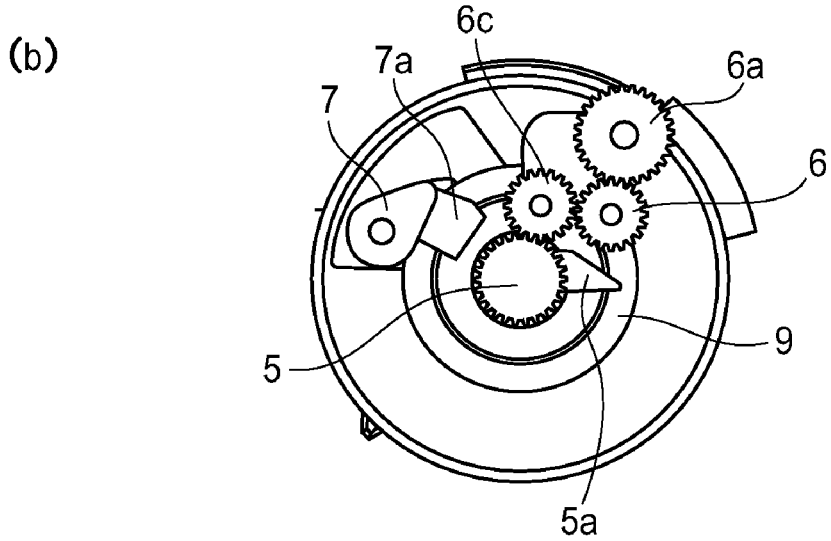

Referring to FIGS. 21*a* and 21*b*, the developer supply container 1 is structured so that driving force is transmitted to the conveying member 4 with the use of four gears 5, 6*a*, 6*b*, and 6*c*.

The number of the gears for transmitting driving force to the first gear 5 is an odd number. Further, the direction in which the gear 6*a*, which is in engagement with the driving gear 12, is rotated is the same as the direction in which the developer supply container 1 is automatically rotated.

Also in this embodiment, driving force is inputted into the driving gear 12, as in the first embodiment, even though the developer supply container 1 is structured as described above. As the driving force is inputted, the container proper 1*a*, is automatically rotated by the driving force through the gear 6*a* which is in engagement with the driving gear 12.

In the case of the developer supply container 1 structured to use multiple gears to transmit the driving force to the first gear 5, the cost of these gears significantly contributes to the cost increase. Therefore, the gears 6*a*, 6*b*, and 6*c* are desired to be identical.

From the viewpoint of cost reduction, the developer supply container structure in the first embodiment is preferable.

Embodiment 4

Next, the fourth embodiment will be described. This embodiment is different from the first embodiment only in the structure of the driving force transmitting means (driving force transmitting device) of the developer supply container 1. That is, the other structural features of the developer supply container 1 in this embodiment are the same as those of the developer supply container 1 in the above described first embodiment, and therefore, will not be described in detail. The members of the developer supply container 1 and developer receiving apparatus 10 in this embodiment, which are the same in function as the counterparts in the first embodiment, will be given the same referential codes as those given to the counterparts in the first embodiment, respectively. Further, this embodiment employs the same locking mechanism as that used in the first embodiment. However, the locking mechanism used in the second embodiment may be employed in place of that in the first embodiment.

Figure 22:
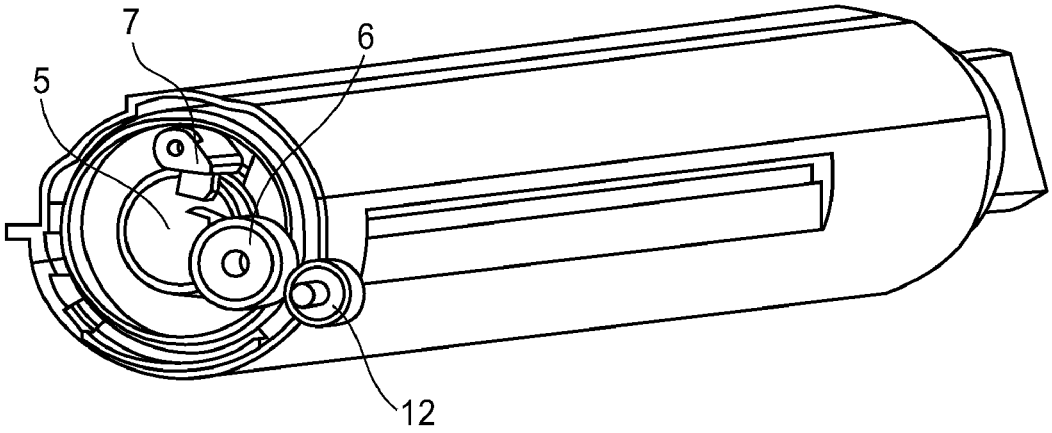
FIG. 22 is a rough drawing of the developer supply container in the fourth embodiment.

Referring to FIG. 22, in this embodiment, the driving force transmitting means is made up of a first wheel 5, a second wheel 6, and a third wheel, which are made up of such a material that makes their peripheral surfaces high in frictional resistance. The third wheel is coaxial with the second wheel 6. The driving wheel 12 of the developer receiving apparatus is also formed of a frictional substance.

Even in the case of the combination of the developer supply container 1 and developer receiving apparatus 10 structured as described and made of the above described substance, the developer supply container 1 can be automatically rotated as it is in the first embodiment.

Incidentally, from the standpoint of properly transmitting driving force, the use of the driving force transmitting means, such as the one in the first embodiment, which is made up of gears (wheels with teeth), is preferable to the driving force transmitting means in this embodiment.

Embodiment 5

Figure 23:
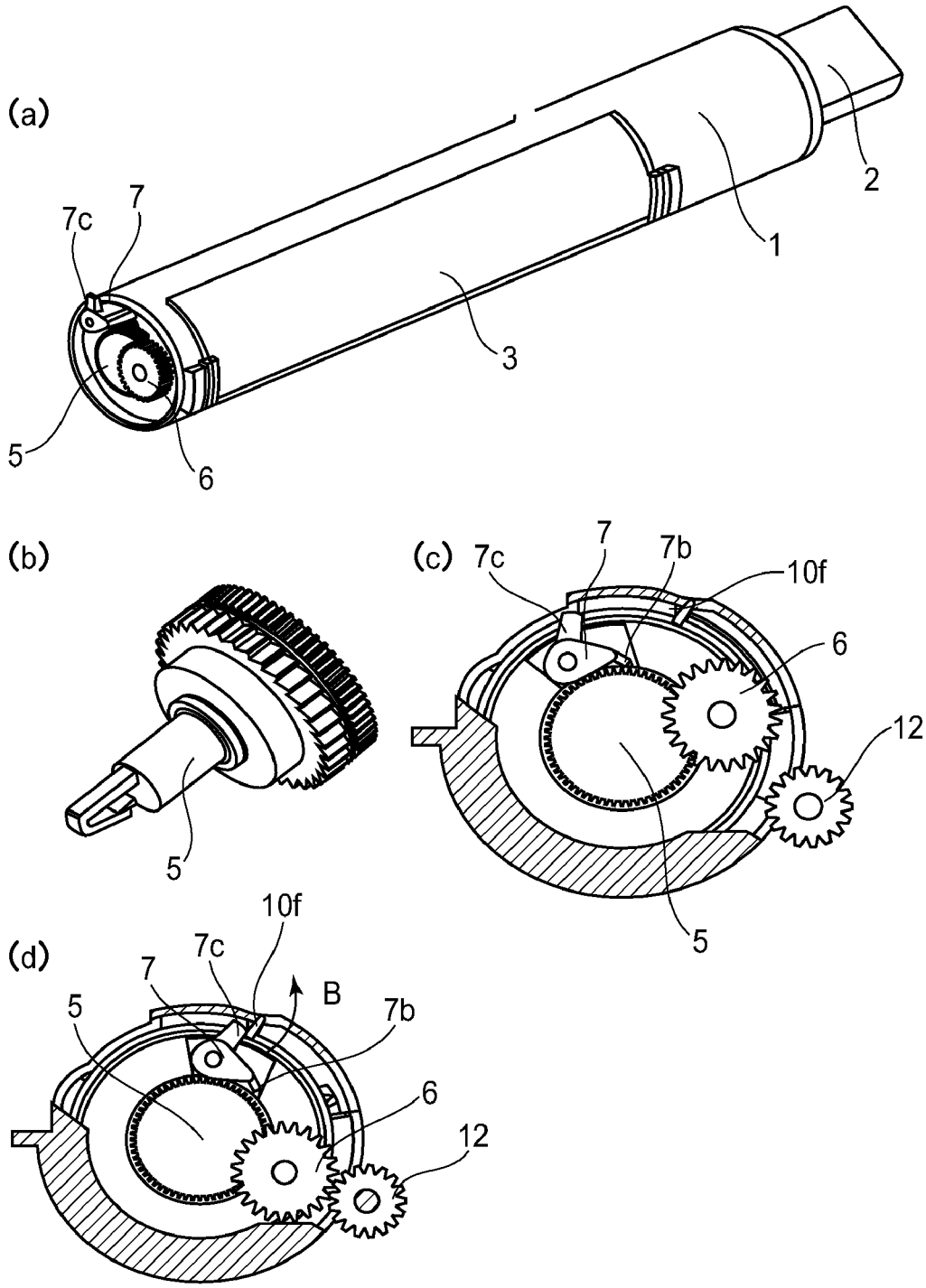
FIG. 23 is a rough drawing of the developer supply container in the fifth embodiment.

Next, referring to FIGS. 23*a*-23*d*, the developer supply container 1 in the fifth embodiment of the present invention will be described. FIG. 23*a* is a perspective view of the entirety of the container 1, and FIG. 23*b* is a schematic drawing of the locking member. FIG. 23*c* shows the lengthwise end of the developer supply container 1 before the rotation of the developer supply container 1, as seen from the side from which the developer supply container 1 is driven, and FIG. 23*d* shows the lengthwise end of the developer supply container 1 after the rotation of the developer supply container 1. The developer supply container 1 in this embodiment is also the same in basic structure as the one in the first embodiment. Therefore, the basic structure of the developer supply container 1 in this embodiment will not be described. In other words, only the structural features of the developer supply container 1 in this embodiment, which are different from those of the developer supply container 1 in the first embodiment, will be described. Further, the members of the developer supply container 1 and developer receiving apparatus 10 in this embodiment, which are identical to those in the first embodiment, will be given the same referential codes as those given to the counterparts in the first embodiment, respectively.

This embodiment is different from the first embodiment in that in this embodiment in that the rotation of the first gear 5 is locked to the container proper 1*a* in such a manner that it does not rotate at all relative to the container 1*a*. That is, the second gear also is prevented through the first gear from rotating at all relative to the container proper 1*a*.

More concretely, referring to FIGS. 23*a* and 23*b*, the first gear 5 is formed as an integral part of the catching member 9, and there is no ring 14. Further, the disengagement projection 10*f* for disengaging the locking member 7 belongs to the developer receiving apparatus 10.

In this embodiment, as the second gear 6 receives driving force from the driving gear 12 of the developer receiving apparatus 10, force is generated in the direction to pull the container proper 1*a* inward, because the locking member 7 prevents the second gear 6 from rotating relative to the container proper 1*a*, through the first gear 5.

Therefore, the container proper 1*a* automatically rotates as does the container proper 1*a* in the first embodiment. Therefore, the disengagement force catching portion 7*b* of the locking member 7 comes into contact with the disengagement force applying projection 10*f*, and is pushed up by the disengagement projection 10*f* in the direction indicated by an arrow mark B. As a result, the first gear 5 is unlocked.

Also in this embodiment, the first gear 5 and catching member 9 are formed as an integral part of each other, so that the locking portion 7*b* of the locking member 7 is caught by the catching member 9. In principle, as long as the gear train is locked, it does not matter at which point of the gear trains the gear train is locked. That is, the gear train may be locked by locking the first gear 5 or second gear 6.

In the first embodiment, as described above, the portion of the developer supply container 1, through which the driving force is applied to the developer supply container 1 in the direction to rotate the developer supply container 1, is the shaft by which the gear 6 is supported. Thus, the greater the distance of the shaft from the rotational center of the developer supply container 1, the more easily the developer supply container 1 can be rotated, and therefore, it is possible to reduce the amount of load which the second gear 6 is required to withstand. In a case where the rotation of the first gear 5 relative to the developer supply container 1 is controlled as in this embodiment, the greater the distance between the member for freeing the first gear 5 from the control, the smaller the load to which the member for disengaging the first gear 5 from the controlling member, and therefore, the less the physical strength required of the disengaging member.

In this embodiment, members, such as the ring 4 used in the first embodiment, are not required. Thus, this embodiment makes it possible to reduce the cost of the developer supply container 1.

However, because of variation in the various components of the developer supply container 1 and developer receiving apparatus 10, and also, in their positioning, there is a possibility that the timing with which the developer discharge hole 1*b* becomes completely connected with the developer reception hole 10*b* will deviate from the timing with which the first gear 5 is unlocked. Thus, the structural arrangement in the first embodiment, which is free from this kind of problem, is preferable.

Embodiment 6

Figure 24:
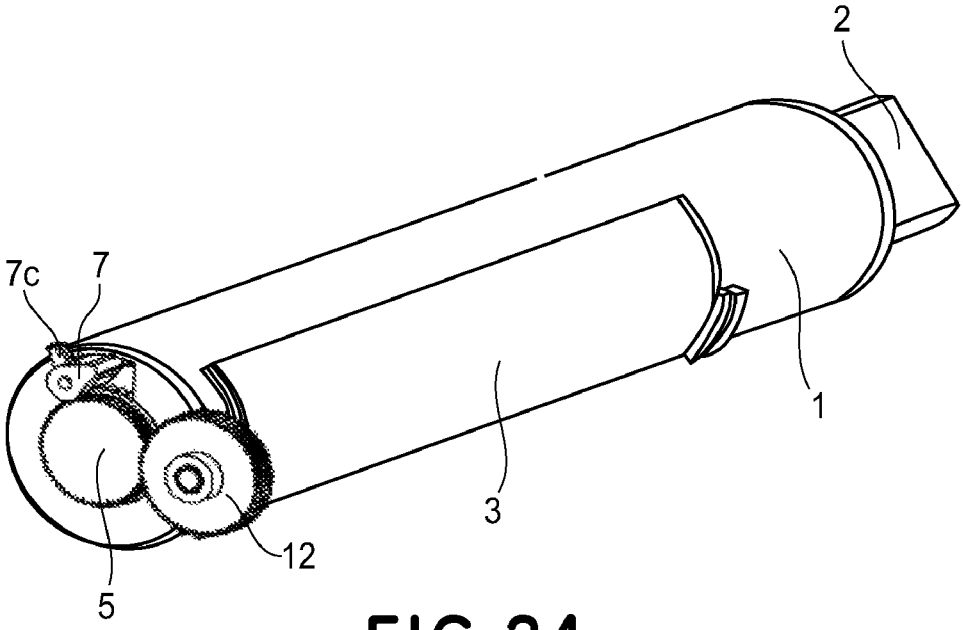
FIG. 24 is a rough drawing of the developer supply container in the sixth embodiment.

Next, referring to FIG. 24, the developer supply container 1 in the sixth embodiment of the present invention will be described. The developer supply container 1 in this embodiment also is the same in basic structure as the one in the first embodiment. Therefore, the portions of the developer supply container 1 in this embodiment, which will be the same description as the counterpart in the first embodiment, will not be described. That is, only the portions of the developer supply container 1 in this embodiment, which are different in structure from the counterparts in the first embodiment, will be described. Further, the members of the developer supply container 1 and developer receiving apparatus 10 in this embodiment, which are the same in function as the counterparts in the first embodiment, will be given the same referential codes as those given to the counterparts in the first embodiment, respectively. Further, this embodiment will be described with reference to a case in which the re-locking mechanism in the first embodiment is employed. However, the following description of this embodiment holds even if the re-locking mechanism in the second embodiment is used.

In this embodiment, only the first gear 5 is provided as the driving force transmitting means (driving force transmitting device); the second and third gears are not provided. Further, the first gear is an integral part of the above described catching member 9; there is no ring 14. The first gear 5 is locked by the locking member 7 so that it cannot rotate relative to the container proper 1*a*.

In this embodiment, the first gear 5 engages with the driving gear 12 at the end of the operation for mounting the developer supply container 1 into the developer receiving apparatus 10. As driving force is inputted into the driving gear 12, which is in engagement with the first gear 5, the developer supply container 1 rotates, because the first gear 5 is prevented by the locking member 7, as a controlling means, from rotating relative to the container proper 1*a*.

Therefore, the container proper 1*a* in this embodiment also is automatically rotated as is the container proper 1*a* of the developer supply container 1 in the first embodiment. As the developer supply container 1 rotates, the disengagement force catching portion 7*b* of the locking member 7 comes into contact with the disengagement projection 10*a* of the developer receiving apparatus 10, at roughly the same time as the developer discharge hole 1*b* and the developer reception hole 10*b* perfectly align with each other. Thus, as the developer supply container 1 rotates further, the locking member 7 is pushed up, disengaging thereby the first gear 5 from the locking member 7.

Further, in this embodiment, while the locking member 7 is in engagement with the first gear 5, the first gear 5 is not allowed to rotate relative to the developer supply container 1 at all. However, the developer supply container 1 may be structured in the following manner. That is, the first gear 5 may be prevented from rotating relative to the developer supply container 1, by providing the first gear 5 with torsional load. For example, an elastic member, such as the ring 14 in the first embodiment, may be placed between the first gear 5 and developer supply container 1. That is, the developer supply container 1 may be structured so that the first gear 5 is kept under the load which is large enough for the developer supply container 1 to be automatically rotated to be set, but, is not large enough to prevent the first gear 5 from rotating relative to the developer supply container 1. In this case, the structure of the unlocking means is the same as that in the first embodiment.

As described above, this embodiment is different from the first embodiment in that in this embodiment, the operation for rotating the developer supply container 1 after the mounting of the developer supply container 1 can be automated in its entirety. Therefore, this embodiment can further improve the developer supply container 1 in usability compared to the first embodiment. Further, this embodiment does not require a member, such as the ring 14 in the first embodiment, making it possible to further reduce the cost of the developer supply container 1.

However, because of the variation in the measurements and positioning of various components of the developer supply container 1 and developer receiving apparatus 10, there is a possibility that the timing with which the developer discharge hole 1*b* becomes completely connected with the developer reception hole 10*b* will deviate from the timing with which the first gear 5 is unlocked. Further, the insertion of the developer supply container 1 into the developer receiving apparatus 10 causes the first gear 5 to come into contact with the driving gear 12 from the direction parallel to their axial lines. Therefore, it is possible that the teeth of the first gear 5 will collide with the teeth of the driving gear 12, making it rather difficult to insert the developer supply container 1 all the way into the developer receiving apparatus 10. Thus, the first embodiment is more desirable in that it is free from the ill effects which this embodiment might suffer.

Embodiment 7

Figure 25:
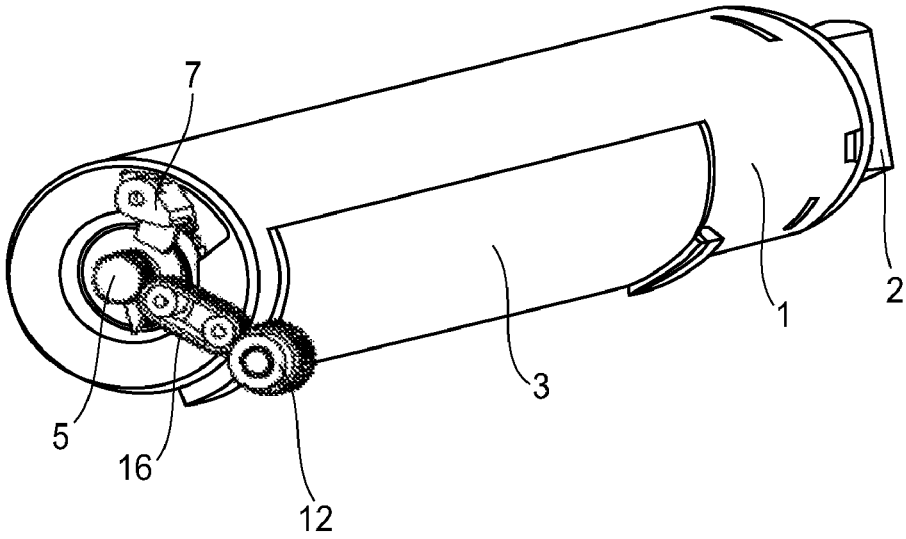
FIG. 25 is a rough drawing of the developer supply container in the seventh embodiment.

Next, referring to FIG. 25, the developer supply container 1 in the seventh embodiment of the present invention will be described. The developer supply container 1 in this embodiment also is the same in basic structure as the one in the first embodiment. Therefore, the portions of the developer supply container 1 in this embodiment, which will be the same in description as the counterpart in the first embodiment, will not be described. That is, only the portions of the developer supply container 1 in this embodiment, which are different in structure from the counterparts in the first embodiment, will be described. Further, the members of the developer supply container 1 and developer receiving apparatus 10 in this embodiment, which are the same in function as the counterparts in the first embodiment, will be given the same referential codes as those given to the counterparts in the first embodiment, respectively. Further, in this embodiment, the same re-locking mechanism as that used in the first embodiment is used. However, even if the same re-locking mechanism as that used in the second embodiment is used, the description of this embodiment will be the same as that which will be given next.

In this embodiment, the driving force transmitting means (driving force transmitting device) is made up of the first gear 5, driving force transmitting belt 16, and two pulleys by which the belt 16 is supported and stretched. Also in this embodiment, the first gear 5 and catching member 9 are integral with each other, as shown in FIG. 25, and there is no ring 14. The first gear 5 is kept locked to the container proper 1*a* by the locking member 7 so that it does not rotate relative to the container proper 1*a* at all.

Further, in this embodiment, in order to prevent the driving force transmitting belt 16 from rotationally moving relative to the pulleys, the inwardly facing surface of the driving force transmitting belt 16, and the outwardly facing surface of each pulley, have been treated to make them highly frictional. Incidentally, in order to make it even more difficult for the driving force transmitting belt 16 slips relative to the pulleys, the inwardly facing surface of the driving force transmitting belt 16, and the outwardly facing surface of each pulley, may be provided with teeth so that the teeth of the belt 16 mesh with those of the pulleys.

In this embodiment, as the developer supply container 1 is rotated by a certain angle by a user after it was mounted into the developer receiving apparatus 10, the teeth of the driving force transmitting belt 16 engage with the driving gear 12 of the developer receiving apparatus 10. Then, as driving force is inputted into the driving gear 12 after the closing of the developer supply container replacement cover by the use, the inputted driving force turns into a force which acts in the direction to rotate the developer supply container 1, because the first gear 5 is locked to the container proper 1*a* by the locking member as a controlling means, being therefore prevented from rotating relative to the container proper 1*a*.

Therefore, the container proper 1*a* automatically rotates as does the container proper 1*a* in the first embodiment. As a result, at about the same time as the developer discharge hole 1*b* completely aligns with the developer reception hole 10*b*, the disengagement force catching portion 7*b* of the locking member 7 collides with the locking member disengagement projection 10*a* of the developer receiving apparatus 10, and pushes upward the locking member 7 in the direction indicated by an arrow mark B, freeing the first gear 5 from the locking member 7.

This embodiment is more advantageous than the first embodiment in that it affords more latitude in the designing (positioning) of the driving force transmitting means.

However, in the case of this embodiment, there is a possibility that because of the variance in the measurements of the various components and the positioning of the components, the timing with which the developer discharge hole 1*b* becomes completely connected with the developer reception hole 10*b* will deviate from the timing with which the first gear 5 is unlocked. Therefore, the first embodiment is more desirable in that it is free from the ill effects which this embodiment might suffer.

Further, in this embodiment, the developer supply container 1 is structured so that the first gear 5 is solidly locked to the container proper 1*a*. However, the developer supply container 1 may be structured so that the first gear 5 is kept under the torsional load as in the first embodiment. In such a case, the locking member 7 is disengaged by the disengagement projection which rotates with the first gear 5 relative to the container proper 1*a*, making it possible to fully connect the developer discharge hole 1*b* with the developer reception hole 10*b* with a proper timing.

Embodiment 8

Next, referring to FIGS. 26 and 27, the developer supply container 1 in the eighth embodiment of the present invention will be described. The developer supply container 1 in this embodiment also is the same in basic structure as the developer supply container 1 in the first embodiment. Therefore, the portions of the developer supply container 1 in this embodiment, which are the same in description as the counterpart in the first embodiment, will not be described. That is, only the portions of the developer supply container 1 in this embodiment, which are different in structure from the counterparts in the first embodiment, will be described. Further, the members of the developer supply container 1 and developer receiving apparatus 10 in this embodiment, which are the same in function as the counterparts in the first embodiment, will be given the same referential codes as those given to the counterparts in the first embodiment, respectively. Further, this embodiment will be described with reference to a developer supply container 1 employing the same re-locking mechanism as that used in the first embodiment. However, even if this embodiment is described with reference to a developer supply container 1 employing the same re-locking mechanism as that used in the second embodiment is used, the description of this embodiment will be the same as that which will be given next.

Figure 26:
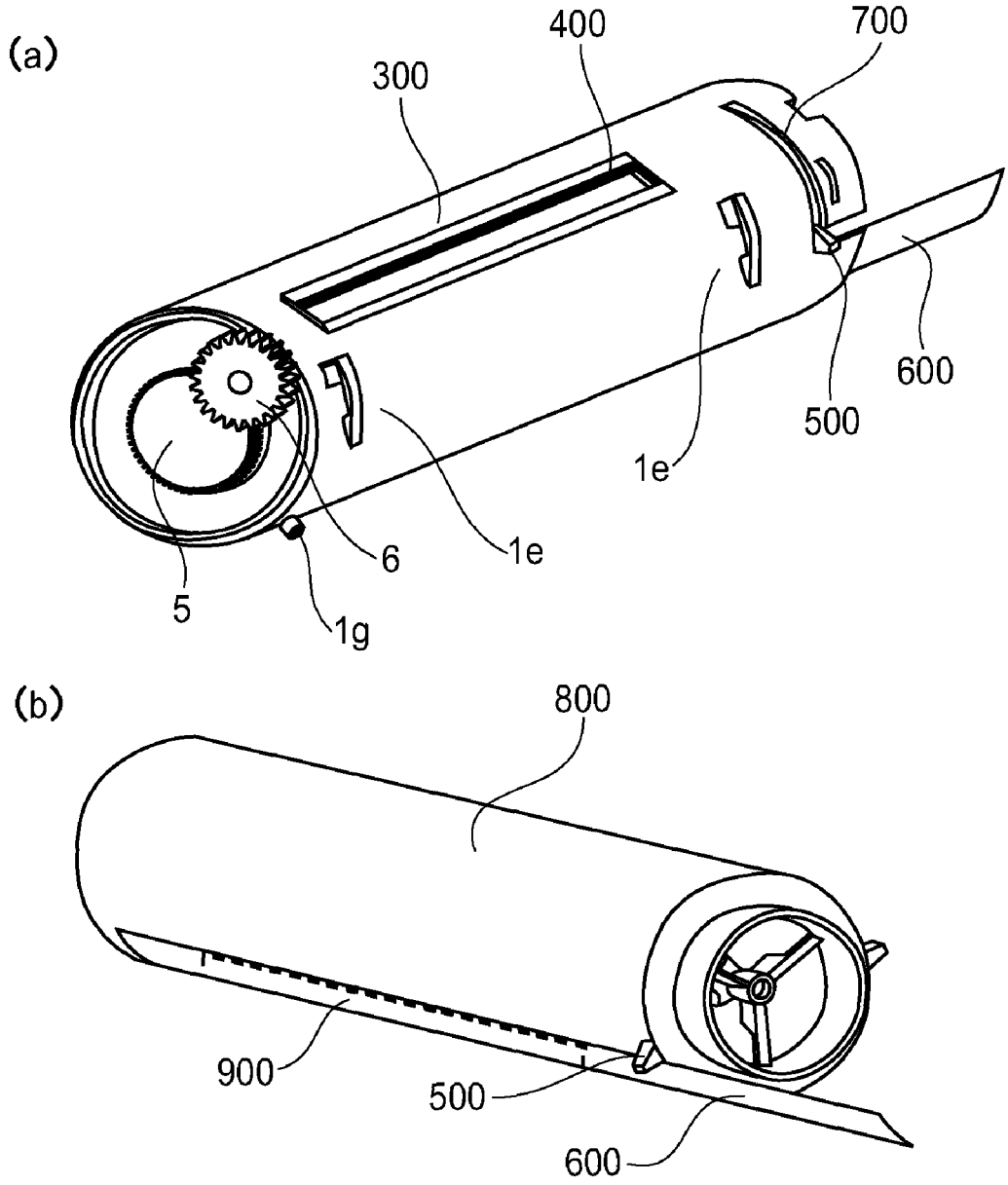
FIG. 26 is a rough drawing of the developer supply container in the eighth embodiment.
Figure 27:
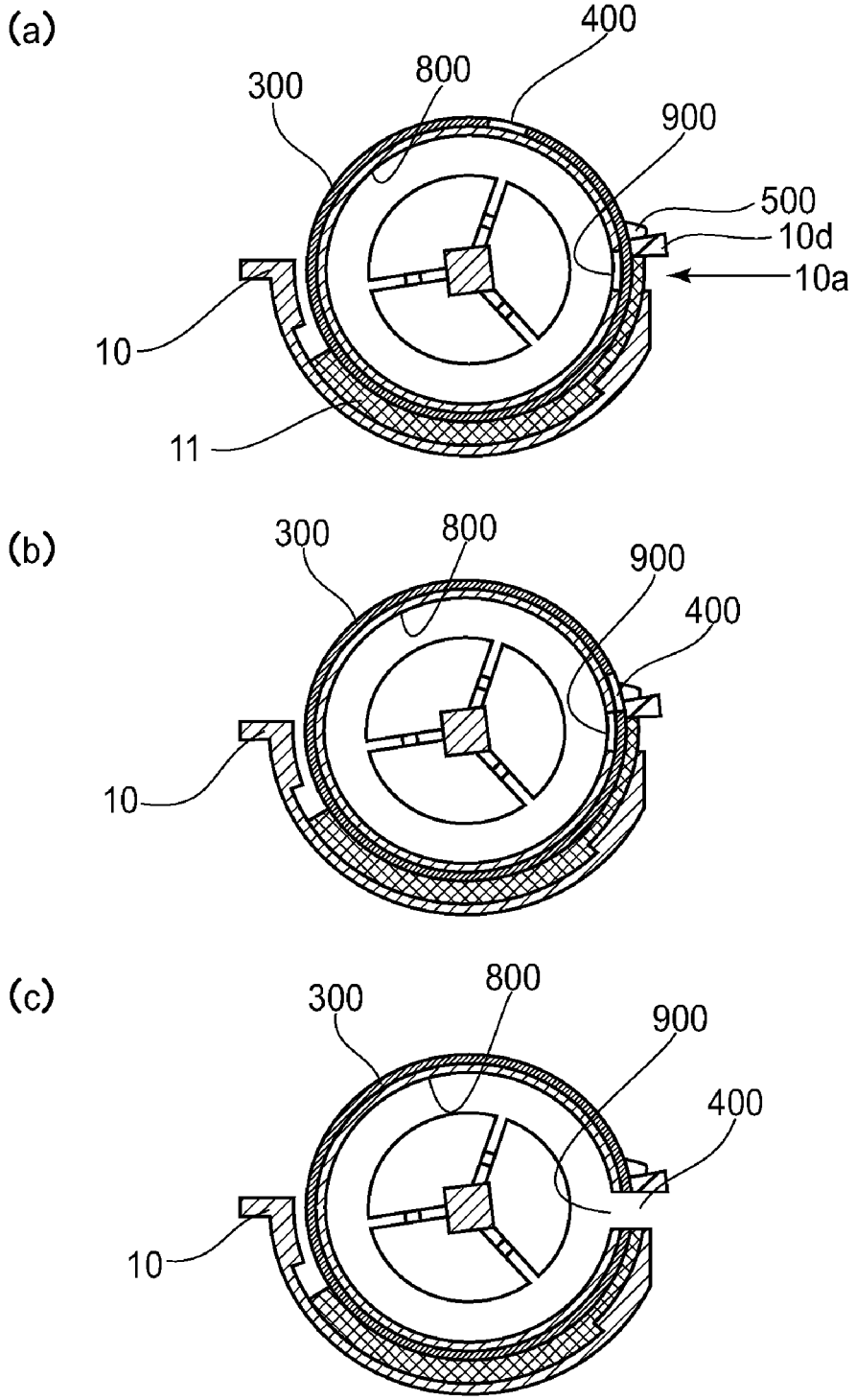
FIG. 27 is a drawing for describing the operation for setting the developer supply container in the eighth embodiment, for developer discharge.

FIG. 26 is a schematic perspective view of the developer supply container 1 in this embodiment. FIGS. 27*a*, 27*b* and 27*c* are drawings which sequentially shows the operational steps for setting the developer supply container 1 in this embodiment. That is, FIG. 27*a* shows the developer supply container 1 at the end of the insertion of the developer supply container 1, and FIG. 27*b* shows the developer supply container 1 right after its engagement with the gear 12 for driving force reception. FIG. 27*c* shows the developer supply container 1 after the developer discharge hole 1*b* was fully connected with the developer reception hole 10*b* by the rotation of the developer supply container 1.

The developer supply container 1 in the embodiments of the present invention, which were described up to this point, were structured so that the container proper 1*a* was automatically rotated with the utilization of the driving force transmitting means. However, the developer supply container 1 in this embodiment is different from the preceding ones in that it is provided with a rotational cylindrical shutter, which is fitted around the container proper 1*a* in such a manner that it is automatically rotated.

That is, the developer supply container 1 in this embodiment has a so-called double-cylinder structure. More specifically, it has an inner cylinder 800 (which functions as container proper) in which developer is stored, and an outer cylinder 300 (which functions as container shutter), which is a rotatable member fitted around the inner cylinder 800.

The inner cylinder 800 is provided with gears 5 and 6 as is the container proper 1*a* of the developer supply container 1 in the first embodiment. It is also provided with a guiding groove 700, a pair of connective projections 1*e*, and a guiding projection 1*g*. The guiding groove 700 is structured so that a guiding projection 500, with which the peripheral surface of the inner cylinder is provided, can be inserted. It plays the role of guiding the outer cylinder when the outer cylinder is rotated relative to the inner cylinder. Further, the mounting guide 1*g* is for regulating the developer supply container 1 in the angle and attitude relative to the developer receiving apparatus 10 when the developer supply container 1 is inserted into the developer receiving apparatus 10. Further, the shaft portion of the gear 5 is solidly attached to the shaft portion of the stirring member 4 in the inner cylinder so that the gear 5 and stirring member 4 rotate together. That is, the developer supply container 1 is structured so that it is difficult for the gears 5 and 6 to rotate relative to the outer cylinder 300 when the gears 5 and 6 are driven by the gear 12 of the developer receiving apparatus 10. Thus, as the gears 5 and 6 are driven by the gear 12, the developer supply container 1 is automatically rotated to be set for developer discharge.

In this embodiment, the inner cylinder 800 is provided with a hole 900 for discharging the developer. Further, the outer cylinder 300 is provided with a hole 400 (which functions as developer outlet) which connects to the hole 900 to discharge the developer. Immediately after the completion of the insertion of the developer supply container 1, the hole 900 of the inner cylinder and the hole 400 of the outer cylinder are not in connection with each other. That is, the outer cylinder 300 is still playing the role of being a container shutter.

Further, the hole of the outer cylinder 300 is kept sealed with a sealing film 600, which is attached to the outer cylinder 300 so that it can be peeled away by a user before the developer supply container 1 is rotated after the insertion of the developer supply container 1 into the developer receiving apparatus 10.

Further, the developer supply container 1 is provided with an elastic seal, which is placed between the inner and outer cylinders 800 and 300 in a manner to surround the hole 900 of the inner cylinder 800 to prevent the developer from leaking. This elastic seal is kept compressed by a preset amount, by the inner and outer cylinders 800 and 300.

Immediately after the insertion of the developer supply container 1 into the developer receiving apparatus 10, the hole 900 of the inner cylinder is in alignment with the developer reception hole of the developer receiving apparatus 10, whereas the hole 400 of the outer cylinder 300 is not in alignment with the developer reception hole of the developer receiving apparatus 10, facing roughly straight upward.

The developer supply container 1 is to be rotated to be set for developer discharge while it is in the above described condition, as is the developer supply container 1 in the first embodiment described above (FIG. 27*a*→27*b*→27(*cc*)). As the developer supply container 1 is rotated, only the outer cylinder is automatically rotated relative to the inner cylinder which remains attached to the developer receiving apparatus 10 in such a manner that it is virtually impossible to rotate the inner cylinder.

That is, the developing device shutter is opened by the operation for rotating the developer supply container 1 into its operational position (developer discharging position). Further, the hole 900 of the outer cylinder 800 is made to directly face the developer reception hole of the developer receiving apparatus 10 (FIG. 27*c*). As a result, the hole 400 of the inner cylinder, hole 900 of the outer cylinder, and developer reception hole of the developer receiving apparatus 10 become perfectly aligned and connected; it becomes possible for the developer receiving apparatus 10 to be supplied with the developer.

The operation for taking the developer supply container 1 in this embodiment out of the developer receiving apparatus 10 is the same as those in the preceding embodiments above described. That is, the outer cylinder 300 is to be rotated in the opposite direction from the direction in which it was rotated to be set for developer discharge (FIG. 27*c*→27*b*→27*a*). As the developer supply container 1 is rotated, the operation for resealing the hole 400 of the inner cylinder 300, and the operation for resealing the developer reception hole of the developer receiving apparatus 10, are sequentially carried out by the rotation of the outer cylinder 300. The hole 900 of the outer cylinder remains unsealed. However, when the developer supply container 1 is removed from the developer receiving apparatus 10, the hole 400 of the inner cylinder has been already resealed by the outer cylinder, and in addition, the hole 900 of the outer cylinder 800 is facing virtually straight upward. Therefore, the amount by which the developer scatter when the developer supply container 1 is removed is minuscule.

In this embodiment, the hole 400 is in the cylindrical wall of the container proper 1*a*. However, the location of the hole 400 does not need to be the location in this embodiment. For example, the shape of the container shutter may be made to resemble that of the container shutter in the first embodiment, so that as the outer cylinder resembling the container shutter in the first embodiment is rotated away from the hole 900 of the inner cylinder to "unseal" the developer supply container 1. That is, in this case, the outer cylinder is not provided with a hole (400) dedicated to developer discharge.

In the above, the present invention has been described with reference to each of the developer supply containers and developer supply system in the first to eight embodiments of the present invention. However, the structural features of the developer supply containers and developer supply systems in the first to eight embodiments may be modified, combined, and/or replaced as fits, as long as the changes fall within the scope of the present invention.

INDUSTRIAL APPLICABILITY

As described above, according to the present invention, it is possible to provide a developer supply container which is significantly smaller in the amount of force necessary to drive the developer supply container after the rotation of the developer supply container in the direction to be set for developer discharge, than a developer supply container in accordance with the prior art.

While the developer supply container and the developer supply system of the invention have been described with reference to embodiments 1-8, the embodiments 1-8 may be combined or replaced within the concept of the present invention.

The invention claimed is:

1. A developer supply container comprising:

a substantially cylindrical container including an inner space configured to contain developer and an opening provided on a peripheral portion of said cylindrical container and configured to permit discharge of the developer therein;

a developer feeder provided in said cylindrical container and configured to feed the developer in said cylindrical container toward said opening by rotation thereof relative to said cylindrical container;

a gear train provided on a longitudinal end surface of said cylindrical container and configured to transmit a rotational driving force to said developer feeder; and a flip-flop mechanism, provided with a spring, configured and positioned to be movable between a first position where rotation of said gear train relative to said cylindrical container is substantially restricted and a second position where rotation of said gear train relative to said cylindrical container is not substantially restricted.

2. A developer supply container according to claim 1, wherein said flip-flop mechanism includes a lever portion configured and positioned to receive a force for moving said flip-flop mechanism from the second position toward the first position.

3. A developer supply container according to claim 1 or 2, wherein said gear train includes a first gear which is coaxially rotatable with said developer feeder, and a second gear which is noncoaxially rotatable with said developer feeder.

4. A developer supply container according to claim 3, wherein said first gear is rotatable about a rotation center of said cylindrical container.

5. A developer supply container according to claim 3, wherein said second gear is a stepped gear having a larger diameter gear portion and a smaller diameter gear portion which is engaged with said first gear.

6. A developer supply container according to claim 1, wherein when said flip-flop mechanism is in the first position, said flip-flop mechanism is configured to substantially restrict the rotation of said gear train relative to said cylindrical container to cause said cylindrical container to rotate.

7. A developer supply container according to claim 1, wherein when said flip-flop mechanism is in the first position, said flip-flop mechanism is configured to lock rotation of said gear train relative to said cylindrical container.

* * * * *